US007506942B2

(12) United States Patent
Martinez

(10) Patent No.: US 7,506,942 B2
(45) **Date of Patent: *Mar. 24, 2009**

(54) PRINTING APPARATUS

(76) Inventor: Raul Martinez, 152 5th St., Del Mar, CA (US) 92014

( * ) Notice: Subject to any disclaimer, the term of this patent is extended or adjusted under 35 U.S.C. 154(b) by 0 days.

This patent is subject to a terminal disclaimer.

(21) Appl. No.: 11/492,648

(22) Filed: Jul. 24, 2006

(65) Prior Publication Data

US 2007/0070098 A1 Mar. 29, 2007

Related U.S. Application Data

(63) Continuation of application No. 11/150,090, filed on Jun. 11, 2005, now Pat. No. 7,111,915, which is a continuation-in-part of application No. 10/623,299, filed on Jul. 17, 2003, now Pat. No. 6,918,641, which is a continuation-in-part of application No. 09/877,828, filed on Jun. 8, 2001, now Pat. No. 6,746,093.

(51) Int. Cl.
*B41J 3/00* (2006.01)

(52) U.S. Cl. ..... 347/2; 347/104; 82/152; 141/1

(58) Field of Classification Search ..... 347/1, 347/2, 4, 104–105, 107; 82/117–118, 152; 101/35, 36, 38.1; 141/1; 142/1; 409/165
See application file for complete search history.

(56) References Cited

U.S. PATENT DOCUMENTS 6,913,335 B2 7/2005 Martinez ..... 347/2
7,111,915 B2 * 9/2006 Martinez et al. ..... 347/2

* cited by examiner

*Primary Examiner*—Juanita D Stephens

(57) ABSTRACT

A method and apparatus for imprinting high quality images on non-planar surfaces, including the surfaces of various types of three-dimensional articles, such as baseball bats, formed from a number of different types of materials. In the preferred method of the invention, the non-planar surfaces of the three-dimensional articles are printed using a uniquely modified ink jet image transfer technique. The apparatus of the invention includes an ink jet printer coupled with a novel article positioning apparatus which functions to support a plurality of circumferentially spaced-apart articles, to move a selected one of the circumferentially spaced articles into proximity with the ink jet printer and to controllably rotate the selected one of the circumferentially spaced articles.

4 Claims, 56 Drawing Sheets

-26-
19
18
L
B
T
H
10
34
8
60
8
36
40
68
64
30
42
42a
42b
10
7
7
22b
31
24
6
14
-22-

244
196
196a
196b
196c
196d
C
M
Y
K
248
246a
248a
260
246
256
230
227
224
278
236
272
234
270a
232
236
234
284
208
202
202a
266
-200-
270
270b
274
248a
268
202a

*Physical relationship of pixel position on the Bat to which nozzle delivers the drop*
*(Repeated for each color plane)*
*Alpha numeric in grid cell indicates which nozzle delivers the pixel on each revolution*

Fig. 46 A

*Image Size: 48x16 pixels*
*Nozzle Count: 8 (8th disabled in this example)*
*Nozzle Pitch: 4 Image Lines*

*Printmode: 1 Pass*
*Head Advance Per Revolution: 7 Image Lines*

| Vertical Pixel | Image Pixel Rotation (degrees) | 0<br>0.0000 | 1<br>0.0625 | 2<br>0.1250 | 3<br>0.1875 | 4<br>0.2500 | 5<br>0.3125 | 6<br>0.3750 | 7<br>0.4375 | 8<br>0.5000 | 9<br>0.5625 | 10<br>0.6250 | 11<br>0.6875 |
|---|---|---|---|---|---|---|---|---|---|---|---|---|---|
| 15 | 337.5 | 6-D | 4 | 2-A | 7-D | 5-C | 3-B | 1-A | 6-D | 4-C | 2-B | 7-E | 5-D |
| 14 | 315 | 6-D | 4 | 2-A | 7-D | 5-C | 3-B | 1-A | 6-D | 4-C | 2-B | 7-E | 5-D |
| 13 | 292.5 | 4-C | 2-A | 7-D | 5-C | 3-B | 1-A | 6-D | 4-C | 2-B | 7-E | 5-D | 3-C |
| 12 | 270 | 4-C | 2-A | 7-D | 5-C | 3-B | 1-A | 6-D | 4-C | 2-B | 7-E | 5-D | 3-C |
| 11 | 247.5 | 4-C | 2-A | 7-D | 5-C | 3-B | 1-A | 6-D | 4-C | 2-B | 7-E | 5-D | 3-C |
| 10 | 225 | 2-A | 7-D | 5-C | 3-B | 1-A | 6-D | 4-C | 2-B | 7-E | 5-D | 3-C | 1-B |
| 9 | 202.5 | 2-A | 7-D | 5-C | 3-B | 1-A | 6-D | 4-C | 2-B | 7-E | 5-D | 3-C | 1-B |
| 8 | 180 | 7-D | 5-C | 3-B | 1-A | 6-D | 4-C | 2-B | 7-E | 5-D | 3-C | 1-B | 6-E |
| 7 | 157.5 | 7-D | 5-C | 3-B | 1-A | 6-D | 4-C | 2-B | 7-E | 5-D | 3-C | 1-B | 6-E |
| 6 | 135 | 5-C | 3-B | 1-A | 6-D | 4-C | 2-B | 7-E | 5-D | 3-C | 1-B | 6-E | 4-D |
| 5 | 112.5 | 5-C | 3-B | 1-A | 6-D | 4-C | 2-B | 7-E | 5-D | 3-C | 1-B | 6-E | 4-D |
| 4 | 90 | 5-C | 3-B | 1-A | 6-D | 4-C | 2-B | 7-E | 5-D | 3-C | 1-B | 6-E | 4-D |
| 3 | 67.5 | 3-B | 1-A | 6-D | 4-C | 2-B | 7-E | 5-D | 3-C | 1-B | 6-E | 4-D | 2-C |
| 2 | 45 | 3-B | 1-A | 6-D | 4-C | 2-B | 7-E | 5-D | 3-C | 1-B | 6-E | 4-D | 2-C |
| 1 | 22.5 | 1-A | 6-D | 4-C | 2-B | 7-E | 5-D | 3-C | 1-B | 6-E | 4-D | 2-C | 7-F |
| 0 | 0 | 1-A | 6-D | 4-C | 2-B | 7-E | 5-D | 3-C | 1-B | 6-E | 4D | 2-C | 7-F |

| | |
|---|---|
| A | *Indicated Pixel printed on 1st revolution* |
| B | *Indicated Pixel printed on 2nd revolution* |
| C | *Indicated Pixel printed on 3rd revolution* |
| D | *Indicated Pixel printed on 4th revolution* |
| E | *Indicated Pixel printed on 5th revolution* |
| F | *Indicated Pixel printed on 6th revolution* |
| G | *Indicated Pixel printed on 7th revolution* |
| I | *Indicated Pixel printed on 8th revolution* |
| J | *Indicated Pixel printed on 9th revolution* |
| K | *Indicated Pixel printed on 10th revolution* |
| L | *Indicated Pixel printed on 11th revolution* |

| 12<br>0.7500 | 13<br>0.8125 | 14<br>0.8750 | 15<br>0.9375 | 16<br>1.0000 | 17<br>1.0625 | 18<br>1.1250 | 19<br>1.1875 | 20<br>1.2500 | 21<br>1.3125 | 22<br>1.3750 | 23<br>1.4375 | 24<br>1.5000 |
|---|---|---|---|---|---|---|---|---|---|---|---|---|
| 3-C | 1-B | 6-E | 4-D | 2-C | 7-F | 5-E | 3-D | 1-C | 6-F | 4-E | 2-D | 7-G |
| 3-C | 1-B | 6-E | 4-D | 2-C | 7-F | 5-E | 3-D | 1-C | 6-F | 4-E | 2-D | 7-G |
| 1-B | 6-E | 4-D | 2-C | 7-F | 5-E | 3-D | 1-C | 6-F | 4-E | 2-D | 7-G | 5-F |
| 1-B | 6-E | 4-D | 2-C | 7-F | 5-E | 3-D | 1-C | 6-F | 4-E | 2-D | 7-G | 5-F |
| 1-B | 6-E | 4-D | 2-C | 7-F | 5-E | 3-D | 1-C | 6-F | 4-E | 2-D | 7-G | 5-F |
| 6-E | 4-D | 2-C | 7-F | 5-E | 3-D | 1-C | 6-F | 4-E | 2-D | 7-G | 5-F | 3-E |
| 6-E | 4-D | 2-C | 7-F | 5-E | 3-D | 1-C | 6-F | 4-E | 2-D | 7-G | 5-F | 3-E |
| 4-D | 2-C | 7-F | 5-E | 3-D | 1-C | 6-F | 4-E | 2-D | 7-G | 5-F | 3-E | 1-D |
| 4-D | 2-C | 7-F | 5-E | 3-D | 1-C | 6-F | 4-E | 2-D | 7-G | 5-F | 3-E | 1-D |
| 2-C | 7-F | 5-E | 3-D | 1-C | 6-F | 4-E | 2-D | 7-G | 5-F | 3-E | 1-D | 6-G |
| 2-C | 7-F | 5-E | 3-D | 1-C | 6-F | 4-E | 2-D | 7-G | 5-F | 3-E | 1-D | 6-G |
| 2-C | 7-F | 5-E | 3-D | 1-C | 6-F | 4-E | 2-D | 7-G | 5-F | 3-E | 1-D | 6-G |
| 7-F | 5-E | 3-D | 1-C | 6-F | 4-E | 2-D | 7-G | 5-F | 3-E | 1-D | 6-G | 4-F |
| 7-F | 5-E | 3-D | 1-C | 6-F | 4-E | 2-D | 7-G | 5-F | 3-E | 1-D | 6-G | 4-F |
| 5-E | 3-D | 1-C | 6-F | 4-E | 2-D | 7-G | 5-F | 3-E | 1-D | 6-G | 4-F | 2-E |
| 5-E | 3-D | 1-C | 6-F | 4-E | 2-D | 7-G | 5-F | 3-E | 1-D | 6-G | 4-F | 2-E |

Fig. 46 B

| 25<br>1.5625 | 26<br>1.6250 | 27<br>1.6875 | 28<br>1.7500 | 29<br>1.8125 | 30<br>1.8750 | 31<br>1.9375 | 32<br>2.0000 | 33<br>2.0625 | 34<br>2.1250 | 35<br>2.1875 | 36<br>2.2500 |
|---|---|---|---|---|---|---|---|---|---|---|---|
| 5-F | 3-E | 1-D | 6-G | 4-F | 2-E | 7-I | 5-G | 3-F | 1-E | 6-I | 4-G |
| 5-F | 3-E | 1-D | 6-G | 4-F | 2-E | 7-I | 5-G | 3-F | 1-E | 6-I | 4-G |
| 3-E | 1-D | 6-G | 4-F | 2-E | 7-I | 5-G | 3-F | 1-E | 6-I | 4-G | 2-F |
| 3-E | 1-D | 6-G | 4-F | 2-E | 7-I | 5-G | 3-F | 1-E | 6-I | 4-G | 2-F |
| 3-E | 1-D | 6-G | 4-F | 2-E | 7-I | 5-G | 3-F | 1-E | 6-I | 4-G | 2-F |
| 1-D | 6-G | 4-F | 2-E | 7-I | 5-G | 3-F | 1-E | 6-I | 4-G | 2-F | 7-J |
| 1-D | 6-G | 4-F | 2-E | 7-I | 5-G | 3-F | 1-E | 6-I | 4-+G | 2-F | 7-J |
| 6-G | 4-F | 2-E | 7-I | 5-G | 3-F | 1-E | 6-I | 4-G | 2-F | 7-J | 5-I |
| 6-G | 4-F | 2-E | 7-I | 5-G | 3-F | 1-E | 6-I | 4-G | 2-F | 7-J | 5-I |
| 4-F | 2-E | 7-I | 5-G | 3-F | 1-E | 6-I | 4-G | 2-F | 7-J | 5-I | 3-G |
| 4-F | 2-E | 7-I | 5-G | 3-F | 1-E | 6-I | 4-G | 2-F | 7-J | 5-I | 3-G |
| 4-F | 2-E | 7-I | 5-G | 3-F | 1-E | 6-I | 4-G | 2-F | 7-J | 5-I | 3-G |
| 2-E | 7-I | 5-G | 3-F | 1-E | 6-I | 4-G | 2-F | 7-J | 5-I | 3-G | 1-F |
| 2-E | 7-I | 5-G | 3-F | 1-E | 6-I | 4-G | 2-F | 7-J | 5-I | 3-G | 1-F |
| 7-I | 5-G | 3-F | 1-E | 6-I | 4-G | 2-F | 7-J | 5-I | 3-G | 1-F | 7-J |
| 7-I | 5-G | 3-F | 1-E | 6-I | 4-G | 2-F | 7-J | 5-I | 3-G | 1-F | 7-J |

Fig. 46 C

| 37<br>2.3125 | 38<br>2.3750 | 39<br>2.4375 | 40<br>2.5000 | 41<br>2.5625 | 42<br>2.6250 | 43<br>2.6875 | 44<br>2.7500 | 45<br>2.8125 | 46<br>2.8750 | 47<br>2.9375 | 48<br>3.0000 |
|---|---|---|---|---|---|---|---|---|---|---|---|
| 2-F | 7-J | 5-I | 3-G | 1-F | 6-J | 4-I | 2-G | 7-K | 5-J | 3-I | 1-G |
| 2-F | 7-J | 5-I | 3-G | 1-F | 6-J | 4-I | 2-G | 7-K | 5-J | 3-I | 1-G |
| 7-J | 5-I | 3-G | 1-F | 6-J | 4-I | 2-G | 7-K | 5-J | 3-I | 1-G | 6-K |
| 7-J | 5-I | 3-G | 1-F | 6-J | 4-I | 2-G | 7-K | 5-J | 3-I | 1-G | 6-K |
| 7-J | 5-I | 3-G | 1-F | 6-J | 4-I | 2-G | 7-K | 5-J | 3-I | 1-G | 6-K |
| 5-I | 3-G | 1-F | 6-J | 4-I | 2-G | 7-K | 5-J | 3-I | 1-G | 6-K | 4-J |
| 5-I | 3-G | 1-F | 6-J | 4-I | 2-G | 7-K | 5-J | 3-I | 1-G | 6-K | 4-J |
| 3-G | 1-F | 6-J | 4-I | 2-G | 7-K | 5-J | 3-I | 1-G | 6-K | 4-J | 2-I |
| 3-G | 1-F | 6-J | 4-I | 2-G | 7-K | 5-J | 3-I | 1 | 6-K | 4-J | 2-I |
| 1-F | 6-J | 4-I | 2-G | 7-K | 5-J | 3-I | 1-G | 6-K | 4-J | 2-I | 7-L |
| 1-F | 6-J | 4-I | 2-G | 7-K | 5-J | 3-I | 1-G | 6-K | 4-J | 2-I | 7-L |
| 1-F | 6-J | 4-I | 2-G | 5-J | 5-J | 3-I | 1-G | 6-K | 4-J | 2-I | 7-L |
| 6-J | 4-I | 2-G | 7-K | 5-J | 3-I | 1-G | 6-K | 4-J | 2-I | 7-L | 5-K |
| 6-J | 4-I | 2-G | 7-K | 5-J | 3-I | 1-G | 6-K | 4-J | 2-I | 7-L | 5-K |
| 4-I | 2-G | 7-K | 5-J | 3-I | 1-G | 6-K | 4-J | 2-I | 7-L | 5-K | 3-J |
| 4-I | 2-G | 7-K | 5-J | 3-I | 1-G | 6-K | 4-J | 2-I | 7-L | 5-K | 3-J |

Fig. 46 D

| 49<br>3.0625 | 50<br>3.1250 | 51<br>3.1875 | 52<br>3.2500 | 53<br>3.3125 | 54<br>3.3750 | 55<br>3.4375 |
|---|---|---|---|---|---|---|
| 6-K | 4-J | 2-I | 7-L | 5-K | 3-J | 1-I |
| 6-K | 4-J | 2-I | 7-L | 5-K | 3-J | 1-I |
| 4-J | 2-I | 7-L | 5-K | 3-J | 1-I | |
| 4-J | 2-I | 7-L | 5-K | 3-J | 1-I | |
| 4-J | 2-I | 7-L | 5-K | 3-J | 1-I | |
| 2-I | 7-L | 5-K | 3-J | 1-I | | |
| 2-I | 7-L | 5-K | 3-J | 1-I | | |
| 7-L | 5-K | 3-J | 1-I | | | |
| 7-L | 5-K | 3-J | 1-I | | | |
| 5-K | 3-J | 1-I | | | | |
| 5-K | 3-J | 1-I | | | | |
| 5-K | 3-J | 1-I | | | | |
| 3-J | 1-I | | | | | |
| 3-J | 1-I | | | | | |
| 1-I | | | | | | |
| 1-I | | | | | | |

No ink actually jetted beyond 48 due to off edge of image

Fig. 46 E

Image Size: 24x16 pixels
Nozzle Count: 8 (8th disabled in this example)
Nozzle Pitch: 4 Image Lines

Printmode: 2 Pass
Head Advance Per Revolution: 3.5 Image Lines

| Vertical Pixel | Image Pixel / Rotation (degrees | 0 / 0.0000 | 0.5 / 0.0625 | 1 / 0.1250 | 1.5 / 0.1875 | 2 / 0.2500 | 2.5 / 0.3125 | 3 / 0.3750 | 3.5 / 0.4375 | 4 / 0.5000 | 4.5 / 0.5625 |
|---|---|---|---|---|---|---|---|---|---|---|---|
| 15 | 337.5 | 6-C | 4-B | 2-A | 7-D | 5-C | 3-B | 1-A | 6-D | 4-C | 2-B |
| 14 | 315 | 6-C | 4-B | 2-A | 7-D | 5-C | 3-B | 1-A | 6-D | 4-C | 2-B |
| 13 | 292.5 | 4-B | 2-A | 7-D | 5-C | 3-B | 1-A | 6-D | 4-C | 2-B | 7-E |
| 12 | 270 | 4-B | 2-A | 7-D | 5-C | 3-B | 1-A | 6-D | 4-C | 2-B | 7-E |
| 11 | 247.5 | 4-B | 2-A | 7-D | 5-C | 3-B | 1-A | 6-D | 4-C | 2-B | 7-E |
| 10 | 225 | 2-A | 7-D | 5-C | 3-B | 1-A | 6-D | 4-C | 2-B | 7-E | 5-D |
| 9 | 202.5 | 2-A | 7-D | 5-C | 3-B | 1-A | 6-D | 4-C | 2-B | 7-E | 5-D |
| 8 | 180 | 7-D | 5-C | 3-B | 1-A | 6-D | 4-C | 2-B | 7-E | 5-D | 3-C |
| 7 | 157.5 | 7-D | 5-C | 3-B | 1-A | 6-D | 4-C | 2-B | 7-E | 5-D | 3-C |
| 6 | 135 | 5-C | 3-B | 1-A | 6-D | 4-C | 2-B | 7-E | 5-D | 3-C | 1-B |
| 5 | 112.5 | 5-C | 3-B | 1-A | 6-D | 4-C | 2-B | 7-E | 5-D | 3-C | 1-B |
| 4 | 90 | 5-C | 3-B | 1-A | 6-D | 4-C | 2-B | 7-E | 5-D | 3-C | 1-B |
| 3 | 67.5 | 3-B | 1-A | 6-D | 4-C | 2-B | 7-E | 5-D | 3-C | 1-B | 6-E |
| 2 | 45 | 3-B | 1-A | 6-D | 4-C | 2-B | 7-E | 5-D | 3-C | 1-B | 6-E |
| 1 | 22.5 | 1-A | 6-D | 4-C | 2-B | 7-E | 5-D | 3-C | 1-B | 6-E | 4-D |
| 0 | 0 | 1-A | 6-D | 4-C | 2-B | 7-E | 5-D | 3-C | 1-B | 6-E | 4-D |

Fig. 47 A

| | |
|---|---|
| A | *Indicated Pixel printed on 1st revolution* |
| B | *Indicated Pixel printed on 2nd revolution* |
| C | *Indicated Pixel printed on 3rd revolution* |
| D | *Indicated Pixel printed on 4th revolution* |
| E | *Indicated Pixel printed on 5th revolution* |
| F | *Indicated Pixel printed on 6th revolution* |
| G | *Indicated Pixel printed on 7th revolution* |
| I | *Indicated Pixel printed on 8th revolution* |
| J | *Indicated Pixel printed on 9th revolution* |
| K | *Indicated Pixel printed on 10th revolution* |
| L | *Indicated Pixel printed on 11th revolution* |

| 5 | 5.5 | 6 | 6.5 | 7 | 7.5 | 8 | 8.5 | 9 | 9.5 | 10 | 10.5 | 11 |
|---|---|---|---|---|---|---|---|---|---|---|---|---|
| 0.6250 | 0.6875 | 0.7500 | 0.8125 | 0.8750 | 0.9375 | 1.0000 | 1.0625 | 1.1250 | 1.1875 | 1.2500 | 1.3125 | 1.3750 |

| | | | | | | | | | | | | |
|---|---|---|---|---|---|---|---|---|---|---|---|---|
| 7-E | 5-D | 3-C | 1-B | 6-E | 4-D | 2-C | 7-F | 5-E | 3-D | 1-C | 6-F | 4-E |
| 7-E | 5-D | 3-C | 1-B | 6-E | 4-D | 2-C | 7-F | 5-E | 3-D | 1-C | 6-F | 4-E |
| 5-D | 3-C | 1-B | 6-E | 4-D | 2-C | 7-F | 5-E | 3-D | 1-C | 6-F | 4-E | 2-D |
| 5-D | 3-C | 1-B | 6-E | 4-D | 2-C | 7-F | 5-E | 3-D | 1-C | 6-F | 4-E | 2-D |
| 5-D | 3-C | 1-B | 6-E | 4-D | 2-C | 7-F | 5-E | 3-D | 1-C | 6-F | 4-E | 2-D |
| 3-C | 1-B | 6-E | 4-D | 2-C | 7-F | 5-E | 3-D | 1-C | 6-F | 4-E | 2-D | 7-G |
| 3-C | 1-B | 6-E | 4-D | 2-C | 7-F | 5-E | 3-D | 1-C | 6-F | 4-E | 2-D | 7-G |
| 1-B | 6-E | 4-D | 2-C | 7-F | 5-E | 3-D | 1-C | 6-F | 4-E | 2D | 7-G | 5-F |
| 1-B | 6-E | 4-D | 2-C | 7-F | 5-E | 3-D | 1-C | 6-F | 4-E | 2-D | 7-G | 5-F |
| 6-E | 4-D | 2-C | 7-F | 5-E | 3-D | 1-C | 6-F | 4-E | 2-D | 7-G | 5-F | 3-E |
| 6-E | 4-D | 2-C | 7-F | 5-E | 3-D | 1-C | 6-F | 4-E | 2-D | 7-G | 5-F | 3-E |
| 6-E | 4-D | 2-C | 7-F | 5-E | 3-D | 1-C | 6-F | 4-E | 2-D | 7-G | 5-F | 3-E |
| 4-D | 2-C | 7-F | 5-E | 3-D | 1-C | 6-F | 4-E | 2-D | 7-G | 5-F | 3-E | 1-D |
| 4-D | 2-C | 7-F | 5-E | 3-D | 1-C | 6-F | 4-E | 2-D | 7-G | 5-F | 3-E | 1-D |
| 2-C | 7-F | 5-E | 3-D | 1-C | 6-F | 4-E | 2-D | 7-D | 5-F | 3-E | 1-D | 6-G |
| 2-C | 7-F | 5-E | 3-D | 1-C | 6-F | 4-E | 2-D | 7-G | 5-F | 3-E | 1-D | 6-G |

Fig. 47 B

| 11.5 | 12 | 12.5 | 13 | 13.5 | 14 | 14.5 | 15 | 15.5 | 16 | 16.5 | 17 | 17.5 |
|---|---|---|---|---|---|---|---|---|---|---|---|---|
| 1.4375 | 1.5000 | 1.5625 | 1.6250 | 1.6875 | 1.7500 | 1.8125 | 1.8750 | 1.9375 | 2.0000 | 2.0625 | 2.1250 | 2.1875 |

| | | | | | | | | | | | | |
|---|---|---|---|---|---|---|---|---|---|---|---|---|
| 2-D | 7-G | 5-F | 3-E | 1-D | 6-G | 4-F | 2-E | 7-I | 5-G | 3-F | 1-E | 6-I |
| 2-D | 7-G | 5-F | 3-E | 1-D | 6-G | 4-F | 2-E | 7-I | 5-G | 3-F | 1-E | 6-I |
| 7-G | 5-F | 3-E | 1-D | 6-G | 4-F | 2-E | 7-I | 5-G | 3-F | 1-E | 6-I | 4-G |
| 7-G | 5-F | 3-E | 1-D | 6-G | 4-F | 2-E | 7-I | 5-G | 3-F | 1-E | 6-I | 4-G |
| 7-G | 5-G | 3-E | 1-D | 6-G | 4-F | 2-E | 7-I | 5-G | 3-F | 1-E | 6-I | 4-G |
| 5-F | 3-E | 1-D | 6-G | 4-F | 2-E | 7-I | 5-G | 3-F | 1-E | 6-I | 4-G | 2-F |
| 5-F | 3-E | 1-D | 6-G | 4-F | 2-E | 7-I | 5-G | 3-F | 1-E | 6-I | 4-G | 2-F |
| 3-E | 1-D | 6-G | 4-F | 2-E | 7-I | 5-G | 3-F | 1-E | 6-I | 4-G | 2-F | 7-J |
| 3-E | 1-D | 6-G | 4-F | 2-E | 7-I | 5-G | 3-F | 1-E | 6-I | 4-G | 2-F | 7-J |
| 1-D | 6-G | 4-F | 2-E | 7-I | 5-G | 3-F | 1-E | 6-I | 4-G | 2-F | 7-J | 5-I |
| 1-D | 6-G | 4-F | 2-E | 7-I | 5-G | 3-F | 1-E | 6-I | 4-G | 2-F | 7-J | 5-I |
| 1-D | 6-G | 4-F | 2-E | 7-I | 5-G | 3-F | 1-E | 6-I | 4-G | 2-F | 7-J | 5-I |
| 6-G | 4-F | 2-E | 7-I | 5-G | 3-F | 1-E | 6-I | 4-G | 2-F | 7-J | 5-I | 3-G |
| 6-G | 4-F | 2-E | 7-I | 5-G | 3-F | 1-E | 6-I | 4-G | 2-F | 7-J | 5-I | 3-G |
| 4-F | 2-E | 7-I | 5-G | 3-F | 1-E | 6-I | 4-G | 2-F | 7-J | 5-I | 3-G | 1-F |
| 4-F | 2-E | 7-I | 5-G | 3-F | 1-E | 6-I | 4-G | 2-F | 7-J | 5-I | 3-G | 1-F |

Fig. 47 C

| 18 | 18.5 | 19 | 19.5 | 20 | 20.5 | 21 | 21.5 | 22 | 22.5 | 23 | 23.5 |
|---|---|---|---|---|---|---|---|---|---|---|---|
| 2.2500 | 2.3125 | 2.3750 | 2.4375 | 2.5000 | 2.5625 | 2.6250 | 2.6875 | 2.7500 | 2.8125 | 2.8750 | 2.9375 |

| | | | | | | | | | | | |
|---|---|---|---|---|---|---|---|---|---|---|---|
| 4-G | 2-F | 7-J | 5-I | 3-G | 1-F | 6-J | 4-I | 2-G | 7-K | 5-J | 3-I |
| 4-G | 2-F | 7-J | 5-I | 3-G | 1-F | 6-J | 4-I | 2-G | 7-K | 5-J | 3-I |
| 2-F | 7-J | 5-I | 3-G | 1-F | 6-J | 4-I | 2-G | 7-K | 5-J | 3-I | 1-G |
| 2-F | 7-J | 5-I | 3-G | 1-F | 6-J | 4-I | 2-G | 7-K | 5-J | 3-I | 1-G |
| 2-F | 7-J | 5-I | 3-G | 1-F | 6-J | 4-I | 2-G | 7-K | 5-J | 3-I | 1-G |
| 7-J | 5-I | 3-G | 1-F | 6-J | 4-I | 2-G | 7-K | 5-J | 3-I | 1-G | 6-K |
| 7-J | 5-I | 3-G | 1-F | 6-J | 4-I | 2-G | 7-K | 5-J | 3-I | 1-G | 6-K |
| 5-I | 3-G | 1-F | 6-J | 4-I | 2-G | 7-K | 5-J | 3-I | 1-G | 6-K | 4-J |
| 5-I | 3-G | 1-F | 6-J | 4-I | 2-G | 7-K | 5-J | 3-I | 1-G | 6-K | 4-J |
| 3-G | 1-F | 6-J | 4-I | 2-G | 7-K | 5-J | 3-I | 1-G | 6-K | 4-J | 2-I |
| 3-G | 1-F | 6-J | 4-I | 2-G | 7-K | 5-J | 3-I | 1-G | 6-K | 4-J | 2-I |
| 3-G | 1-F | 6-J | 4-I | 2-G | 5-J | 5-J | 3-I | 1-G | 6-K | 4-J | 2-I |
| 1-F | 6-J | 4-I | 2-G | 7-K | 5-J | 3-I | 1-G | 6-K | 4-J | 2-I | 7-L |
| 1-F | 6-J | 4-I | 2-G | 7-K | 5-J | 3-I | 1-G | 6-K | 4-J | 2-I | 7-L |
| 6-J | 4-I | 2-G | 7-K | 5-J | 3-I | 1-G | 6-K | 4-J | 2-I | 7-L | 5-K |
| 6-J | 4-I | 2-G | 7-K | 5-J | 3-I | 1-G | 6-K | 4-J | 2-I | 7-L | 5-K |

Fig. 47 D

| 24 | 24.5 | 25 | 25.5 | 26 | 26.5 | 27 | 27.5 |
|---|---|---|---|---|---|---|---|
| 3.0000 | 3.0625 | 3.1250 | 3.1875 | 3.2500 | 3.3125 | 3.3750 | 3.4375 |

| | | | | | | | |
|---|---|---|---|---|---|---|---|
| 1-G | 6-K | 4-J | 2-I | 7-L | 5-K | 3-J | 1-I |
| 1-G | 6-K | 4-J | 2-I | 7-L | 5-K | 3-J | 1-I |
| 6-K | 4-J | 2-I | 7-L | 5-K | 3-J | 1-I | |
| 6-K | 4-J | 2-I | 7-L | 5-K | 3-J | 1-I | |
| 6-K | 4-J | 2-I | 7-L | 5-K | 3-J | 1-I | |
| 4-J | 2-I | 7-L | 5-K | 3-J | 1-I | | |
| 4-J | 2-I | 7-L | 5-K | 3-J | 1-I | | |
| 2-I | 7-L | 5-K | 3-J | 1-I | | | |
| 2-I | 7-L | 5-K | 3-J | 1-I | | | |
| 7-L | 5-K | 3-J | 1-I | | | | |
| 7-L | 5-K | 3-J | 1-I | | | | |
| 7-L | 5-K | 3-J | 1-I | | | | |
| 5-K | 3-J | 1-I | | | | | |
| 5-K | 3-J | 1-I | | | | | |
| 3-J | 1-I | | | | | | |
| 3-J | 1-I | | | | | | |

No ink actually jetted beyond 24 due to off edge of image

Fig. 47 E

Matrix to Calculate Nozzle to Column Mapping On Each Revolution of the Bat

*Advance/Rev (A) 63 (This is A=(N-1)/Passes)*
*Pitch of nozzles ( 8 (This is ImageDPI/PrintheadNozzlePitch)*
*Array should be widened for nozzles 0-127 and as many revolutions as required to complete the image.*

*Note: Nozzle-Revs with numbers less than 0 or greater than the last column of the image are located off the image during that revolution and will not be jetted.*

| Nozzle Number / Rev Number | 0 | 1 | 2 | 3 | 4 | 5 | 6 | 7 | 8 | 9 | ..... | 124 | 125 | 126 | 127 |
|---|---|---|---|---|---|---|---|---|---|---|---|---|---|---|---|
| 0 | 0 | -8 | -16 | -24 | -32 | -40 | -48 | -56 | -64 | -72 | ..... | -992 | -1000 | -1008 | -1016 |
| 1 | 63 | 55 | 47 | 39 | 31 | 23 | 15 | 7 | -1 | -9 | ..... | -929 | -937 | -945 | -953 |
| 2 | 126 | 118 | 110 | 102 | 94 | 86 | 78 | 70 | 62 | 54 | ..... | -866 | -874 | -882 | -890 |
| 3 | 189 | 181 | 173 | 165 | 157 | 149 | 141 | 133 | 125 | 117 | ..... | -803 | -811 | -819 | -827 |
| 4 | 252 | 244 | 236 | 228 | 220 | 212 | 204 | 196 | 188 | 180 | ..... | -740 | -748 | -756 | -764 |
| 5 | 315 | 307 | 299 | 291 | 283 | 275 | 267 | 259 | 251 | 243 | ..... | -677 | -685 | -693 | -701 |
| 6 | 378 | 370 | 362 | 354 | 346 | 338 | 330 | 322 | 314 | 306 | ..... | -614 | -622 | -630 | -638 |
| 7 | 441 | 433 | 425 | 417 | 409 | 401 | 393 | 385 | 377 | 369 | ..... | -551 | -559 | -567 | -575 |
| 8 | 504 | 496 | 488 | 480 | 472 | 464 | 456 | 448 | 440 | 432 | ..... | -488 | -496 | -504 | -512 |
| 9 | 567 | 559 | 551 | 543 | 535 | 527 | 519 | 511 | 503 | 495 | ..... | -425 | -433 | -441 | -449 |
| 10 | 630 | 622 | 614 | 606 | 598 | 590 | 582 | 574 | 566 | 558 | ..... | -362 | -370 | -378 | -386 |
| 11 | 693 | 685 | 677 | 669 | 661 | 653 | 645 | 637 | 629 | 621 | ..... | -299 | -307 | -315 | -323 |
| 12 | 756 | 748 | 740 | 732 | 724 | 716 | 708 | 700 | 692 | 684 | ..... | -236 | -244 | -252 | -260 |
| 13 | 819 | 811 | 803 | 795 | 787 | 779 | 771 | 763 | 755 | 747 | ..... | -173 | -181 | -189 | -197 |
| 14 | 882 | 874 | 866 | 858 | 850 | 842 | 834 | 826 | 818 | 810 | ..... | -110 | -118 | -126 | -134 |
| 15 | 945 | 937 | 929 | 921 | 913 | 905 | 897 | 889 | 881 | 873 | ..... | -47 | -55 | -63 | -71 |
| 16 | 1008 | 1000 | 992 | 984 | 976 | 968 | 960 | 952 | 944 | 936 | ..... | 16 | 8 | 0 | -8 |
| 17 | 1071 | 1063 | 1055 | 1047 | 1039 | 1031 | 1023 | 1015 | 1007 | 999 | ..... | 79 | 71 | 63 | 55 |
| 18 | 1134 | 1126 | 1118 | 1110 | 1102 | 1094 | 1086 | 1078 | 1070 | 1062 | ..... | 142 | 134 | 126 | 118 |
| 19 | 1197 | 1189 | 1181 | 1173 | 1165 | 1157 | 1149 | 1141 | 1133 | 1125 | ..... | 205 | 197 | 189 | 181 |
| 20 | 1260 | 1252 | 1244 | 1236 | 1228 | 1220 | 1212 | 1204 | 1196 | 1188 | ..... | 268 | 260 | 252 | 244 |
| 21 | 1323 | 1315 | 1307 | 1299 | 1291 | 1283 | 1275 | 1267 | 1259 | 1251 | ..... | 331 | 323 | 315 | 307 |
| 22 | 1386 | 1378 | 1370 | 1362 | 1354 | 1346 | 1338 | 1330 | 1322 | 1314 | ..... | 394 | 386 | 378 | 370 |
| 23 | 1449 | 1441 | 1433 | 1425 | 1417 | 1409 | 1401 | 1393 | 1385 | 1377 | ..... | 457 | 449 | 441 | 433 |
| 24 | 1512 | 1504 | 1496 | 1488 | 1480 | 1472 | 1464 | 1456 | 1448 | 1440 | ..... | 520 | 512 | 504 | 496 |
| 25 | 1575 | 1567 | 1559 | 1551 | 1543 | 1535 | 1527 | 1519 | 1511 | 1503 | ..... | 583 | 575 | 567 | 559 |
| 26 | 1638 | 1630 | 1622 | 1614 | 1606 | 1598 | 1590 | 1582 | 1574 | 1566 | ..... | 646 | 638 | 630 | 622 |
| 27 | 1701 | 1693 | 1685 | 1677 | 1669 | 1661 | 1653 | 1645 | 1637 | 1629 | ..... | 709 | 701 | 693 | 685 |
| 28 | 1764 | 1756 | 1748 | 1740 | 1732 | 1724 | 1716 | 1708 | 1700 | 1692 | ..... | 772 | 764 | 756 | 748 |
| 29 | 1827 | 1819 | 1811 | 1803 | 1795 | 1787 | 1779 | 1771 | 1763 | 1755 | ..... | 835 | 827 | 819 | 811 |
| 30 | 1890 | 1882 | 1874 | 1866 | 1858 | 1850 | 1842 | 1834 | 1826 | 1818 | ..... | 898 | 890 | 882 | 874 |
| 31 | 1953 | 1945 | 1937 | 1929 | 1921 | 1913 | 1905 | 1897 | 1889 | 1881 | ..... | 961 | 953 | 945 | 937 |
| 32 | 2016 | 2008 | 2000 | 1992 | 1984 | 1976 | 1968 | 1960 | 1952 | 1944 | ..... | 1024 | 1016 | 1008 | 1000 |
| 33 | 2079 | 2071 | 2063 | 2055 | 2047 | 2039 | 2031 | 2023 | 2015 | 2007 | ..... | 1087 | 1079 | 1071 | 1063 |

Fig. 48

PRINTING APPARATUS

This is a Continuation Application of U.S. application Ser. No. 11/150,090 filed Jun. 11, 2005, now U.S. Pat. No. 7,111,915, which is a Continuation-In-Part Application of U.S. application Ser. No. 10/623,299, filed on Jul. 17, 2003, now U.S. Pat. No. 6,918,641, which is a Continuation-in-Part of U.S. application Ser. No. 09/877,828 filed on Jun. 8, 2001, now U.S. Pat. No. 6,746,093.

BACKGROUND OF THE INVENTION

1. Field of the Invention

The present invention relates generally to methods and apparatus for imprinting images on the surfaces of three-dimensional objects. More particularly, the invention concerns a novel, improved method and apparatus for non-contact, high-quality, distortion-free printing of images on non-planar surfaces of three-dimensional objects using ink jet printing technology.

2. Discussion of the Prior Art

Various types of image transfer techniques have been suggested in the past for imprinting images on a number of different material surfaces including cloth, wood, metal and ceramics. A very common technique, which has been widely used, is silk screening. However, such a technique is generally limited to printing on smooth, flat surfaces. Further, such technique produces a relatively low quality print when compared to that produced by lithography, gravure, letterpress sublimation and laser printing.

When the image is to be transferred to a metal surface, prior art sublimation techniques are frequently used. For example, Blake, et al., U.S. Pat. No. 3,484,342 issued Dec. 16, 1969 and Fromson, et al., U.S. Pat. No. 4,201,821 issued May 6, 1980 both suggest decorating unsealed and coated anodized aluminum using sublimation techniques. However, sublimation processes also have substantial drawbacks, particularly when the surface of the object, which is to be printed, is non-planar.

When printing on non-planar surfaces is required, several techniques have been suggested. For example, U.S. Pat. No. 4,741,288 issued to Stirbis, et al., discloses an apparatus for decorating a cylindrical can. The Stirbis, et al., apparatus makes use of a multiple station ink supply and a transfer apparatus for transferring ink from an ink fountain to a rotatable inking blanket wheel through a plate cylinder. The apparatus includes an ink image registration adjustment apparatus and an axial and circumferential tightness control apparatus operatively associated with each plate cylinder and each ink supply and transfer apparatus. In addition to techniques involving the use of rotatable inking wheels such as described in Stirbis, et al., other techniques, which have been suggested for imprinting images on non-planar surfaces, include electrophotographic imaging and magnetic imaging. As a general rule, these techniques have met with limited commercial success.

U.S. Letters Pat. No. 5,831,641 issued to Carlson discloses a method and apparatus for imprinting images on non-planar surfaces, including the surfaces of various types of three-dimensional articles, such as baseball bats. The apparatus includes a modified ink jet plotter coupled with an article-positioning apparatus which functions to automatically maintain the surface of the article to be printed within a plane substantially parallel to and slightly spaced-apart from the place within which the ink jet nozzles of the ink jet plotter reside.

Another prior art technique, which is frequently used to decorate surfaces, such as anodized aluminum surfaces, involves the use of transfer films. These films typically overlay the metal surface and, undesirably, are subject to film deterioration and unattractive abrasion. A very popular prior art printing technique, which has found wide acceptance in recent years, is ink jet printing. Within perhaps the last five years this technology has become the dominant technology for printing color images and graphics in the office and home markets. Ink jet printing basically involves a process whereby ink particles are projected in a continuous stream toward the surface to be imprinted using appropriate computer control to create text and graphics on the printing substrate. A number of different types of ink jet printers/plotters are readily commercially available from sources such as Calcomp, Packard Bell, NEC Technologies and Mutoh America, Inc.

By way of brief explanation of the prior art, traditional ink jet printing processes or methods applied to either planar or non-planar objects, typically utilize left to right jetting initially and on the return, jetting right to left. Upon completion of a dual, one line horizontal print, the object is indexed or advanced approximately 1/64 inch, so that the next line can be bi-directionally jetted. This method of printing takes considerable time when high quality multi-colored photo realistic images, text and graphics are required. The only practical way of increasing speed in this type of bi-directional printing is to add a multiplicity of ink jet-heads in parallel and stack them vertically, thus increasing cost and increasing the amount of maintenance required to achieve a consistent quality print over time.

As will be better understood from the discussion which follows, the method and apparatus of the present invention overcomes most of the problems encountered in prior art attempts to print detailed images on non-planar surfaces by employing a highly novel ink jet image transfer technique.

SUMMARY OF THE INVENTION

It is an object of the present invention to provide a method and apparatus for imprinting high quality images on non-planar surfaces, including the surfaces of various types of three-dimensional articles formed from a number of different types of materials.

Another object of the invention is to provide a method and apparatus of the aforementioned character in which the non-planar surfaces are printed using a uniquely modified ink jet image transfer technique.

Another object of the invention is to provide a method as described in the preceding paragraphs in which the image is printed on the surface of the article using a plurality of ink jet cartridges, the nozzles of which never touch the surface of the article, which is being printed.

Another object of the invention is to provide an apparatus of the character described in the immediately preceding paragraph which includes a novel article-positioning apparatus which functions to controllably rotate the article to be printed and to automatically maintain the longitudinal axis of the article within a plane substantially parallel to and spaced-apart from the plane within which the ink jet nozzles reside.

Another object of the invention is to provide an apparatus of the class described which includes a novel article-positioning apparatus which supports a plurality of articles and functions to sequentially bring each of the articles into position proximate the printing heads of the apparatus and then to controllably rotate the article while maintaining the longitudinal axis of the article within a plane substantially parallel to and spaced-apart from the plane within which the ink jet nozzles reside.

A specific object of the invention is to provide a method and apparatus for imprinting detailed color images on the tapered cylindrical surface such as that found on the barrel and intermediate surfaces of a baseball bat.

Another object of the invention is to provide an apparatus of the class described in which the article-positioning portion of the apparatus is operably coupled with a conventional type of commercially available ink jet plotter.

Another object of the invention is to provide an apparatus of the character described in the preceding paragraph which includes a novel methodology and process of rotationally or spirally rotating the non-planar object at a much faster velocity or speed while maintaining a much slower, but consistent horizontal print-head speed.

Another object of the invention is to provide an apparatus for imprinting high quality images on non-planar surfaces that is simple to use, is reliable in operation and requires minimum maintenance.

By way of brief summary, a major advantage of the method and apparatus of the present invention is the ability to produce high-quality, multi-colored prints on non-planar surfaces of the character not readily adapted to pass through printing machinery, including surfaces found on a number of differently configured, three-dimensional articles such as baseball bats and the like. In this regard, a particular advantage of the apparatus of the present invention is its ability to print high quality images on curved wood and metal surfaces without the dispensing nozzles of the ink jet cartridges of the apparatus coming into physical contact with the surface to be printed. In this regard, a particular advantage of one form o the apparatus of the present invention is its ability to print in a "parallel" indexing configuration, where only spot color printing is required.

An advantage of yet another form of the apparatus of the invention is its ability to print in a rotary spiral, uni-directional "inline", non-indexing configuration. This novel apparatus does not require an additional print-head in parallel, but rather printing speed and print quality are achieved by synchronizing the rotational speed of the object being printed with the movement and firing sequence of the individual print-head nozzles.

In certain forms of the invention, the article-holding and positioning apparatus of the invention is coupled with a conventional, microprocessor-based digital plotter of the character having a plurality of ink jet cartridges which travel longitudinally of the print zone of the plotter. Typically, three ink jet cartridges contain ink of the three primary colors, namely red, yellow and blue, while a fourth cartridge contains black ink. This allows the computer program developed and stored in the computer memory to cause the application of a multiplicity of individual ink dots of various colors to the work surface so that, when combined by the human eye, appear as photo-quality images. In operation of the apparatus of this form of the invention, the article to be imprinted is typically rotated relative to the ink jet cartridges and the surface to be imprinted with the longitudinal axis of the article continuously maintained in a plane which is parallel to and spaced-apart from the plane within which the ink jet nozzles reside.

In several forms of the method of the invention a computer is used to communicate to the printing apparatus information containing the predetermined pattern to be printed which has either been previously scanned or originally-generated using specialized software. The pattern information is typically stored in the computer memory and then sent via cable to the printing apparatus which preferably comprises a conventional printer having four color ink jet print-heads capable of dispensing pigmented inks or dyes comprised of either a solvent or water based material. A printed circuit board operably associated with the cable controllably fires the nozzles of the print-heads to spray microdots of ink onto the surface to be printed in the predetermined pattern.

According to one embodiment of the invention, the microdots have a diameter of approximately 0.0500 mm (0.002 inches) thereby enabling intricate images to be imprinted on the surface. Upon contact with the surface, the ink solidifies and leaves a digitally generated or scanned image or graphic on the surface without the ink jet nozzles ever coming into physical contact with the surface.

Images to be applied to irregular, non-linear surfaces as occur with changing diameters that are rotating at a constant angular rate can be printed to result in linear appearance by computer programming. The subject apparatus can also achieve the linear appearance by producing graphics that compensate dimensionally for the changing diameters and then, by scanning the graphic artwork, computer data can be recorded and stored for use on the subject equipment when desired.

In still another embodiment of the present invention, the apparatus is capable of jetting a designated Cyan (C) color-filled jet-head directly and centered over the non-planar object. Once this is completed the article-holding and positioning apparatus of the invention will index the object directly under a magenta (M) designated jet-head and continue to the next desired color. This type of printing process can be compared, as an analogy, to spot color printing and is a unique feature of the invention. Printing in this manner is rarely used in the ink jet printing industry, because all four color ink jet printing systems are specifically designed to perform process color. Process color combines all four colors, "Cyan", "Magenta", "Yellow" and "Black" (CMYK) ("Black" is specifically designated as "K" and not "B" so as not to be confused with blue, which is typically not used in process color). This latest described method and apparatus of the invention enables imprinting indicia onto elongated, non-planar objects that only require one or two specific single colors. In this instance any specific color may be substituted for the traditional C or Y or M or K.

In yet another embodiment of the invention, the apparatus is capable of jetting the traditional CMYK colors all at once. In this configuration the system can be employed as a traditional process color output apparatus, or, alternatively, the CMYK colors can be substituted for high-speed spot color output. As will later be explained in greater detail, this can be achieved by aligning the ink jet-heads in an "inline" configuration, one after another. This latter process and method can only be practically performed with elongated, non-planar objects, because the non-planar object must be rotated or spun at a constant rate and is not stopped to advance to the next color being jetted. More particularly, in accordance with this form of the invention, the article to be imprinted is rotated at roughly three to four revolutions a second, while the ink jet-heads are moved horizontally at a pre-calculated rate relative to the rotational speed of the article. The apparatus of one form of the invention will only print or jet media in one direction until the print cycle is complete. This is defined as "Uni-directional printing". The apparatus has capability of printing in this fashion in either a process or spot color mode. As previously mentioned, this is a process and method that can only be used in connection with elongated objects. However, it is not limited to cylindrical objects and can be adapted for use with square or rectangular elongated articles as well.

As a general rule, prior art methods which use bi-directional ink jet printing are limited to process color and must print one line at a time horizontally from left to right. The apparatus of the present invention enables spiral or high-speed rotary ink jet printing as a novel and new method of imprinting indicia on elongated non-planar articles.

In yet another embodiment of the invention, the apparatus of the invention is capable of jetting the traditional CMYK colors all at once, while also jetting a colorless resin or polymer, which will hereafter be designated as "Z" in the CMYK (Z) configuration. This designated "Z" jet-head can be used as a permanent or removable mask, where no color is needed and the surface being jetted is to be protected. In this configuration the article can now be jetted with only the "Z" ink jet-head and thus provide protection, so that the object can be introduced into a bath of a single colorant. This allows for flooding of an article completely with a single color.

In the preferred form of the method of the invention, a computer is used to communicate to the printing apparatus information containing the predetermined pattern to be printed, which has either been originally digitally created or been previously scanned using specialized software well known to those skilled in the art. In this regard, specialized software, such as raster image processing type of programs, assist in creating and separating process color and spot color from various other types of printing such as silkscreen and laser printing.

The real challenge of printing or displaying color images accurately to approximate the colors of the real world using devices or technologies that are not capable of reproducing all the colors in the visible spectrum requires precise color management. For example, a computer monitor generally does a much better job of simulating real color than does an ink jet printer. For purposes of color management in the conduct of the method of the present invention, specialized raster image processing software and color management software and tools developed by Wasatch Computer Technology, Inc. and Onyx Graphics of Salt Lake City, Utah has proved to be quite satisfactory.

In carrying out the method of the present invention computer-stored images can be edited on the computer monitor screen to eliminate images, add images or erase spaces for insertion of images. Such images can be nomenclature; video camera generated photo-quality images (people, objects, animals, etc.). Changes can be accomplished expeditiously just prior to printing.

Using the techniques described in the preceding paragraphs, high quality images can quickly and easily be imprinted on a variety of different types of materials and upon the non-planar surfaces of a number of types of irregularly configured three-dimensional articles including baseball bats.

BRIEF DESCRIPTION OF THE DRAWINGS

FIGS. 46A, 46B, 46C, 46D and 46E when considered together comprise a generally graphical representation of pixel positions on the bat relative to the printer head nozzle that is delivering the ink drops during a one pass mode.

FIGS. 47A, 47B, 47C, 46D and 47E when considered together comprise a generally graphical representation of pixel positions on the bat relative to the printer head nozzle that is delivering the ink drops during a two pass mode.

FIG. 48 is a tabular representation showing pixel positions on the bat relative to the total 127 printer head nozzles of one form of the printing assembly that are delivering the ink drops during the spiral printing operation.

DESCRIPTION OF THE INVENTION

Figure 2:
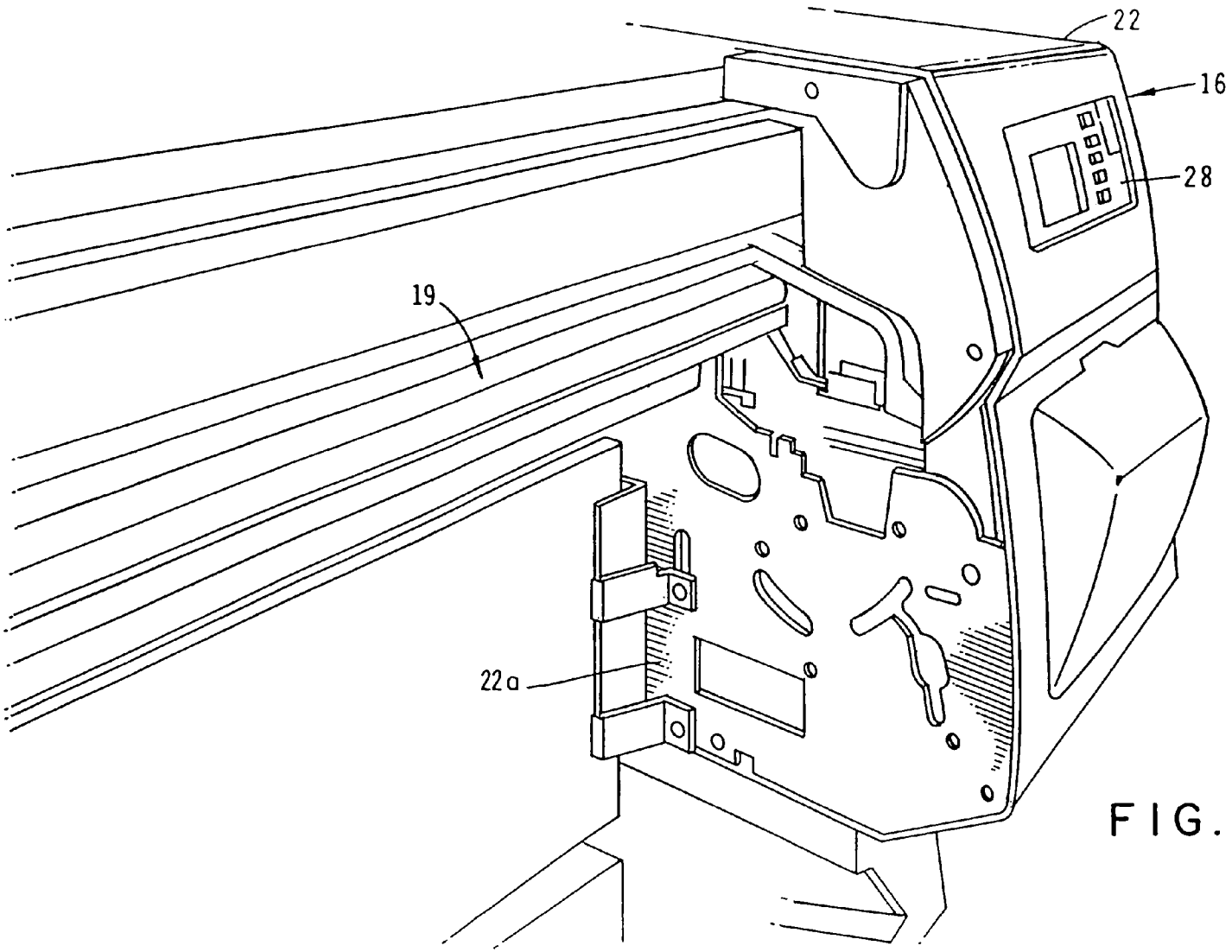
FIG. 2 is an enlarged, generally perspective view of the right-hand portion of the modified commercially available plotter shown FIG. 1.
Figure 3:
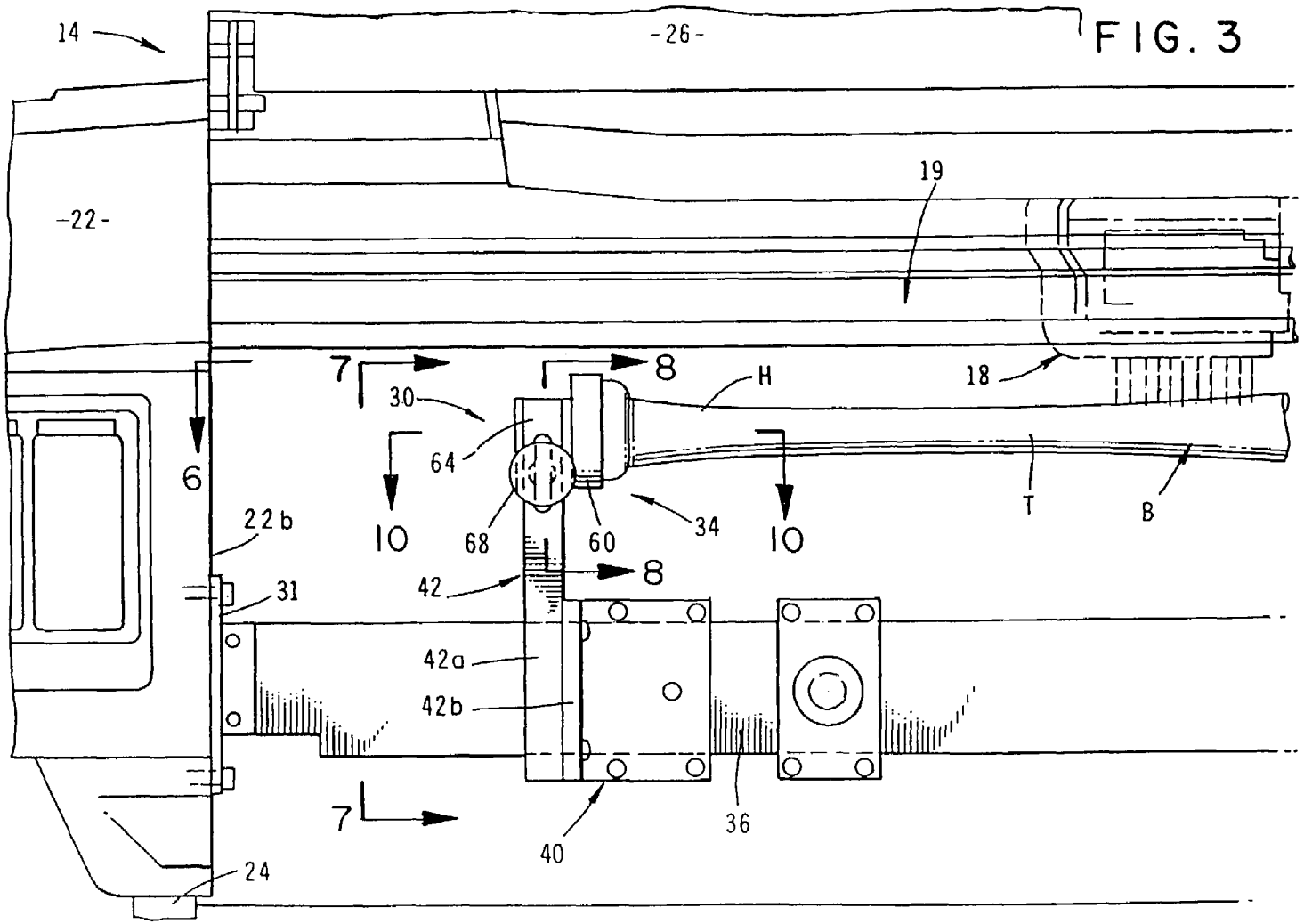
FIGS. 3 and 3A in combination comprise a front view of the apparatus of the invention shown in FIG. 1 following the connection to the apparatus of the novel three-dimensional article-positioning subassembly of the apparatus.
Figure 3A:
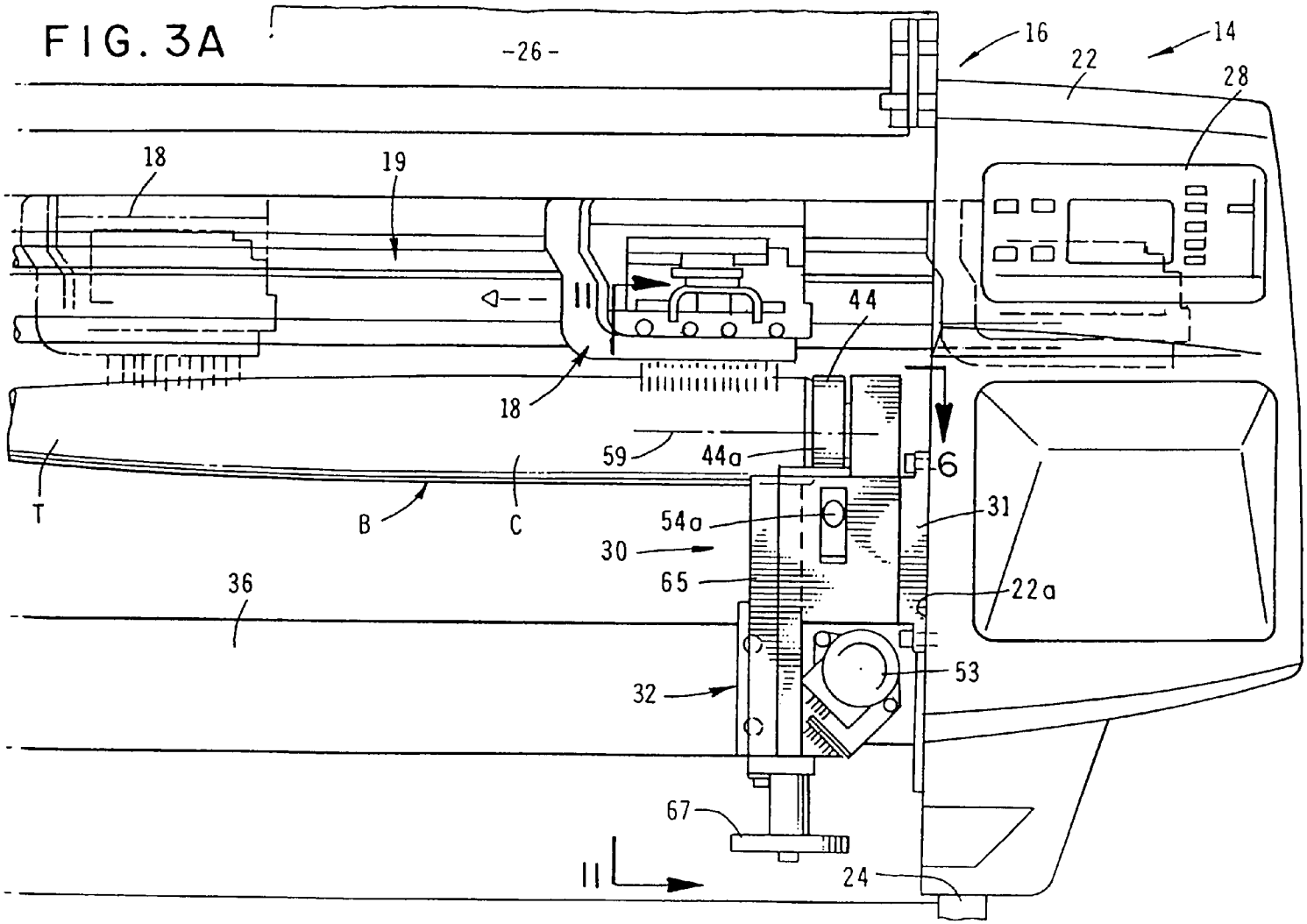

Referring to the drawings and particularly to FIGS. 3 and 3A, one form of the apparatus of the invention for imprinting a predetermined image or pattern on a three-dimensional article is there illustrated and generally designated by the numeral 14. The apparatus of this form of the invention is made up of two main components, one being a modified, commercially available type of microprocessor-based, ink jet printer 16 (FIGS. 1 and 2) and the other comprising positioning means for holding, positioning, and rotating the article to be imprinted within the printer at a location proximate the color ink jet print-heads 18 of the modified printer 16 (FIG. 3). The primary modification made to the commercial printer involves the removal of the drive roller assemblies and their related drive mechanisms from the lower portion of the printer housing. Once this is accomplished the lower portion of the printer housing is open and has the configuration illustrated in FIG. 1 of the drawings.

Figure 1:
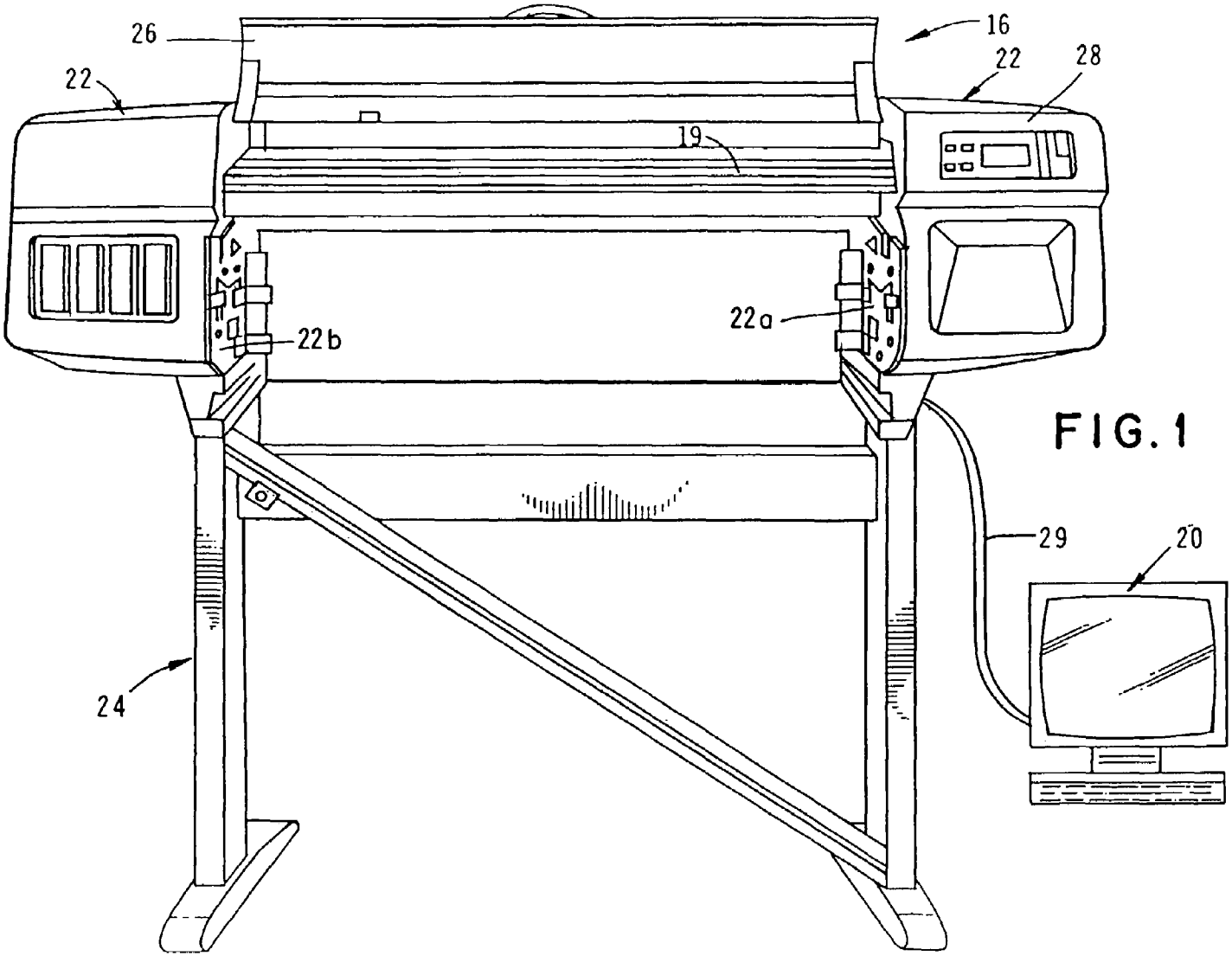
FIG. 1 is a generally perspective view of one form of a modified, commercially available plotter that forms a part of the apparatus of the invention for imprinting a predetermined pattern on a surface of a three-dimensional article such as a baseball bat.

While various commercially available ink jet printers and plotters can be used in combination with the positioning means of the invention, large-format and desktop printers manufactured and sold by The Hewlett-Packard Company as Designjet, Models 1050C/1055CM, 1120C and 1220C have proven satisfactory. The Designjet printer is a microprocessor-based digital printer that receives plotting instructions from an associated host computer 20 (FIG. 1). It is also to be understood that either a printer or a plotter apparatus could be specifically designed for a given application and could be used with positioning means of the character presently to be described in performing the method of the invention. Such an apparatus would preferably incorporate a reciprocally-movable cartridge assembly that could imprint images on a stationary object.

As best seen in FIG. 1, modified printer 16 comprises a console-type housing 22 having a base 24, a covering 26 superimposed over base 24 and a control panel 26 which houses the control circuitry of the printer. Computer 20 functions to communicate to the control circuitry of the printer the predetermined image or graphic that is to be imprinted on the three-dimensional article. The image or graphic can be scanned or can be originally-generated in the computer environment with specialized software. Typically, the computer image or graphic is stored on a hard drive and sent via a cable 28 to the control circuitry of the printer 16. Techniques for scanning or originally-generating the image or indicia or be imprinted on the three-dimensional article are well known to those skilled in the art.

Data transfer is controlled by the computer 20, which generates and transmits to the control circuitry of the printer the necessary timing signals to properly sequence the processing of data and instructions to the printer. The printer memory typically contains the operating system to control printer operation using the control panel. The ink jet print-heads 18, which upon command, travel longitudinally of the print zone of the printer along the print-head carriage 19, are preferably of very high resolution, such as the Designjet ink jet printers sold by Hewlett-Packard. Examples of the design and operation of other prior art print-heads, reservoirs and printers are described in U.S. Pat. Nos. 4,593,292; 4,459,601; 4,523,200; 4,580,147; and 4,646,106. Because of the pertinency of the aforementioned patents, each of the patents is hereby incorporated by reference as though fully set forth herein.

The ink, which is dispensed by the ink jet print-heads, can be either solvent or waterbased and is carried by the cartridges in a manner generally disclosed in U.S. Pat. Nos. 4,646,106 and 4,592,292. The carriage of the printers typically contains a printed circuit board, which controls the firing of the nozzles in the ink jet print-heads. In the apparatus of the present invention, the motor is also controlled from the main printed circuit assembly by the microprocessor 18 via the control circuitry housed within control panel 26. Details concerning the construction and theory of operation of the Designjet Models 1050C/1055CM, 1120C and 1220C printers and details of the control circuitry thereof are readily obtainable from The Hewlett-Packard Company of San Diego, Calif.

Figure 6:
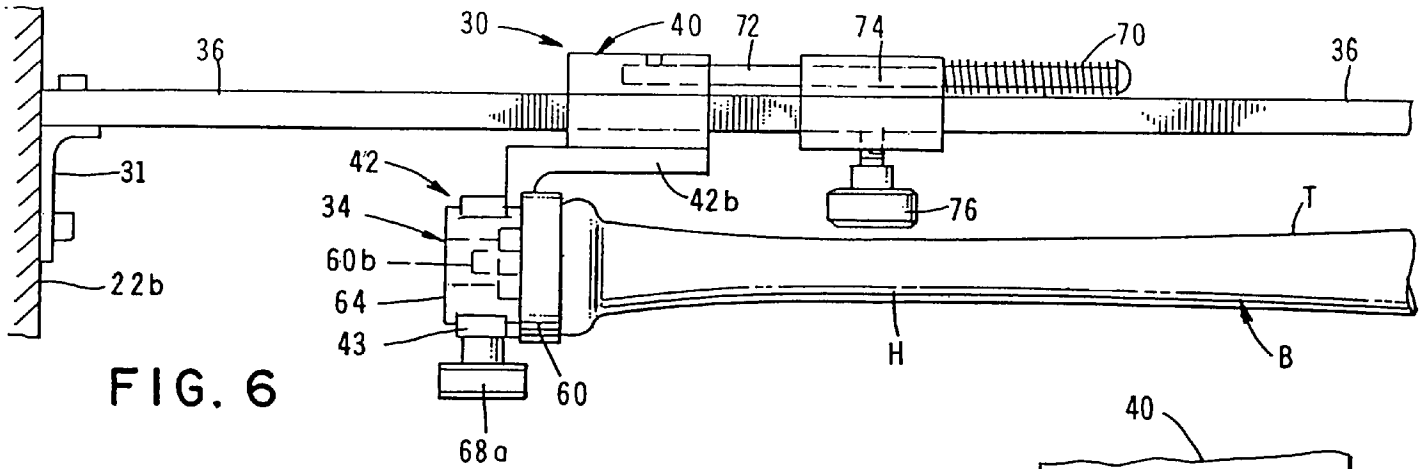
FIGS. 6 and 6A when considered together comprise a view taken along lines 6-6 of FIGS. 3 and 3A.
Figure 6A:
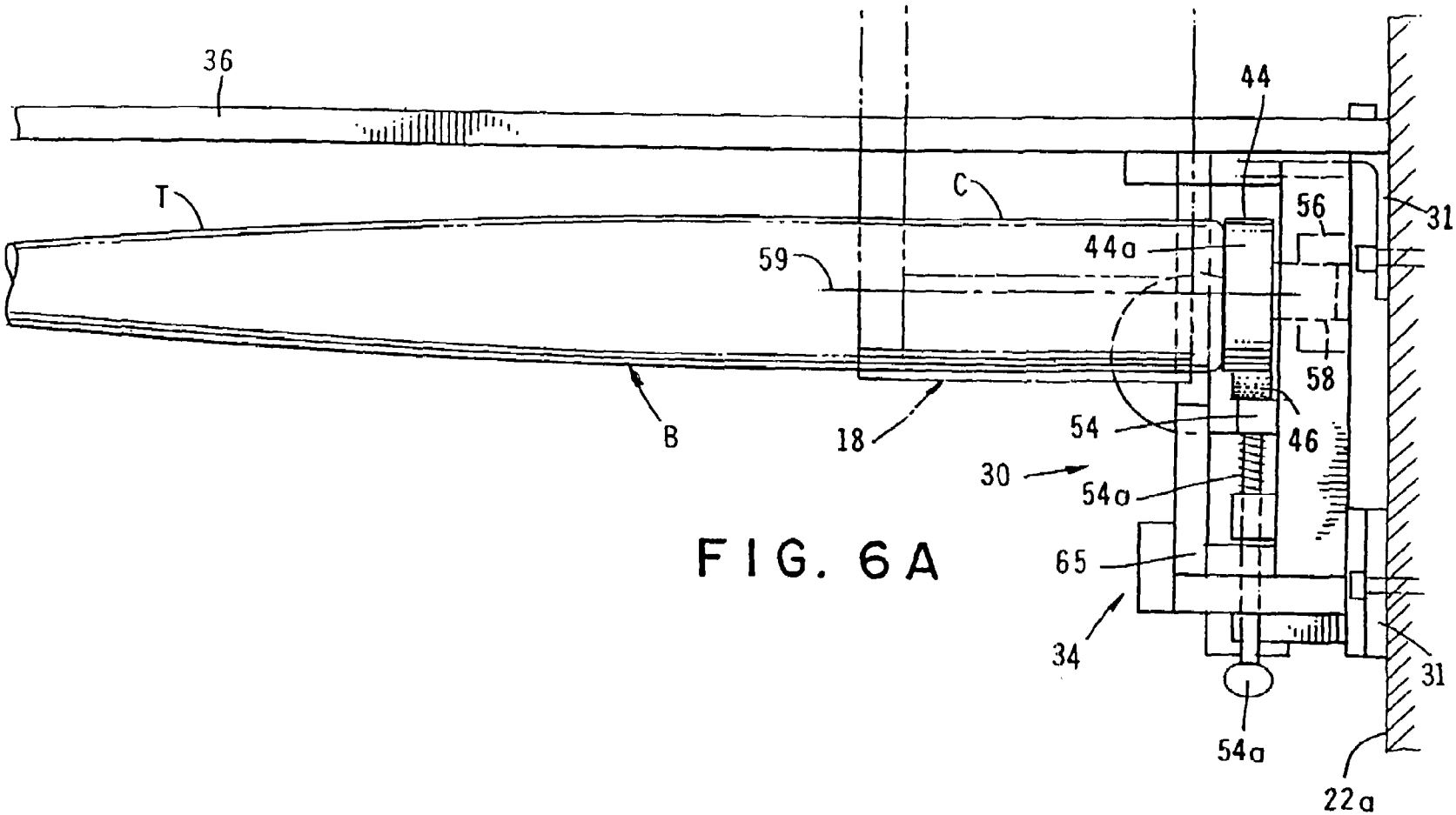

Considering now the important article-positioning means of the invention that is mounted within the modified printer housing 22, this means here comprises an article-positioning assembly, generally designated by the numeral 30, that is mounted within the lower portion of the modified printer housing using appropriate connecting hardware 31 (FIGS. 6 and 6A). In the form of the invention illustrated in the drawings, the article-positioning assembly has a first end portion 32 and a longitudinally-spaced, second, or left-end portion 34 (FIGS. 3 and 3A). As shown in FIG. 3A, first end portion 32 includes first gripping means for gripping the first end of the three-dimensional article to be imprinted and rotating means for controllably rotating the three-dimensional article relative to the ink jet cartridges 18. The second end portion 34, as shown in FIG. 3, includes second gripping means for gripping the second end of the three-dimensional article to be imprinted and length adjustment means for adjusting the distance between first and second gripping means. Second end portion 34 also includes height adjustment means for adjusting the height of the second gripping means.

Figure 5:
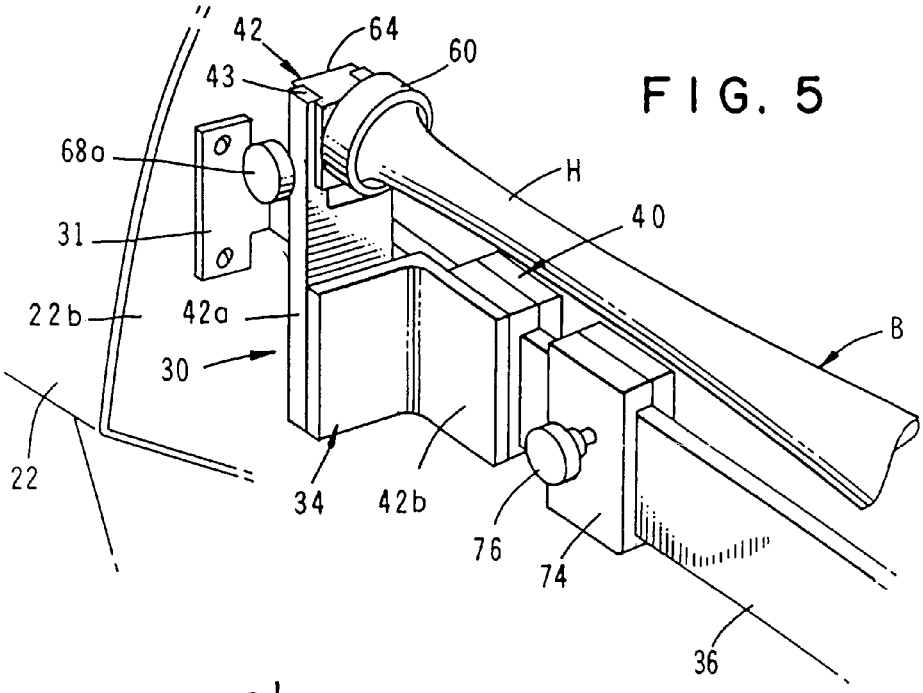
FIG. 5 is a generally perspective, fragmentary view of the left-hand portion of the apparatus shown in FIG. 3 showing the manner in which the handle portion of the baseball bat is mounted within the article-positioning subassembly.
Figure 7:
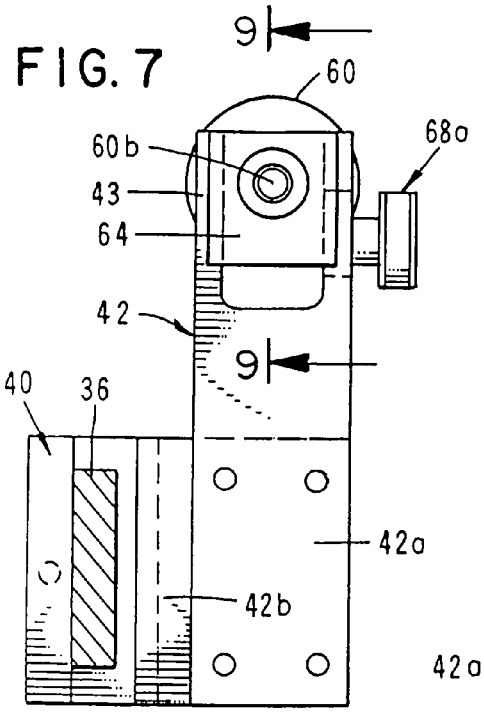
FIG. 7 is a cross-sectional view taken along lines 7-7 of FIG. 3.

The positioning means of the present form of the invention further comprises a guide member 36 that extends longitudinally of the modified printer housing and also comprises a carriage 40 that is slidably movable along guide member 36. A support arm 42*a* of a support arm assembly 42 is connected to carriage 40 by an angle bracket 42*b* (FIG. 5) and the second gripping means of the apparatus is connected to the support arm in the manner as seen in FIGS. 3, 5 and 6.

As previously mentioned, minimum modification of the commercially available Designjet printer is required to enable it to accept the article-positioning means of the invention. Basically, all that is required is to remove the media drive mechanisms, which manipulate the media, such as planar sheets of material which are to be imprinted and to add connectors to the spaced-apart printer end walls 22*a* and 22*b* to permit connection of the article-positioning means thereto (FIG. 1).

Figure 4:
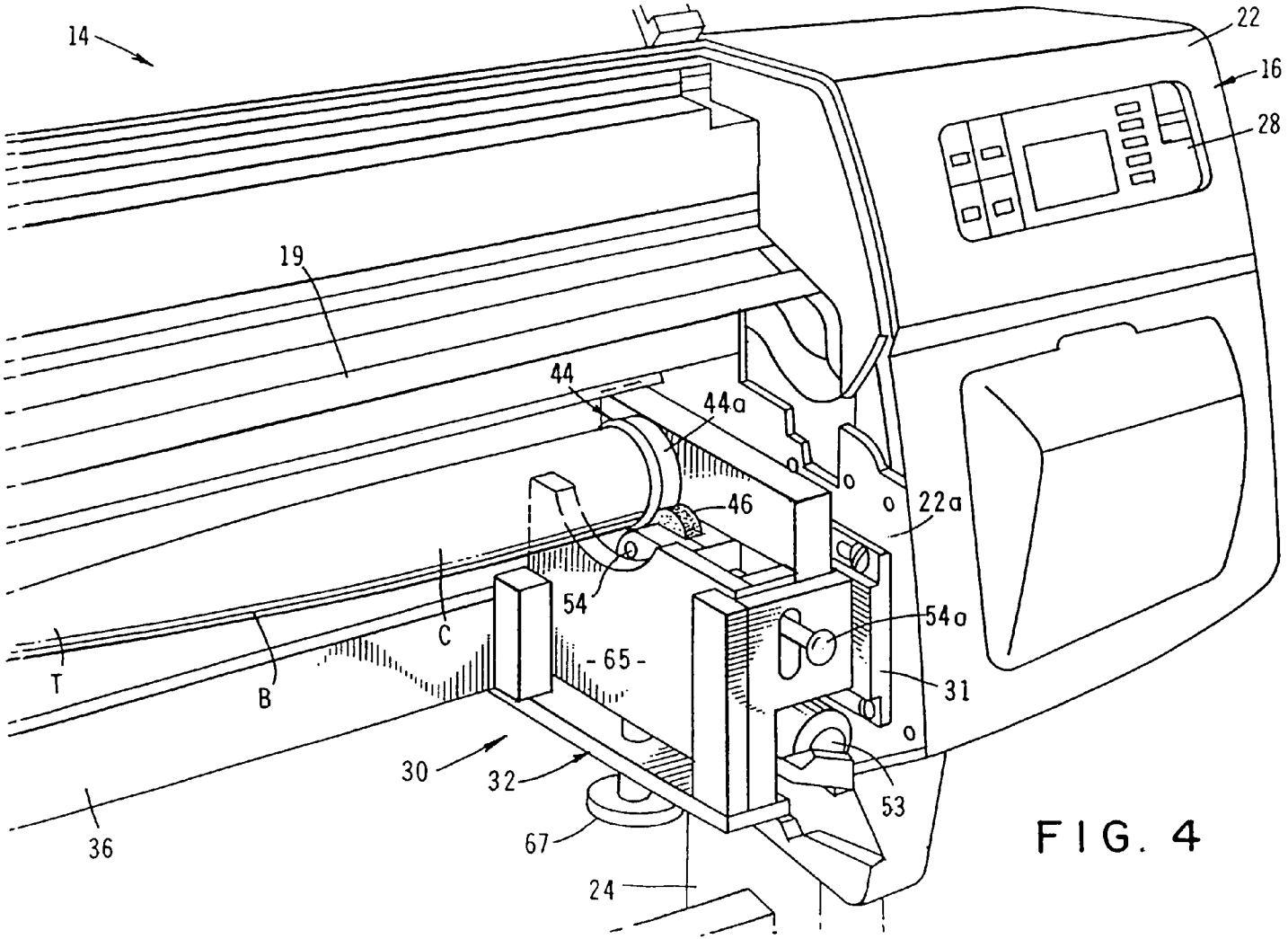
FIG. 4 is a generally perspective view of the right-hand portion of the apparatus shown in FIG. 3A.
Figure 11:
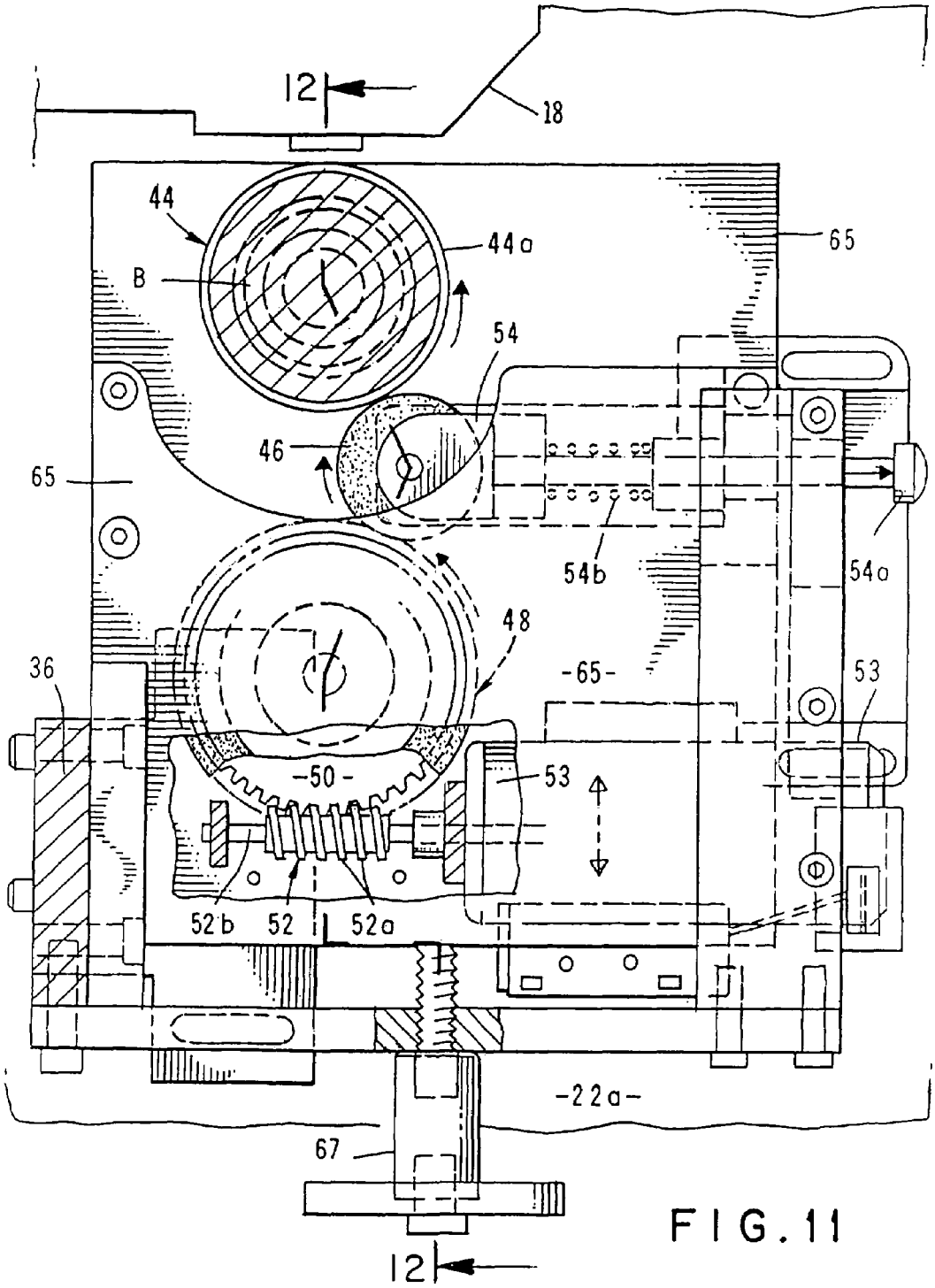
FIG. 11 is an enlarged cross-sectional view taken along lines 11-11 of FIG. 3A.
Figure 12:
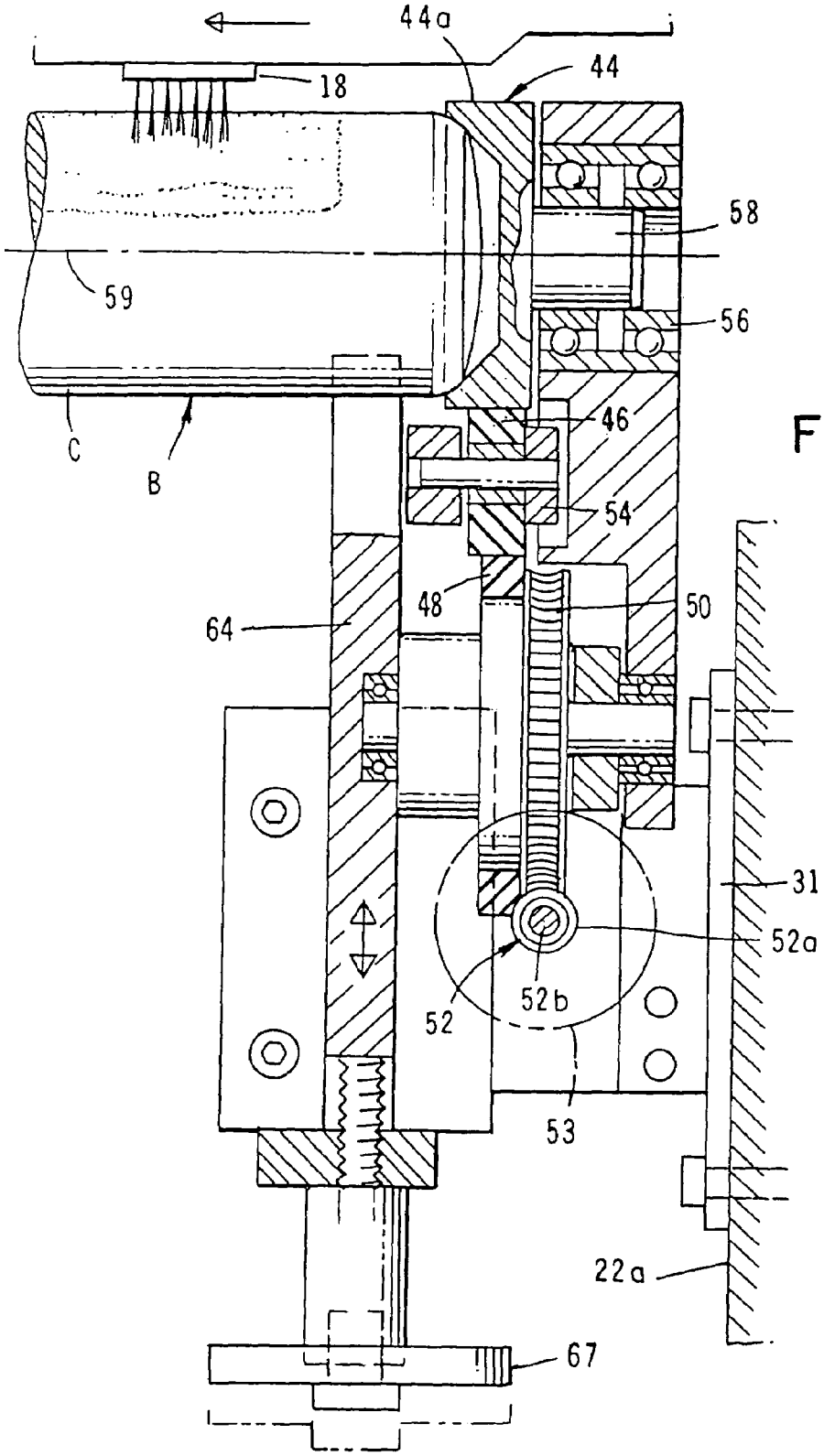
FIG. 12 is a cross-sectional view taken along lines 12-12 of FIG. 11.

As shown in FIGS. 3A and 4 the first gripping means of the apparatus includes a first generally cup-shaped member 44 having a peripheral surface 44*a*. The rotating means of the apparatus for rotating the article to be imprinted here comprises an idler wheel 46 that is disposed in engagement with peripheral surface 44*a* of cup-shaped member 44 for imparting rotation thereto upon rotation of a drive wheel 48. As best seen in FIGS. 11 and 12, the toothed portion 50 of the drive wheel 48 is connected to a rack 52 housing teeth 52*a*. Rack 52 is mounted on a shaft 52, which is rotated by motor means here provided as a conventional electric motor 54.

An important feature of the apparatus of the invention resides in the fact that idler wheel 46 is adjustable relative to both wheel 48 and cup 44 so that cups of various sizes can be substituted for cup 44 in order to accept bats having either larger or smaller barrels. More particularly, as best seen in FIG. 11, idler wheel 46 is mounted for rotation on an idler wheel support carriage 54 that is reciprocally-movable from a first position shown in FIG. 11 to a second retracted position wherein carriage 54 moves to the right has viewed in FIG. 11. Biasing means, shown here as a coil spring 56, functions to urge carriage 54 into engagement with cup 44 and wheel 48 that is to the left as viewed in FIG. 11. It is apparent that by pulling on gripping portion 54*a* (See FIG. 4), idler wheel 46 can be moved to the right as viewed in FIG. 11. This permits cup 44 to be removed from the bearing 56 that supports it (FIG. 12) so that it can be replaced by an alternate, larger or smaller cup. However, regardless of the size of the holding cup, idler wheel 46 will be continuously urged into pressural engagement with drive wheel 48 and with the cup that is holding the bat that is to the imprinted. As shown in FIG. 12, stub shaft 58 is affixed to and extends from cup 44 for insertion into bearing 56. Bearing 56 is located so that the article to be imprinted, in this case a baseball bat B, is rotated about the longitudinal axis 59 of the bat, that resides within a first plane, that is parallel with a second, spaced-apart plane within which the ink jet cartridges travel.

As illustrated in Figured 3 and 3A, baseball bat "B" includes a handle portion "H", a cylindrically-shaped barrel portion "C", and a tapered intermediate portion "T" which is located between handle portion "H" and cylindrically-shaped barrel portion "C". When this type of three-dimensional article is to be imprinted, a generally cup-shaped member 60, which comprises a part of the second gripping means is adapted to support handle portion "H" of the three-dimensional article in the manner shown in FIG. 3. Similarly, the previously identified, generally cup-shaped member 44 of the first gripping means is adapted to support the end of the barrel-shaped portion "C" of the baseball bat. As previously described, when the barrel-shaped portion "C" of the baseball bat to be imprinted is either larger or smaller in diameter from that shown in the drawings, cup-shaped member 44 can be removed and a larger or smaller cup-shaped member can be substituted therefor. Accordingly, bats having barrel portions of various diameters can readily be accommodated by replacing cup-shaped member 44 with an alternate, appropriately-sized cup-shaped member. As is readily apparent from a study of FIGS. 11 and 12, by changing the size of the cup-shaped member that holds the first end, or barrel, of the bat, the speed of rotation of the bat about its longitudinal axis is automatically adjusted. More particularly, where the motor 54 rotates shaft 52*a* at a constant speed, the larger the cup that supports the barrel of the bat, the slower will be the speed of rotation of the bat about axis 59. The effect of this change of rotational speed will later be discussed.

Figure 8:
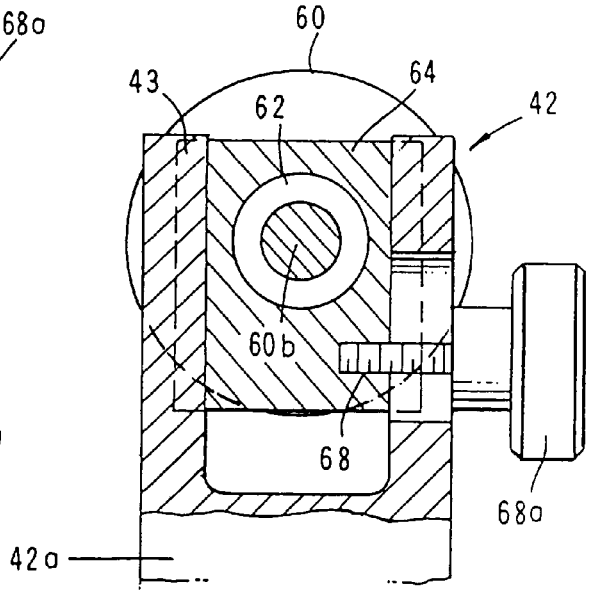
FIG. 8 is a cross-sectional view taken along lines 8-8 of FIG. 3.
Figure 9:
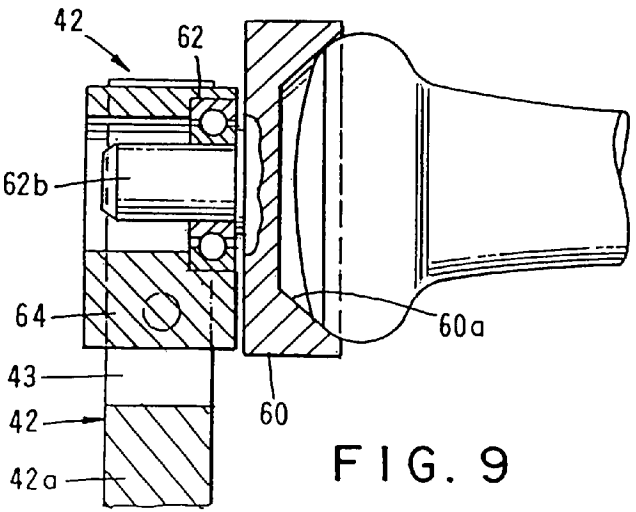
FIG. 9 is an enlarged cross-sectional view taken along lines 9-9 of FIG. 3.
Figure 10:
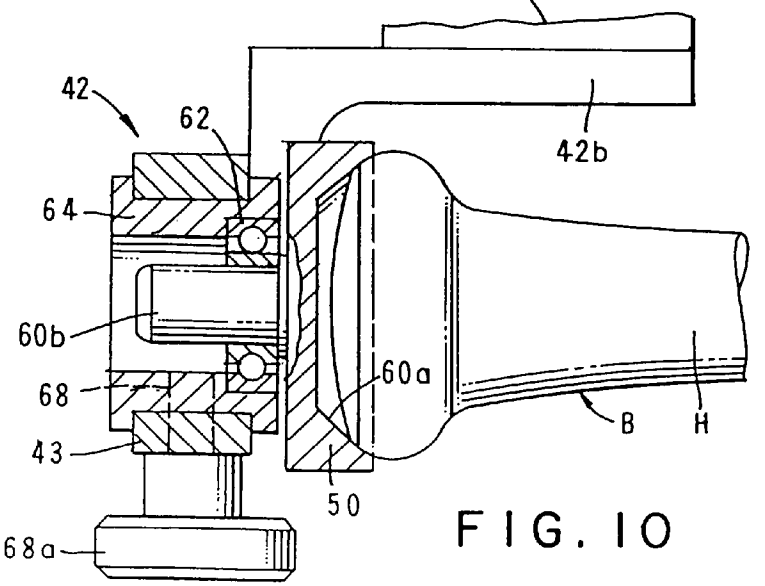
FIG. 10 is an enlarged cross-sectional view taken along lines 10-10 of FIG. 3.

Considering now in greater detail the second gripping means of the invention this means here comprises a generally cup-shaped member 60 that includes an article gripping portion 60*a*and an outwardly-extending shaft portion 60*b*(FIG. 9). Shaft portion 60*b*is mounted for rotation within a bearing 62 that is carried by a holding block 64. Holding block 64 is, in turn, slidably received within the generally yoke-shaped portion 43 of upstanding arm 42*a* of support arm assembly 42 (FIG. 8). Holding block 64, which forms the part of the height adjustment means of the invention for raising or lowering the height of cup 60 relative to the plane of travel of the ink jet cartridges, is held securely in position within yoke portion 43 by a threaded set screw 68 having a finger gripping head portion 68*a* at a selected height so as to maintain the longitudinal axis of the bat parallel with the path of travel of the ink jet cartridges. In this regard, it is also possible to adjust the height of cup 44 of the first gripping means, if so required, by raising or lowering a support plate 65 by a second height adjustment means. This second height adjustment means here comprises, in addition to support plate 65 an adjusting screw 67 that acts on plate 65 in the manner depicted in FIGS. 11 and 12.

In using the apparatus of the invention to accomplish one form of the method of the invention, shaft 58 of an appropriately-sized cup assembly 44 is first mounted within bearing 56. This done, the longitudinal position of the second gripping means of the invention is adjusted using the length adjustment means of the invention to position cup 60 of the second gripping means at the correct spaced-apart location to accept the bat to be imprinted. In this regard, it is to be noted that the length adjustment means includes biasing means, shown here in the form of a coil spring 70 (FIG. 6). Spring 70 circumscribes an elongated rod 72, one end of which is connected to carriage 40, and in this way functions to urge the second gripping means, including cup 60, toward the first gripping means, or to the right as viewed in FIG. 6. As shown in FIG. 6, rod 72 is mounted within an adjustment block 74 that can be selectively positioned along guide 36 by loosening a setscrew 76 to roughly position cup 60 at a location approximately the length of the bat "B".

In using the apparatus of the invention, the length of the bat to be imprinted, as well as the diameter of the barrel portion C of the bat is first determined. This done, an appropriately-sized holding cup, such as cup 44, is inserted into bearing 56 in the manner shown in FIG. 12. In order to insert the holding cup 44 into bearing 56, idler wheel 46 must be urged to the right as viewed in FIG. 11 against the urging of spring 56. When the cup is correctly positioned within bearing 56 and the pressure exerted against idler wheel 46 is relaxed, spring 56 will urge the idler wheel into driving engagement with the peripheral surface 44*a* of the holding cup. As previously mentioned, the larger the holding cup, the slower will be the rotation of the bat. Conversely, the smaller the holding cup, the faster will be the rotation of the bat.

After the correct cup assembly 44 is in place, carriage 40 of the positioning means is moved along guide 36 to a location wherein the extremity of the handle of the bat can be inserted into holding cup 60 (FIG. 3). At this same time, if so required, block 64 can be moved upwardly or downwardly by loosening set screw 68 in order to insure that the longitudinal axis of the bat is precisely parallel to the longitudinal path of travel of the ink jet-heads. It is to be noted that, with the bat secured within the positioning means in the manner shown in FIG. 3 and 3A, the biasing means or spring 70 of the length adjustment means will continuously urge cup 60 into pressural engagement with the extremity of the handle portion of the bat so that cups 44 and 60 are in secure frictional engagement with the ends of the bat.

Figure 13:
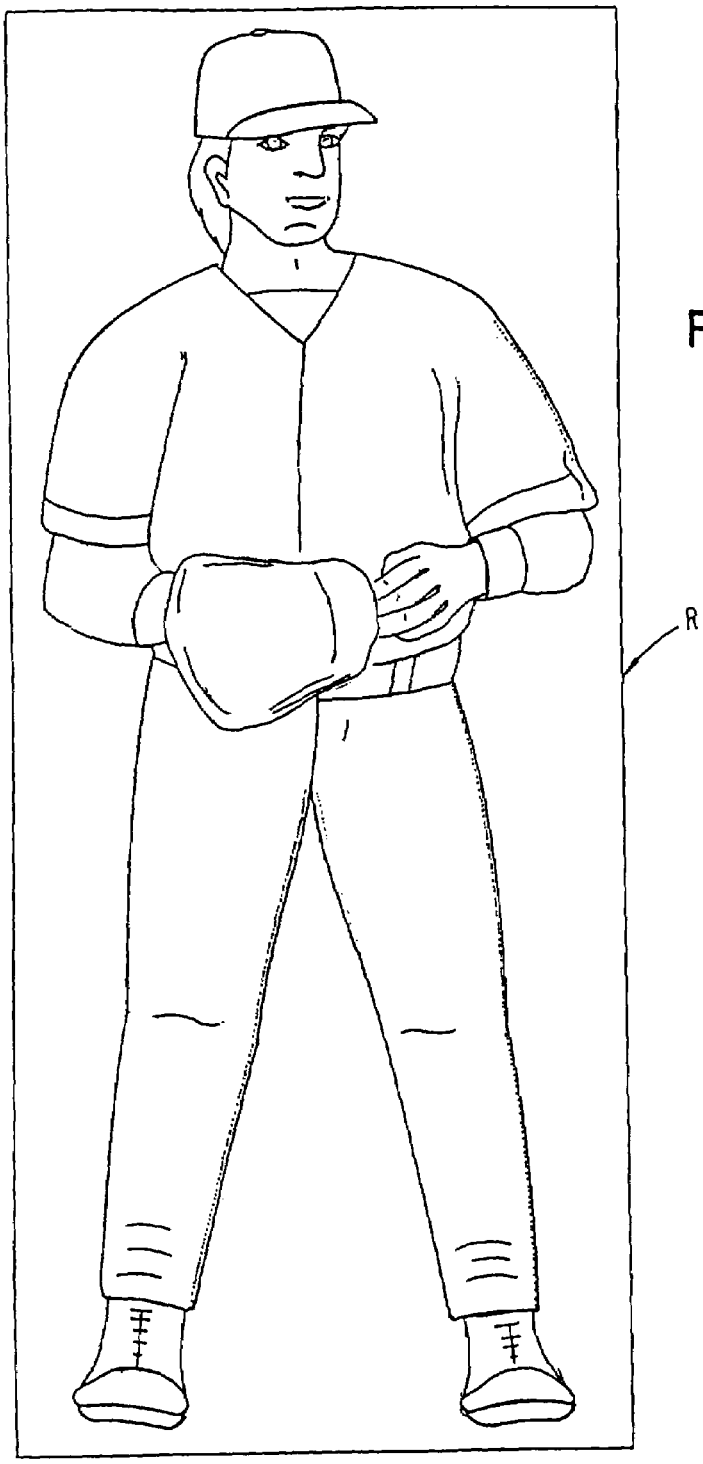
FIG. 13 is a generally diagrammatic view of an undistorted image or pattern that will be appropriately distorted for imprinting on an article such as a baseball bat in accordance with the method of the invention.
Figure 14:
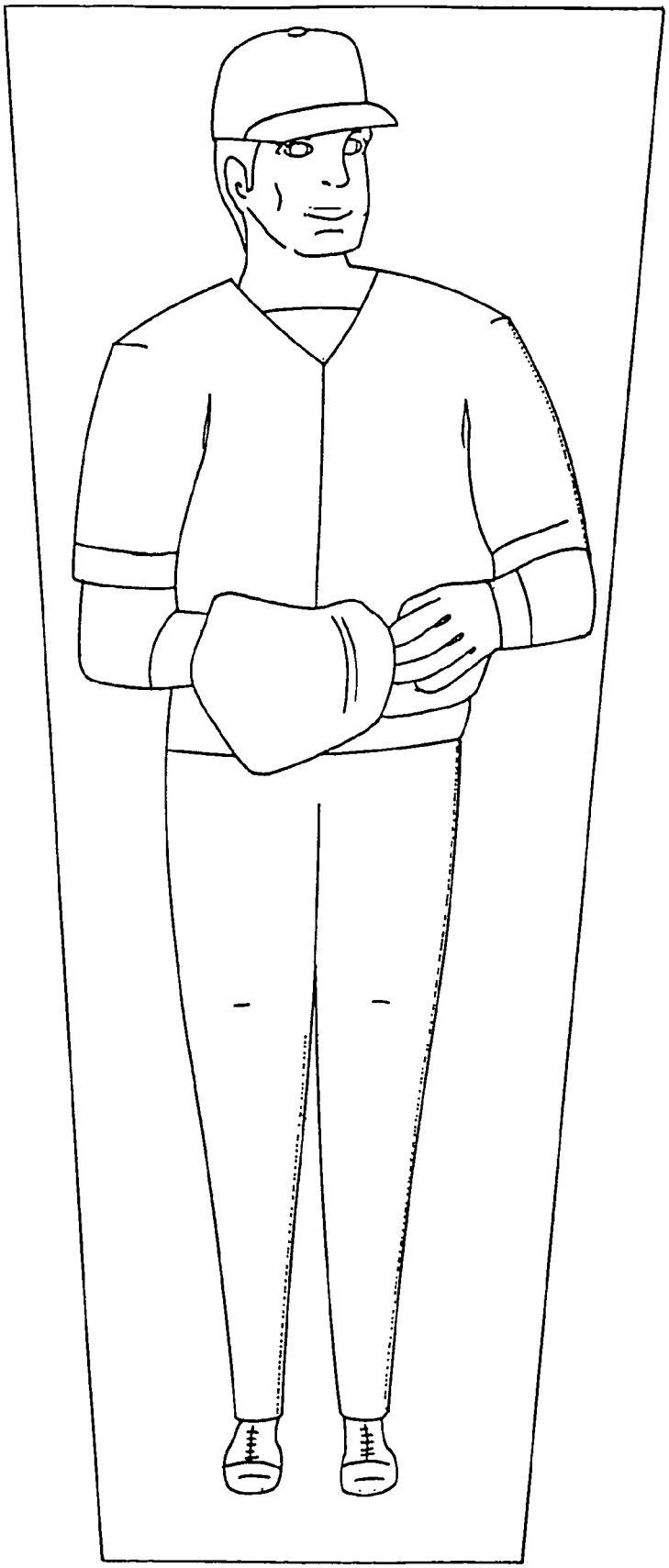
FIG. 14 is a generally diagrammatic view of the image shown in FIG. 13 that has been suitably distorted to enable it to be imprinted on a portion of the surface of a particular size of baseball bat.

Following the correct positioning of the bat "B" within the positioning means, energizing motor 54 will cause rotation of shaft 52*a* and screw 52 which will, in turn, cause rotation of drive wheel 48 at a constant speed of rotation. As previously described herein, rotation of drive wheel 48 will cause rotation of idler wheel 46 and the concomitant rotation of holding cup 44. Rotation of holding cup 44, which is in frictional engagement with the bat, will cause the bat to rotate about axis 59 at a uniform rate that is governed by the diameter of the barrel portion of the bat. In this regard, when the image to be printed is, by way of nonlimiting example, a depiction of a human figure, such as a baseball player of the character shown in FIG. 13, the image is either scanned or originally computer generated using specialized software of a character well known to those skilled in the art. Because of the tapered configuration of the bat, it is obvious that the image as shown in FIG. 13, which is bounded by a rectangle "R" could not be imprinted on the bat because the image does not conform to the surface to be imprinted. This is due to the fact that, if the surface of the bat that is to be printed is projected into a planar configuration, the configuration would obviously be non-rectangular in shape. Therefore, it is necessary to produce a distorted image that is of the character generally depicted in FIG. 14. As indicated in FIG. 14, the distorted image, which now generally conforms to the planar projection of the surface to be imprinted, is bounded by a trapazoid with the lower portion of the image being substantially narrowed so as to conform to the tapering of the bat. When this distorted image is printed by the printer in accordance with appropriate instructions given to the control circuitry of the printer by host computer 20, the image will be neatly wrapped around the barrel as well as the tapered and handle portions of the bat to produce a desired non-overlapping result. Image distortion of the general character shown in FIG. 14 can be easily accomplished by those skilled in the art using several types of readily commercially available morphing type software, to create a file that is readable by the control circuitry of the modified microprocessor-based printer being used. Experience has shown that by way of non-limiting example, photo editing software such as that sold under the name and style "COREL" and "ADOBE PHOTO SHOP" can be used to appropriately distort the image to be imprinted.

The nature and extent of the distortion of the image to be imprinted is, of course, dependent on the configuration of the article to be imprinted. When the article has the configuration of a baseball bat, the bat must first be dimensionally analyzed to determine the character of the surface of the bat that is to be imprinted. Such an analysis can readily be accomplished by those skilled in the art and typically involves a determination of the diameter of the barrel portion of the bat and the degree of reduction in diameter or extent of taper of the tapered and handle portion upon which the image is to appear. Such a dimensional analysis of a baseball bat is relatively simple and need not be particularly precise so long as the surface to be imprinted can be projected into a planar configuration of the general character that is depicted in FIG. 14. Once the distorted image is created and appropriately loaded into the printer and the bat is rotated in the manner previously described, the ink cartridges will move through the print zone in a conventional manner and will appropriately deposit ink onto the surface of the bat to create the desired appropriately distorted image. More particularly, as the bat rotates, the control circuitry of the printer responding to the instructions received from the pre-programmed host computer 20 will direct the ink jet-heads to controllably deposit ink onto the surface of the bat in accordance with the predetermined software that has been developed to produce the desired image on the baseball bat.

Figure 24:
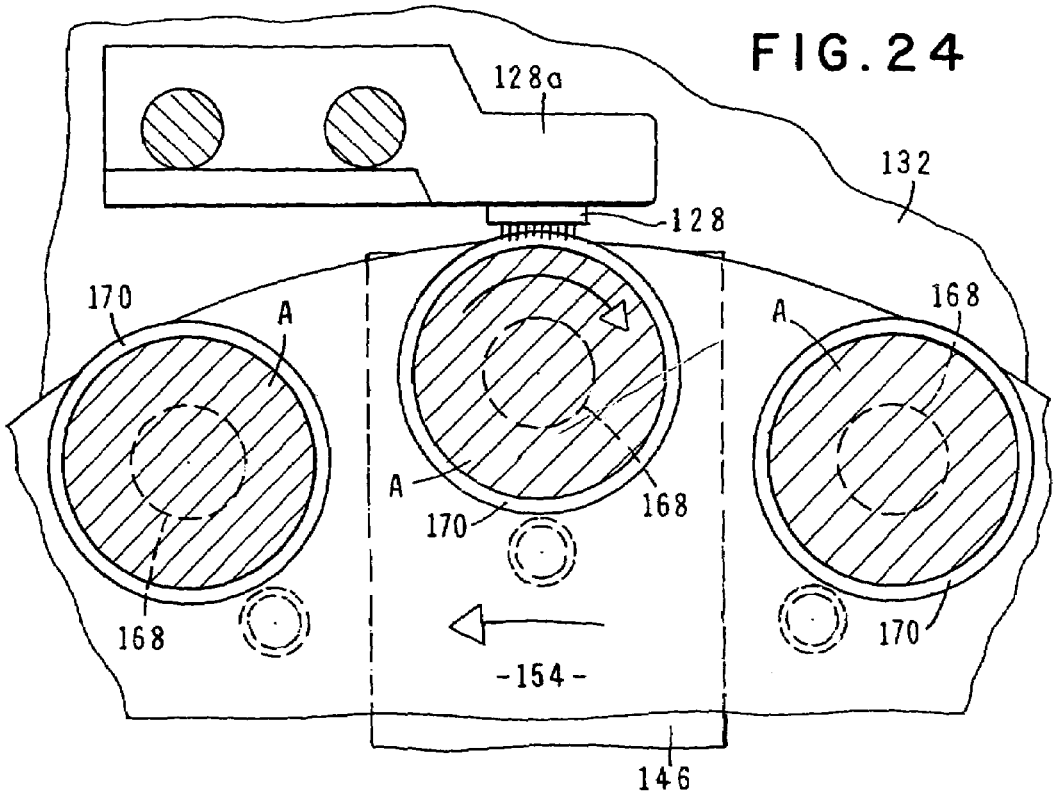
FIG. 24 is a cross-sectional view taken along lines 24-24 of FIG. 22.
Figure 25:
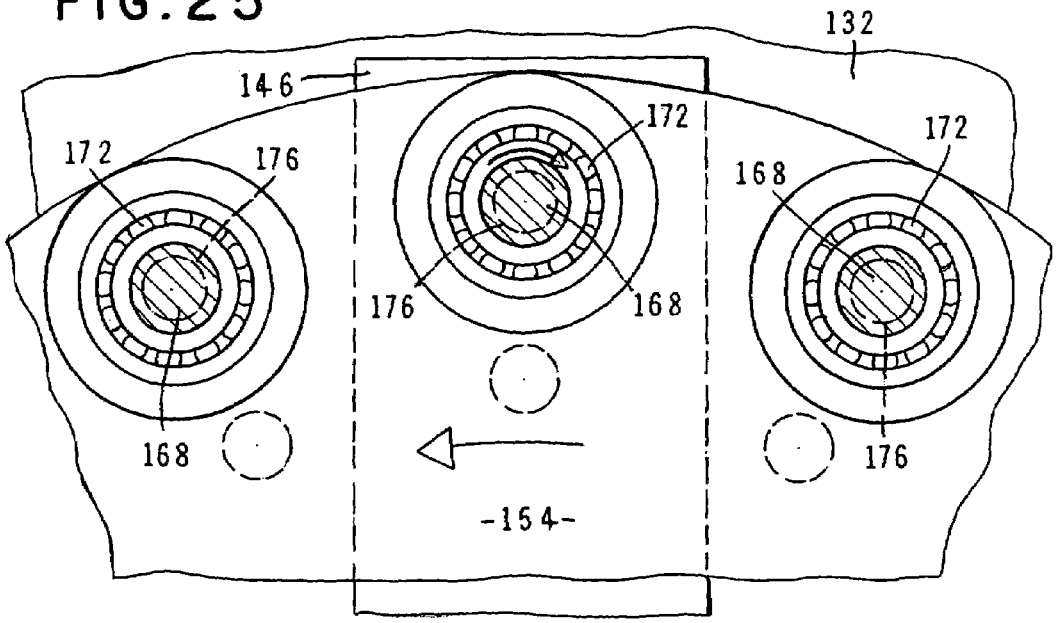
FIG. 25 is a cross-sectional view taken along lines 25-25 of FIG. 22.

Referring next to FIGS. 15 through 26, an alternate form of the apparatus of the invention for imprinting a pre-determined image or pattern on three-dimensional articles is there illustrated and generally designated by the numeral 124. The apparatus of this form of the invention is made up of two main components, one being a modified, commercially available type of microprocessor-based, ink jet printer 126 (FIGS. 15, 16, and 17) of the general character previously described and the other comprising positioning means for holding, positioning, and rotating the articles to be imprinted at a location proximate the ink jet print-heads 128 of the modified printer 126 (FIGS. 16B and 24).

Figure 18:
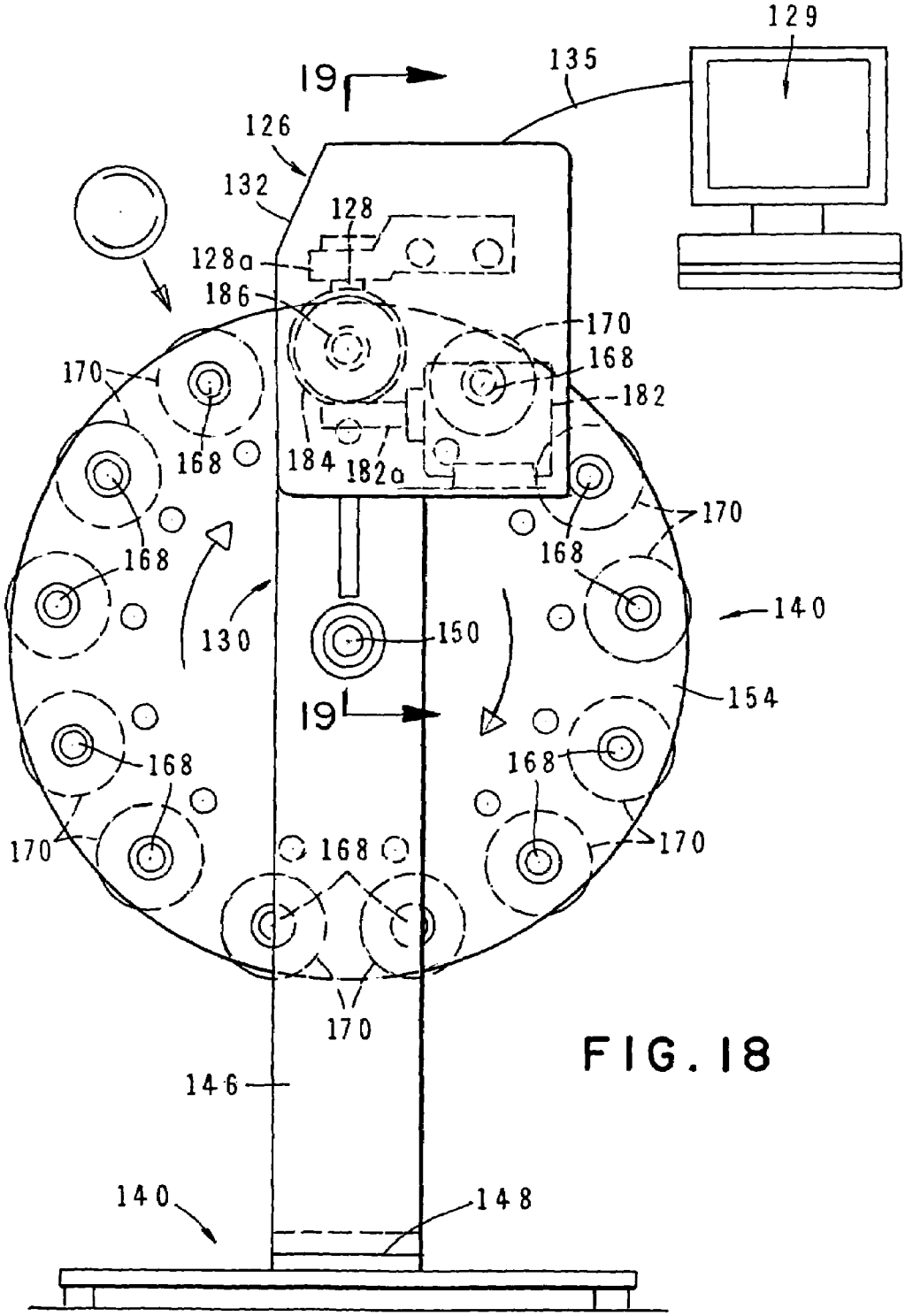
FIG. 18 is a cross-sectional view taken along lines 18-18 of FIG. 16B.

While various commercially available ink jet printers and plotters can be used in combination with the positioning means of the invention, large-format and desktop printers of the character previously described manufactured and sold by The Hewlett-Packard Company as Designjet, Models 1050C/1055CM, 1120C and 1220C have proven satisfactory. Another commercially available printhead that is usable in combination with the positioning means of the invention is a printhead manufactured and sold by Xaar, plc of Cambridge, United Kingdom. The modified printers used in the present application are microprocessor-based digital printers that receive plotting instructions from an associated host computer 129 (FIG. 18). It is also to be understood that either a printer or a plotter apparatus could be specifically designed for a given application and could be used with positioning means of the character presently to be described in performing the method of the invention. Such an apparatus would preferably incorporate a reciprocally-movable cartridge assembly that could imprint images on a stationary object.

Figure 15:
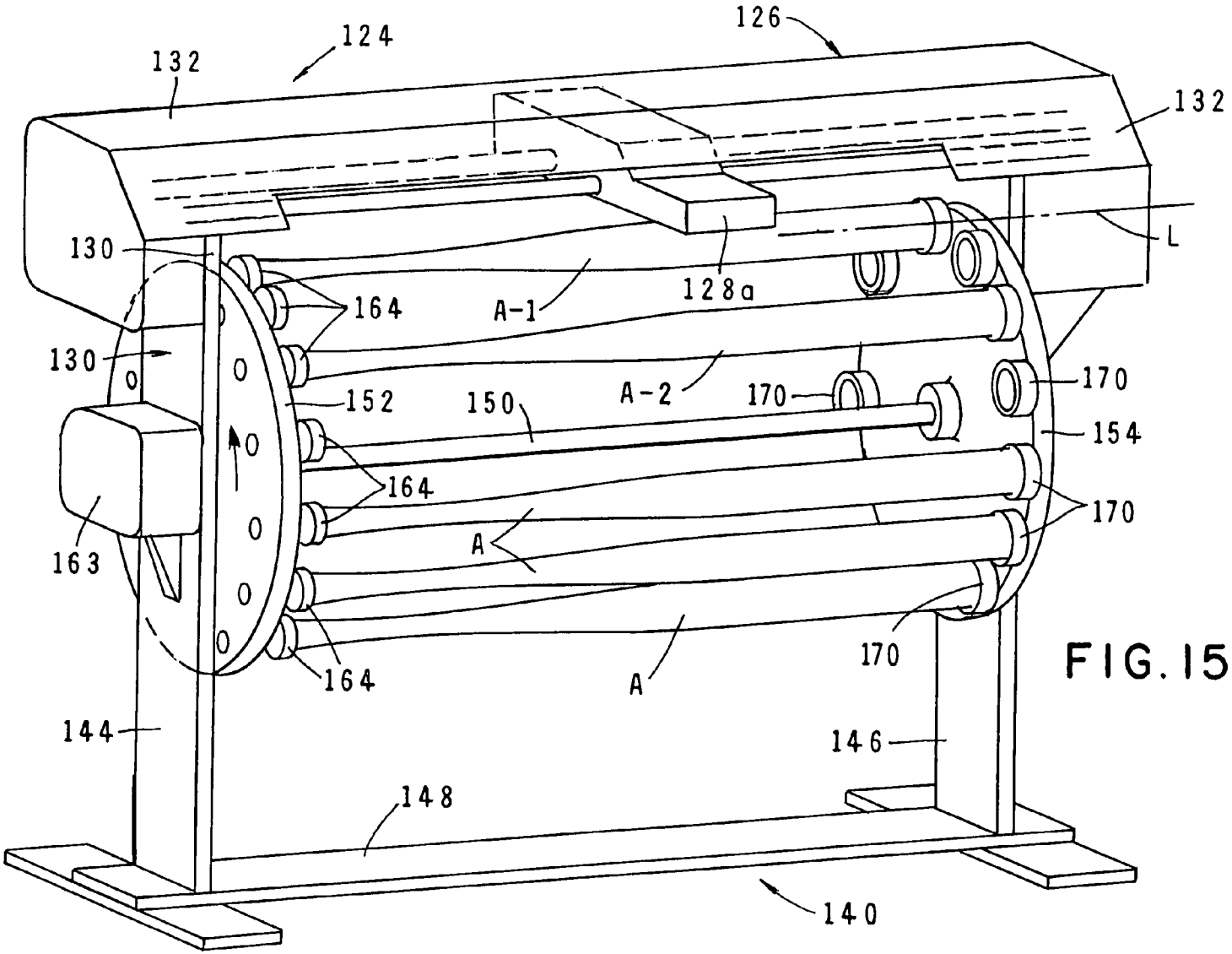
FIG. 15 is a generally perspective view of an alternate form of the apparatus of the invention for imprinting a predetermined pattern on a surface of a plurality of three-dimensional articles such as a baseball bats.

As best seen in FIG. 15, the positioning means of the apparatus of the present invention comprises an upstanding frame 130 that supports the modified printer 126 in the manner shown in FIG. 15. In the present form of the invention modified printer 126 comprises a housing 132 which houses the printer carriage 128*a*, which carries the print-heads heads 128, and a control unit 134 (FIGS. 19B and 22), which includes the control circuitry of the apparatus. Computer 129 (FIG. 18) functions to communicate to the control circuitry and to the printer the predetermined image or graphic that is to be imprinted on the selected three-dimensional article to be imprinted. As before, the image or graphic can be scanned or can be originally-generated in the computer environment with specialized software. Typically, the computer image or graphic is stored on a hard drive and sent via a cable 135 to the control circuitry of the printer. Techniques for scanning or originally-generating the image or indicia to be imprinted on the three-dimensional article are well known to those skilled in the art.

Data transfer is controlled by the computer 129, which generates and transmits to the printer via the control circuitry the necessary timing signals to properly sequence the processing of data and instructions to the printer. The printer memory typically contains the operating system to control printer operation using the control panel. The ink jet print-heads 128, which, upon command travel longitudinally of the print zone of the printer along the print-head carriage 128*a*, are preferably of very high resolution, such as those previously described herein.

The ink, which is dispensed by the ink jet print-heads, can be either solvent or waterbased and is carried by the cartridges in a manner generally disclosed in previously identified U.S. Pat. Nos. 4,646,106 and 4,592,292. The carriage of the printers typically contains a printed circuit board, which controls the firing of the nozzles in the ink jet print-heads. In the apparatus of this latest form of the invention, the motor is also controlled from the main printed circuit assembly by the microprocessor 129 via the control circuitry housed within control unit 134.

Consider now the important article-positioning means of this latest form of the invention for strategically positioning the articles to be imprinted relative to the print-heads 128 of the printing apparatus. This means here comprises a novel article-positioning assembly, generally designated in the drawings by the numeral 140. As previously mentioned, positioning assembly 140 sequentially positions each of the plurality of articles to be imprinted (shown in the drawings as baseball bats) in a manner such that the longitudinal axis of the selected one of the plurality of three-dimensional articles to be imprinted is maintained within a plane that is substantially parallel to and spaced-apart from the plane of the printing heads 128 of the printing assembly.

Figure 16A:
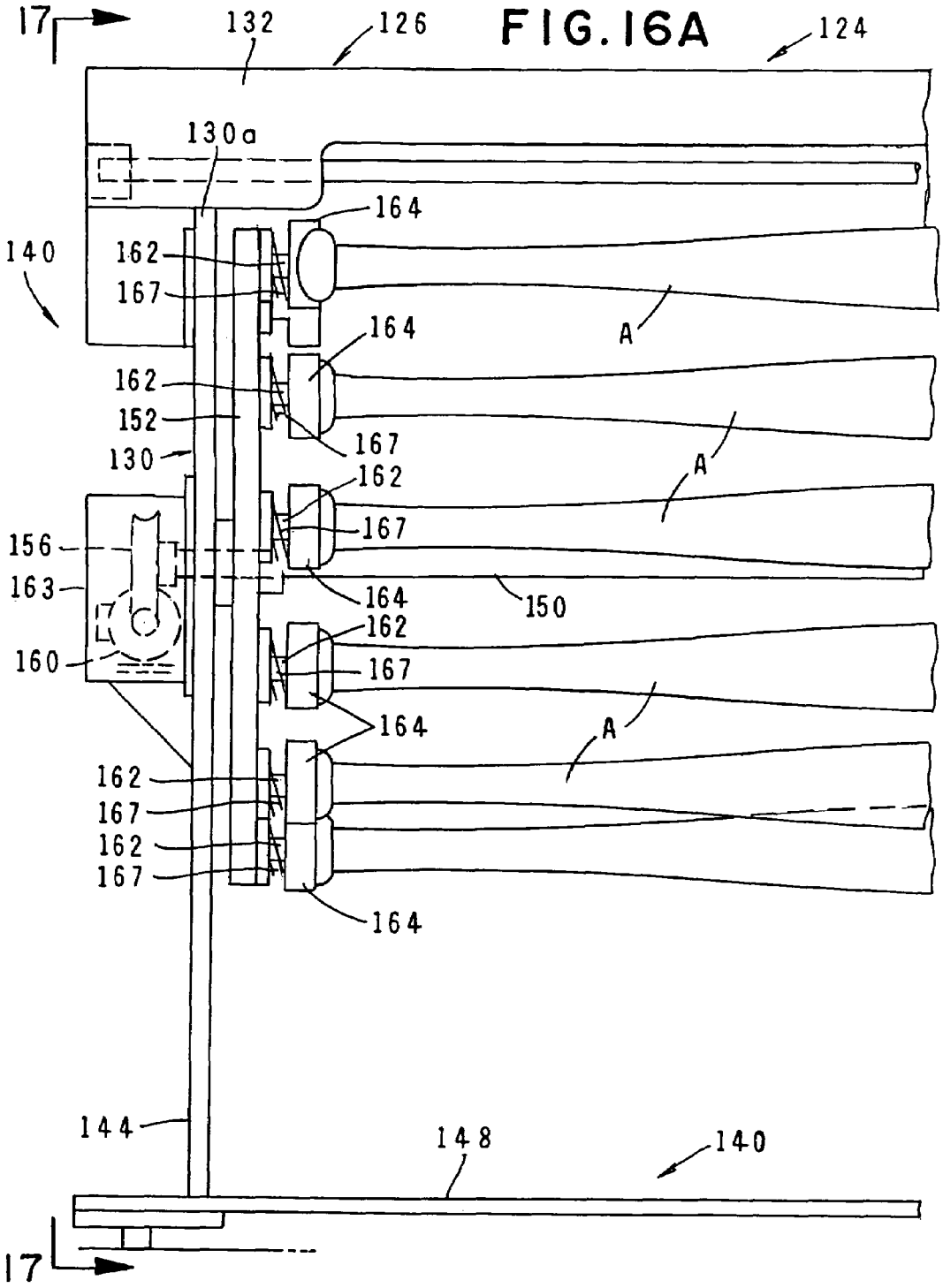
FIGS. 16A and 16B when considered together comprise is an enlarged front view of the apparatus shown FIG. 15.
Figure 16B:
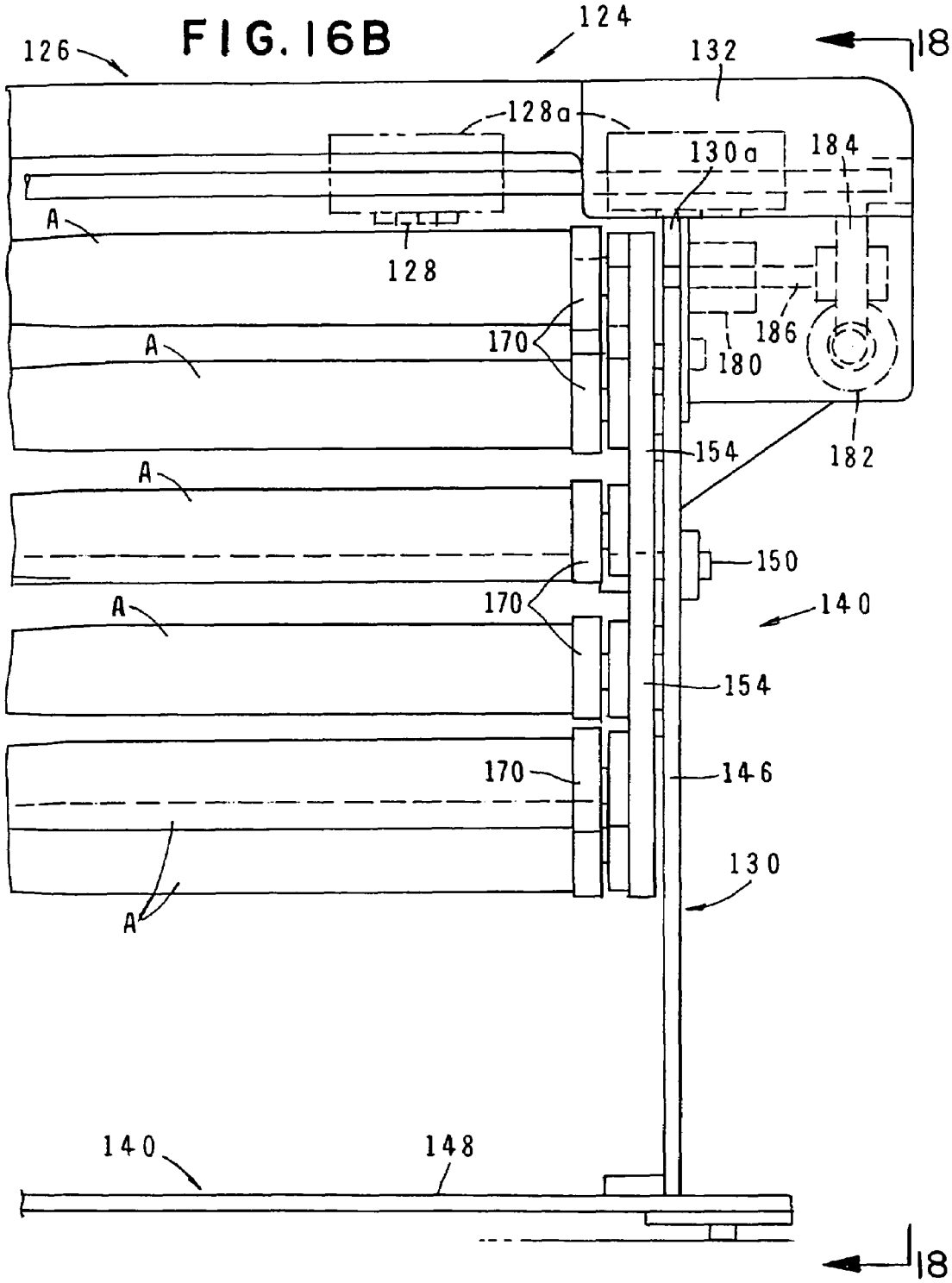
Figure 19A:
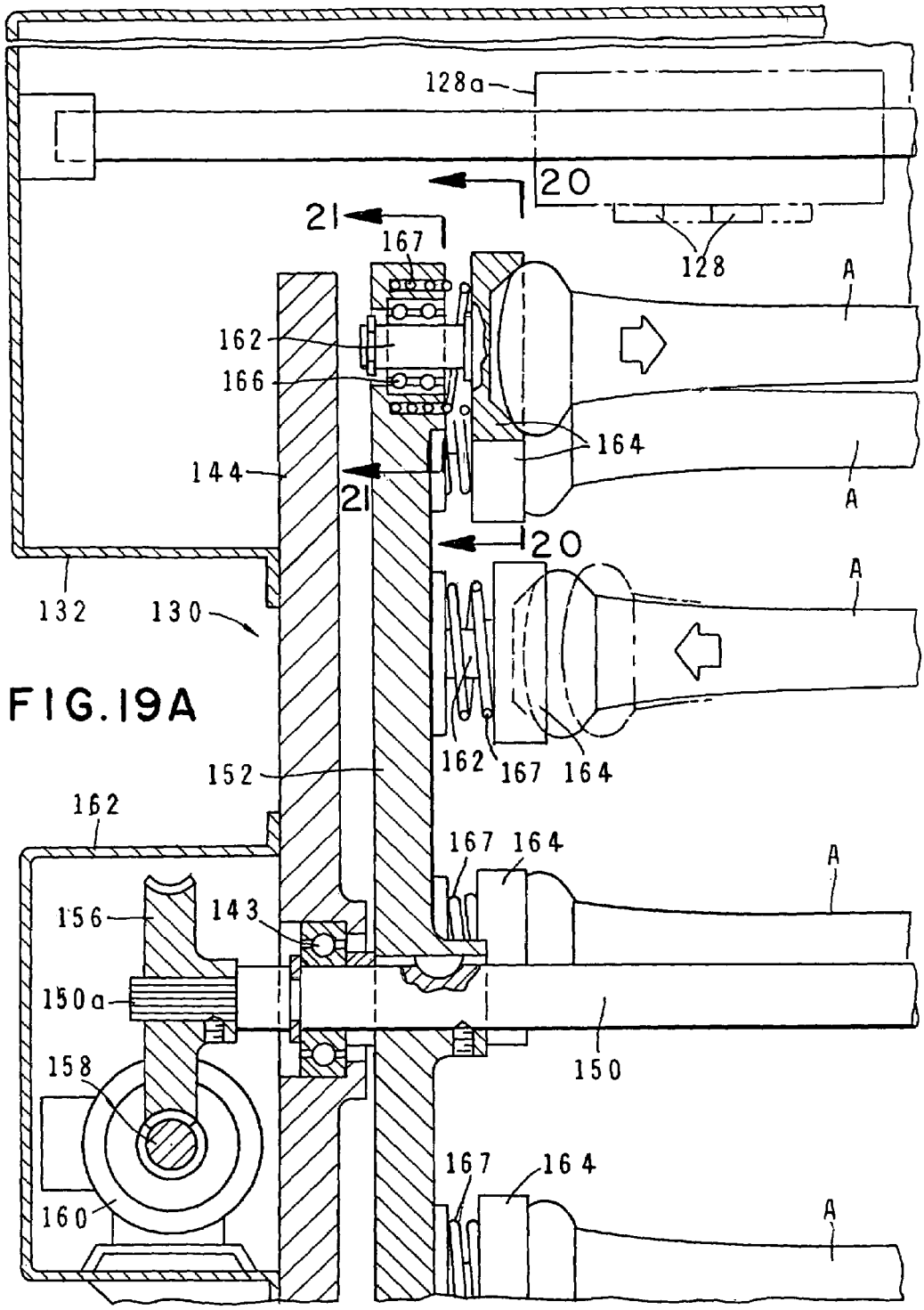
FIGS. 19A and 19B when considered together comprise a cross-sectional view taken along lines 19-19 of FIG. 18.
Figure 19B:
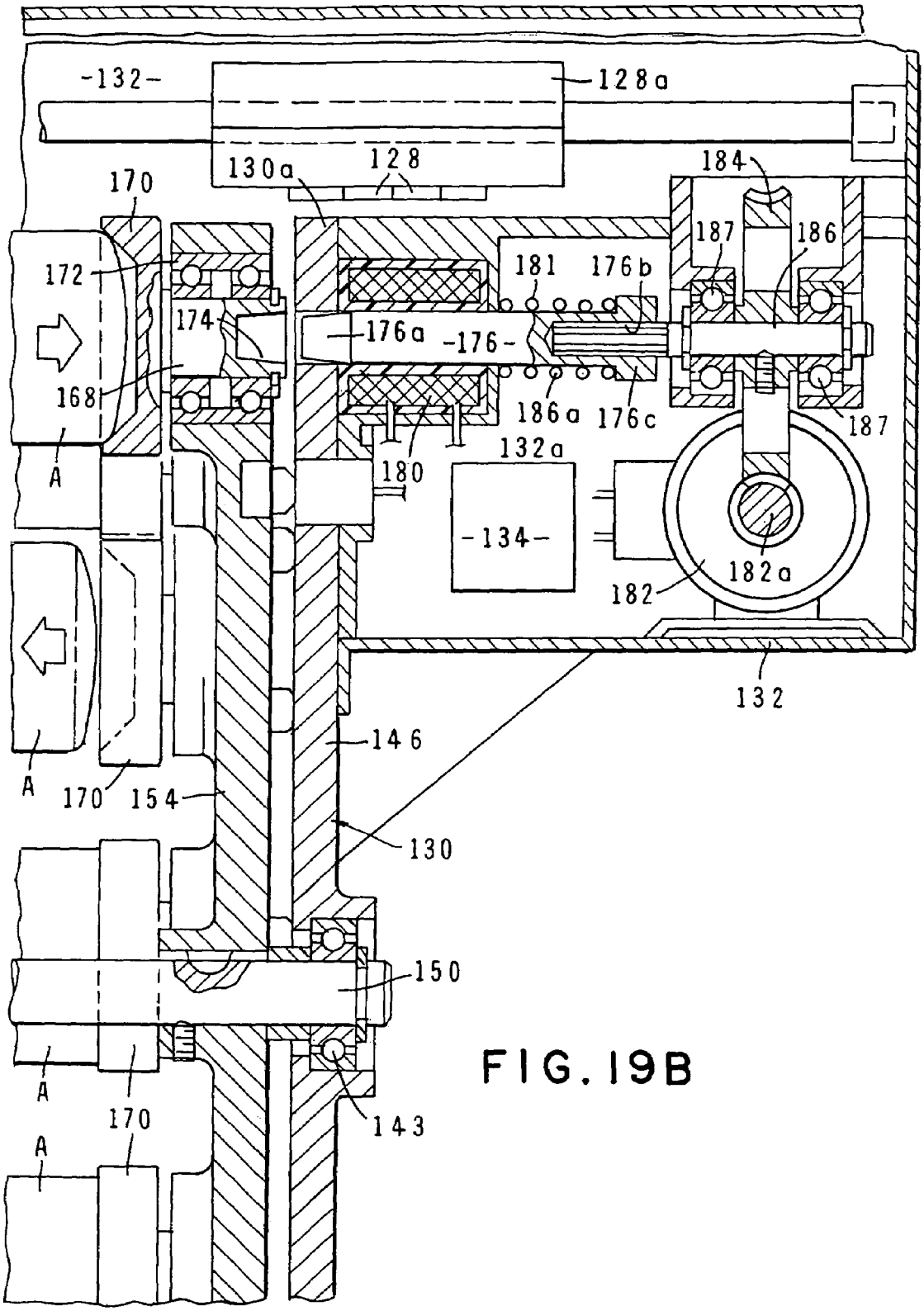
Figure 26:
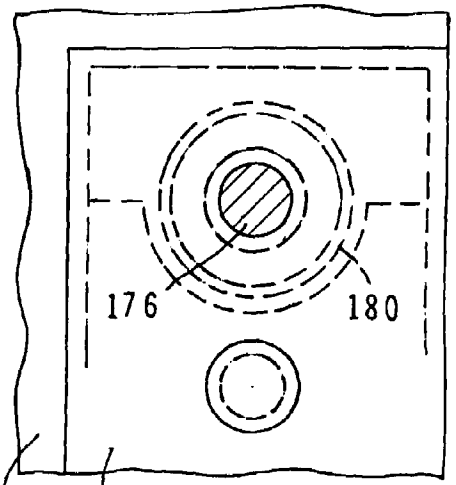
FIG. 26 is a cross-sectional view taken along lines 26-26 of FIG. 22.
Figure 20:
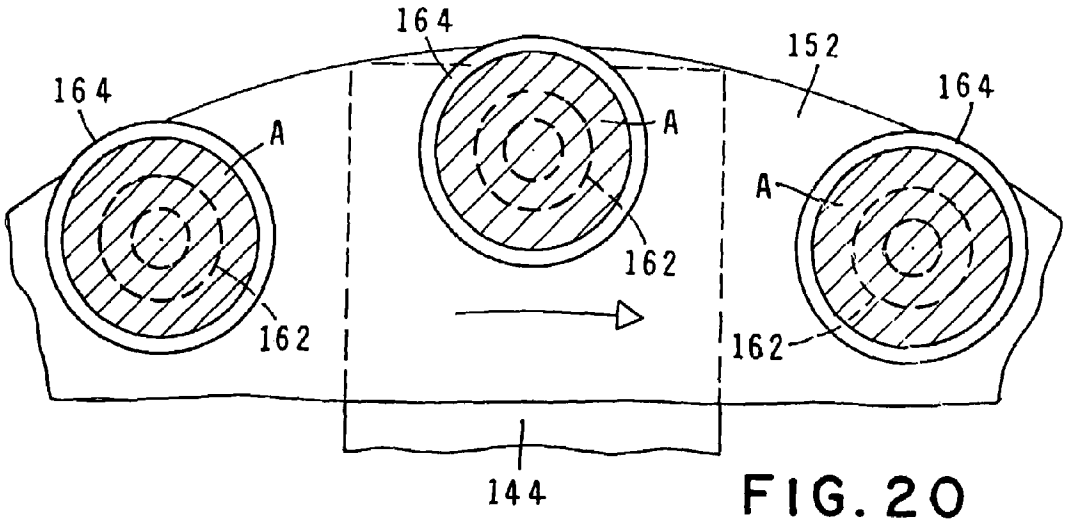
FIG. 20 is an enlarged, cross-sectional view taken along lines 20-20 of FIG. 19A.
Figure 23:
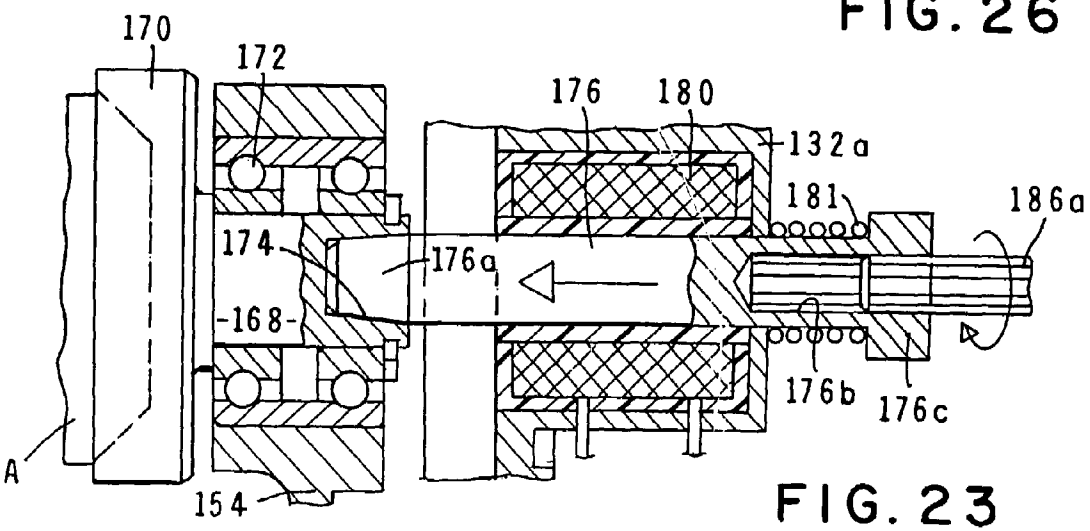
FIG. 23 is an enlarged cross-sectional view similar to the upper portion of FIG. 19B, but showing the solenoid-operated drive shaft of the apparatus moved into a driving position.
Figure 21:
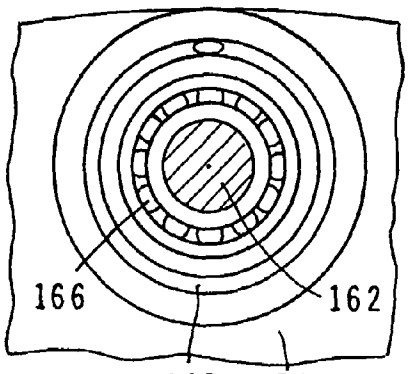
FIG. 21 is an enlarged, cross-sectional view taken along lines 21-21 of FIG. 19A.

As best seen in FIGS. 15, 16A and 16B, article-positioning assembly 140 here comprises the previously identified upstanding supporting frame 130 the upper portion 130*a* of which supports housing 132 of the printing assembly in the manner illustrated in FIG. 15. Supporting frame 130 includes first and second spaced-apart sides 144 and 146 that are interconnected proximate their lower extremities by a base member 148. Rotatably carried by bearing assemblies 143, which are carried by sides 144 and 146, is a central axle 150 to which first and second spaced-apart supporting wheels 152 and 154 are interconnected at spaced-apart locations (FIGS. 19A and 19B).

Connected to side 144 of frame 140 is wheel rotation means for controllably rotating axle 150 along with first and second supporting wheels 152 and 154. As best seen in FIG. 19A, this wheel rotation means here comprises pinion gear 156 that is affixed to the splined end 150*a* of the axle 150 and a rack member 158 which is driven by wheel-driving motor means, shown here as an electric motor 160. A housing 162, which is affixed to side frame member 144, functions to enclose the pinion gear, the rack member and the electric motor 160.

Figure 17:
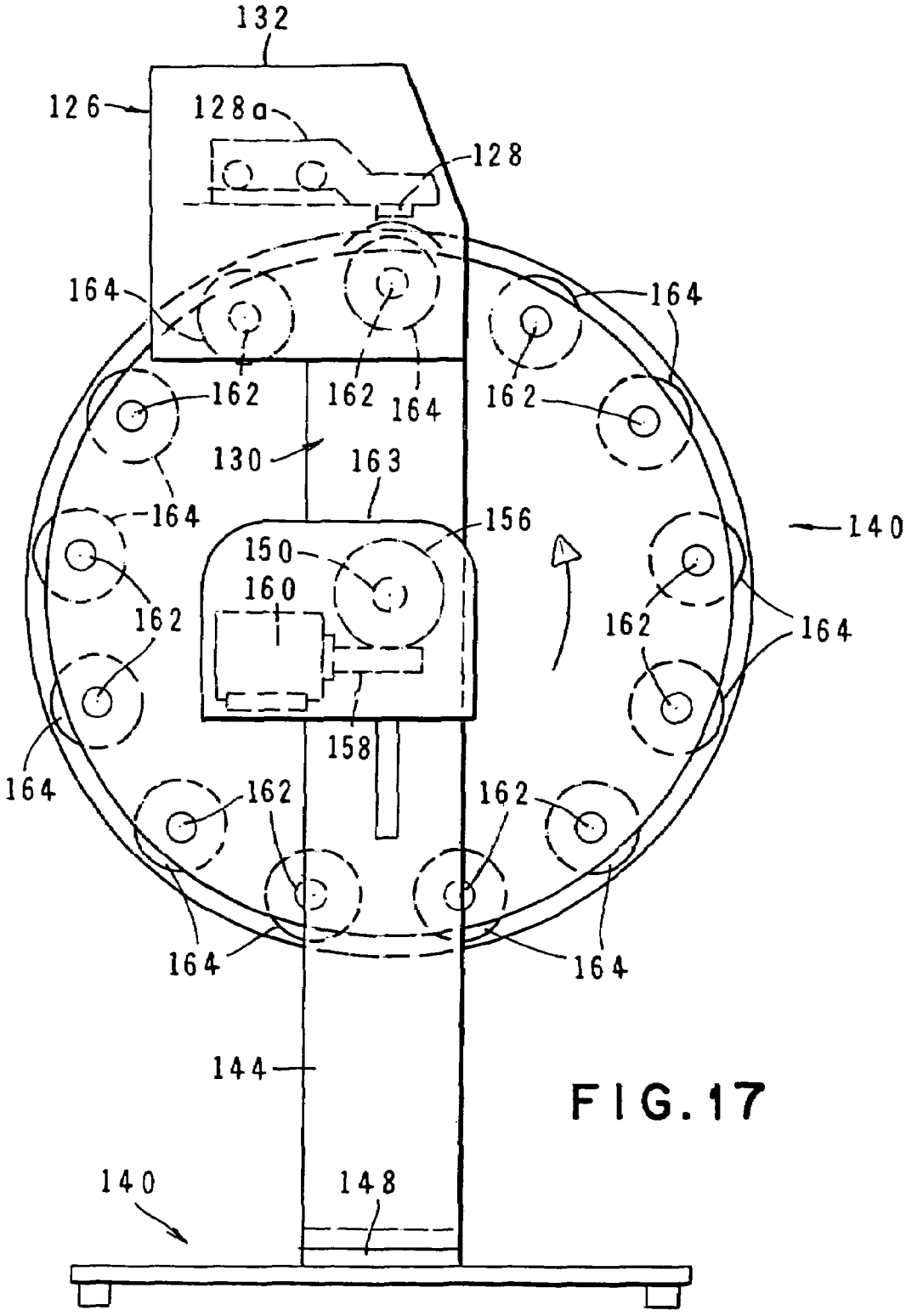
FIG. 17 is a cross-sectional view taken along lines 17-17 of FIG. 16A.

Affixed to wheel 152 are thirteen circumferentially spaced-apart first gripping means for releasably gripping the first or handle end of each of the plurality of three-dimensional articles which, here are shown as baseball bats, are to be imprinted (FIG. 17). Each of the first gripping means here comprises an axle 162 and a bat handle-engaging or gripping cup 164 that is interconnected with axle 162. As best seen by referring to FIG. 19A, each axle 162 is rotatably mounted within a bearing assembly 166 that is carried by wheel 152. In a manner presently to be described, the bat handle engaging cup 164 of each of the first gripping means is movable, against the urging of a first biasing means, here provided as a coil spring 167 which circumscribes axle 162, from a first position spaced-apart from first supporting wheel 152 (see the central portion of FIG. 19A) to a second position proximate said first supporting wheel 152 (see the upper portion of FIG. 19A).

Also affixed to wheel 154 are thirteen circumferentially spaced-apart second gripping means for gripping the second or barrel end of the plurality of three-dimensional articles "A". Each of these second gripping means here comprises a driven shaft 168 and a generally cup-shaped, bat barrel engaging or gripping member 170 which is connected to the driven shaft for rotation therewith. As indicated by FIG. 19B, each of the driven shafts 168 is rotatably supported by a bearing assembly 172 which is carried by wheel 154. For a reason presently to be described, driven shaft 168 is provided with a tapered socket 174.

Also comprising a part of the article-positioning means of the invention is a specially designed article-rotating means which is connected to the supporting frame for controllably rotating a selected one of the plurality of second gripping means. As best seen by referring to FIG. 19B, this novel article-rotating means here comprises a drive shaft 176, drive shaft motor means for rotating the drive shaft and interconnection means for interconnecting the drive shaft with driven shaft 168. The interconnection means here comprises a solenoid assembly 180 of conventional construction which is carried by frame side member 146. Solenoid assembly 180 is operably associated with drive shaft 176 for controllably moving the drive shaft forwardly in the manner shown in FIGS. 22 and 23 into an extended position against the urging of a second or drive shaft biasing means. More particularly, during the operation of the apparatus, drive shaft 176 is moved by solenoid 180 from the first retracted position shown in FIG. 19B to the second extended position shown in FIGS. 22 and 23 wherein the tapered end portion 176*a* of shaft 176 is closely, drivably received within tapered socket 174 of shaft 168. In the present form of the invention, this drive shaft biasing means comprises a coil spring 181 which is disposed between an enlarged diameter portion 176*c* of drive shaft 176 and an inner housing 132*a* that houses solenoid assembly 180.

Figure 22:
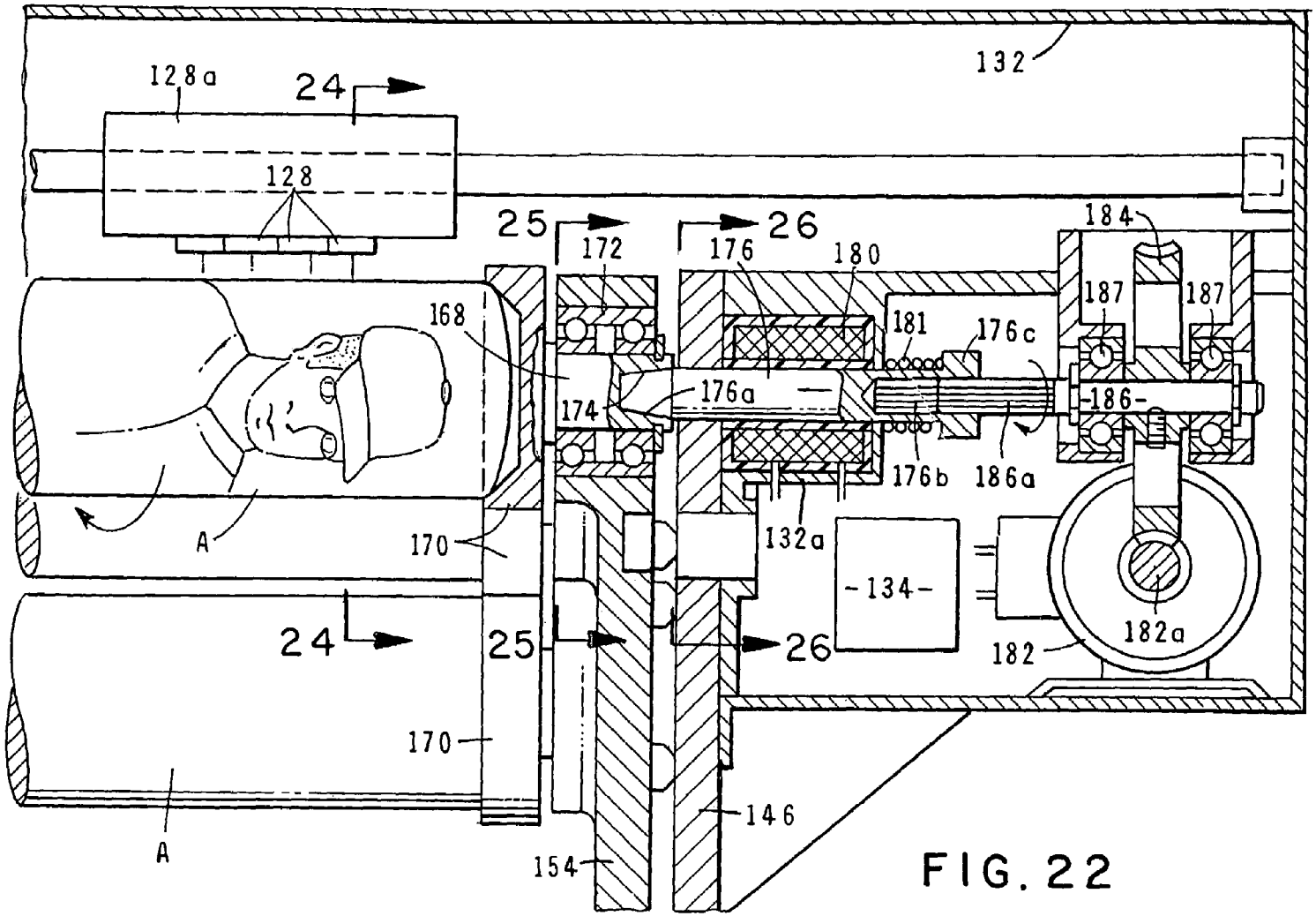
FIG. 22 is an enlarged cross-sectional view similar to the upper portion of FIG. 19B showing the commencement of the printing step of the method of the invention.

With the construction described in the preceding paragraph, when the drive shaft is moved into the second position shown in FIG. 22 and when the motor means, shown here as electric motor 182, is energized, axle 168, along with cup 170 and the baseball bat that is supported between cups 164 and 170 will be controllably rotated. In this regard, as best seen in FIGS. 16B, 18 and 19B, motor 182 has a drive shaft 182*a* which drives a gear 184 that is, in turn, affixed to a shaft 186. Shaft 186, which is rotatably supported by a pair of bearings 187, is provided with a splined end 186*a* that is slidably received within a ribbed bore 176*b* provided in shaft 176 (FIGS. 19B). When the solenoid is de-energized, spring 181 will cause the shaft 176 to return to its normal retracted position shown in FIG. 19B. A portion of the previously identified housing 132, which is affixed to side frame member 146, functions to enclose motor 182 as well as the interconnection means of the invention.

In accomplishing the method of the invention, the article-positioning means is first loaded with the articles to be imprinted, in this case a plurality of baseball bats. This is done by sequentially inserting the handle portion of each bat into a selected one of the handle gripping cups 164 and exerting a rearward pressure that is to the left as viewed in FIG. 15. This rearward pressure causes spring 167 to compress so as to provide sufficient clearance to permit the barrel end of each of the bats to be inserted into the barrel engaging or gripping cups 170. With the positioning means fully or partially loaded, one of the bats, such as the bat designated as "A-1" in FIG. 15, includes a curved surface that resides immediately below the print-heads 128*a* of the printing carriage. With the bat in this position, the solenoid 180 will be energized by the computer-controlled, control unit 134 in a manner to urge the shaft 176 to the left so as to force the tapered end portion 176*a* thereof into driving engagement with the socket 174 provided in shaft 168 (see FIGS. 22 and 23). The control unit 134 will next energize motor 182 so as to impart rotation to shaft 182*a*, to shaft 186, to shaft 176 and to barrel gripping cup 170. Rotation of cup 170, which is in frictional engagement with the barrel end of the bat, will cause the bat to rotate about its longitudinal axis "L" (FIG. 15) at a uniform, predetermined rate. In this regard, and by way of non-limiting example, when the image to be printed comprises, a depiction of a human figure, such as a baseball player of the character shown in FIG. 22, the desired image is either scanned or originally computer generated using specialized software of a character well known to those skilled in the art. As discussed in connection with the earlier described embodiment of the invention, because of the tapered configuration of the bat, it is necessary to produce a distorted image that is of a character, which generally conforms to the planar projection of the surface to be imprinted, the image being substantially narrowed so as to conform to the tapering of the bat (see FIG. 14). When this distorted image is printed by the printer in accordance with appropriate instructions given to the control circuitry of the printer by host computer 129, the image will be neatly wrapped around the curved barrel surface as well as the tapered and handle portions of the bat to produce a desired nonoverlapping result. As previously discussed herein, image distortion of the character described can be easily accomplished by those skilled in the art using several types of readily commercially available morphing type software to create a file that is readable by the control circuitry of the modified microprocessor-based printer being used.

The nature and extent of the distortion of the image to be imprinted is, of course, dependent on the configuration of the article to be imprinted. When the article has the configuration of a baseball bat, the bat must first be dimensionally analyzed to determine the character of the surface of the bat that is to be imprinted. Such an analysis can readily be accomplished by those skilled in the art and typically involves a determination of the diameter of the barrel portion of the bat and the degree of reduction in diameter or extent of taper of the tapered and handle portion upon which the image is to appear. Such a dimensional analysis of a baseball bat is relatively simple and need not be particularly precise so long as the surface to be imprinted can be projected into a planar configuration. Once the distorted image is created and appropriately loaded into the printer and the bat is rotated in the manner previously described, the ink cartridges will move through the print zone in the conventional manner previously discussed and will appropriately deposit ink onto the surface of the bat to create the desired appropriately distorted image (see FIG. 22). More particularly, as the bat rotates, the control circuitry of the printer responding to the instructions received from the pre-programmed host computer 129 will direct the ink jet-heads to controllably deposit ink onto the surface of the bat in accordance with the predetermined software that has been developed to produce the desired image on the baseball bat.

When the printing of the uppermost bat "A-1" is completed, solenoid 180 is de-energized so as to permit spring 182 to urge shaft 176 to return to its retracted position as shown in FIG. 19B. Following retraction of the shaft 176, motor 160 can be energized by the control circuitry of the apparatus to cause controlled rotation of central shaft 150 and the concomitant rotation of wheels 152 and 154 to a position wherein the next in order article to be imprinted, such is the article designated as "A-2" in FIG. 15, is moved into position below the printing heads 128*a*. With the bat "A-2" in this position, the solenoid 80 will once again be energized by the computer-controlled, control unit 134 in a manner to urge the shaft 176 to the left so as to force the tapered end portion 176*a* thereof into driving engagement with the socket 174 provided in shaft 168. The control unit 134 will next energize motor 182 so as to impart rotation to shaft 176, to shaft 168 and to cup 170. Rotation of cup 170, which is in frictional engagement with the bat "A-2", will cause the bat to rotate about its longitudinal axis "L" at a uniform, predetermined rate so that the printing operation can be accomplished in the manner described in the preceding paragraphs.

Following the completion of the printing of the bat "A-2", the remaining unprinted bats mounted within the positioning means can be imprinted in the same manner as discussed in the preceding paragraphs. When all of the bats mounted within the positioning means have been imprinted with the selected indicia, the bats can be removed from the positioning means by sequentially exerting a rearward pressure on holding cups 164 in a manner to compress springs 167 sufficiently to provide the clearance necessary to permit the removal of the opposite end of the bats from the cups 170.

Referring next to FIGS. 26A through 34, still another form of the apparatus of the invention for imprinting a predetermined image or pattern on three-dimensional articles is there illustrated and generally designated by the numeral 194. The apparatus of this form of the invention is also made up of two main components, one being printing means for printing the articles to be imprinted and the other comprising positioning means for holding, positioning, and rotating the articles to be imprinted at a location proximate the ink jet print-heads 196 of the printing means. In this latest embodiment of the invention, the printing means comprises a microprocessor-based, ink jet printing apparatus the construction of which will presently be described.

In this latest form of the invention, the positioning means of the invention, which includes computer means for controlling the printing means, is operably coupled with the aforementioned printing means which uniquely includes the previously mentioned plurality of ink jet print-heads, or cartridges 196 which travel longitudinally of the article to be printed. Suitable ink jet print-heads, or cartridges 196 are commercially available from various sources, including Spectra, Inc. of Lebanon, N.H. In one form of the invention, three ink jet cartridges of the plurality of ink jet cartridges contain ink of the three primary colors, namely red, yellow and blue, while a fourth cartridge contains black ink. This allows the computer program, which is stored in the computer memory of the computer means of the invention, to cause the application of a multiplicity of individual ink dots of various colors to the surface of the article to be printed so that, when combined by the human eye, appear as photo-quality images. As will be discussed in greater detail in the paragraphs which follow, during the printing operation, the article to be printed is controllably rotated relative to the print-heads of the printing means, with the longitudinal axis of the article being continuously maintained in a plane which is parallel to and spaced-apart from the plane within which the ink jet nozzles of the print-heads reside. A computer 198 (FIG. 26B), which forms a part of the computer means of the invention, is used to communicate to the printing means information containing the predetermined pattern to be printed, which has either been previously scanned or originally-generated using commercially available software. The pattern information is typically stored in the computer memory and then sent via cable to the printing means, which, as previously mentioned, preferably comprises four color ink jet print-heads capable of dispensing pigmented inks or dyes comprised of either a solvent or water base material. A printed circuit board, which also comprises a part of the computer means, is operably associated with a conventional cable that controllably fires the nozzles of the print-heads in a manner to controllably spray microdots of ink in a predetermined pattern onto the surface of the article to be printed. According to one embodiment of the invention, the microdots have a diameter of approximately 0.0500 mm. (0.002 inches) thereby enabling intricate images to be imprinted on the surface. Upon contact with the surface, the ink solidifies and leaves a digitally generated or scanned image or graphic on the surface without the ink jet nozzles ever coming into physical contact with the surface.

Images to be applied to irregular, non-linear surfaces with changing diameters, such as baseball bats, that are rotating at a constant angular rate can be printed to result in linear appearance by computer programming. The printing means can also achieve the linear appearance by producing graphics that compensate dimensionally for the changing diameters and then, by scanning the graphic artwork, computer data can be recorded and stored for use on the subject equipment when desired.

In carrying out the method of this latest form of the invention, computer-stored images can be edited on the computer monitor screen 198*a* (FIG. 26B) to eliminate images, add images or erase spaces for insertion of images. Such images can be nomenclature; video camera generated photo-quality images (people, objects, animals, and the like). Changes can be accomplished expeditiously just prior to printing.

Figure 26A:
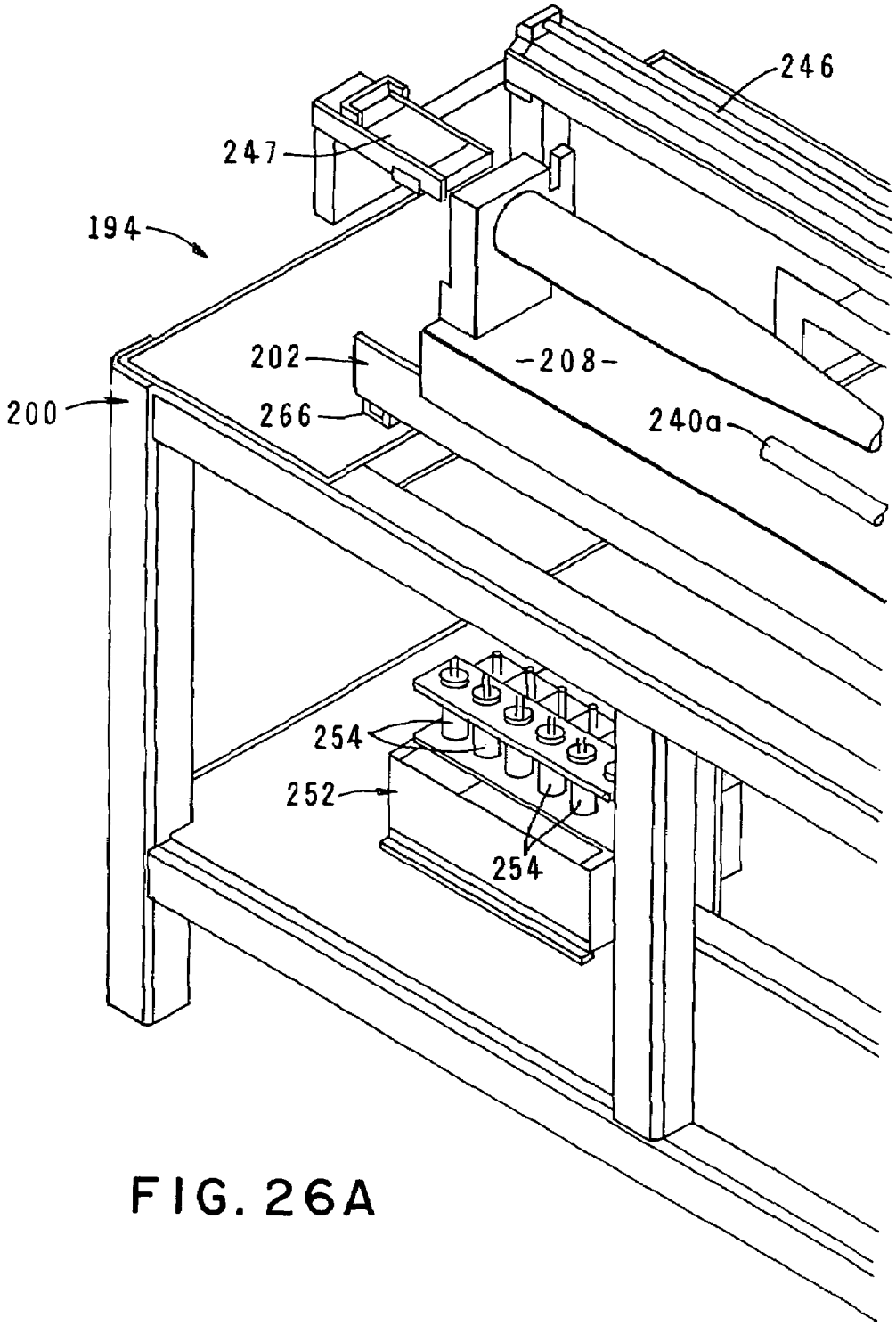
FIGS. 26A and 26B when considered together comprise a generally perspective view of yet another form of the apparatus of the invention for imprinting a predetermined pattern on a surface of a three-dimensional article such as a baseball bat.
Figure 26B:
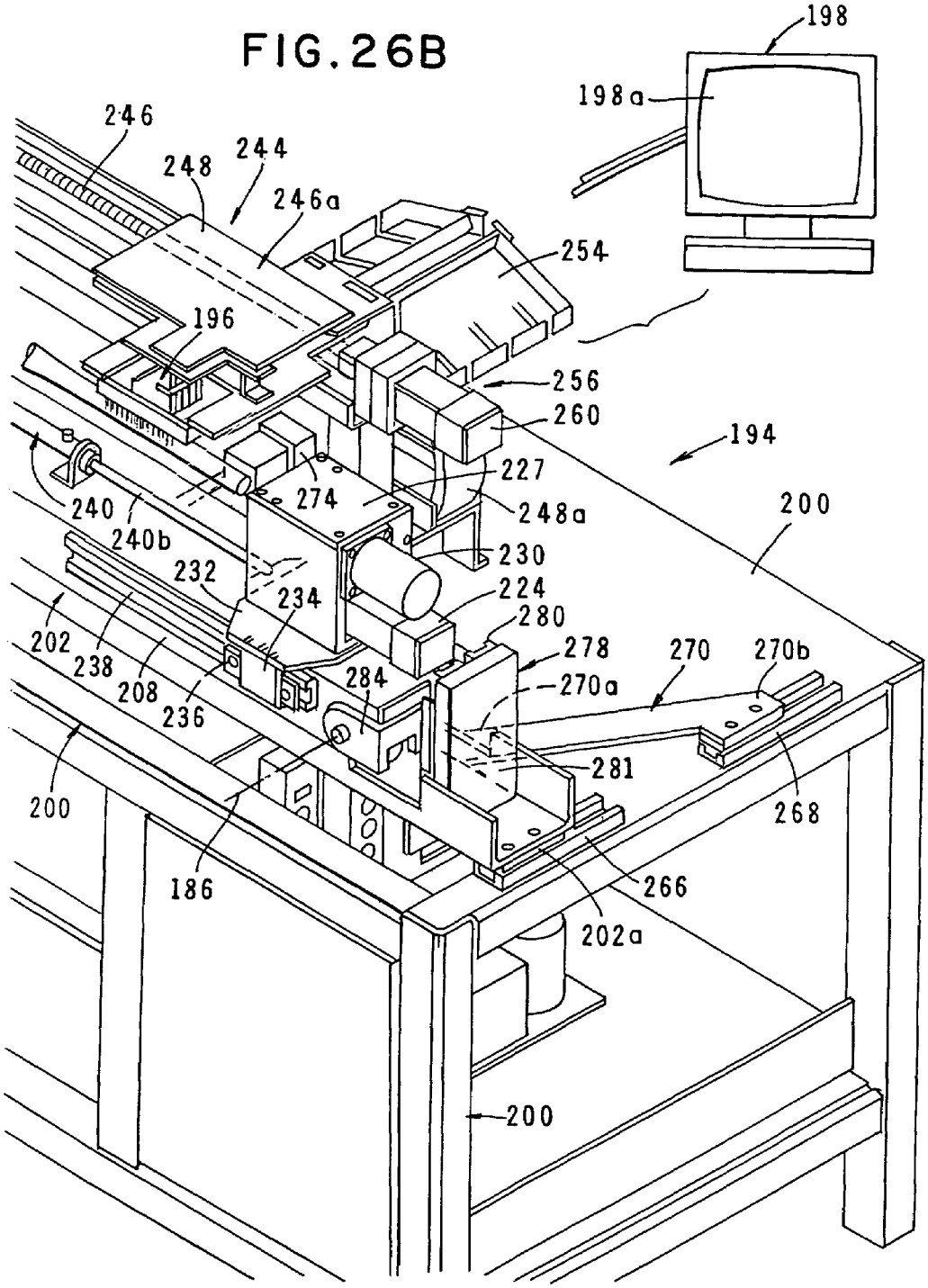

As best seen in FIGS. 26A and 26B, the positioning means of the apparatus of the present invention comprises an upstanding frame 200 that supports the printing means as well as the novel article-holding assembly of the invention, which includes a holding fixture that is generally designated in the drawings by the numeral 202. The article-holding fixture positions the article to be imprinted (shown in the drawings as a baseball bat) in a manner such that the longitudinal axis of the bat is maintained within a plane that is substantially parallel to and spaced-apart from the plane of the printing heads 196 of the printing means.

Figure 27A:
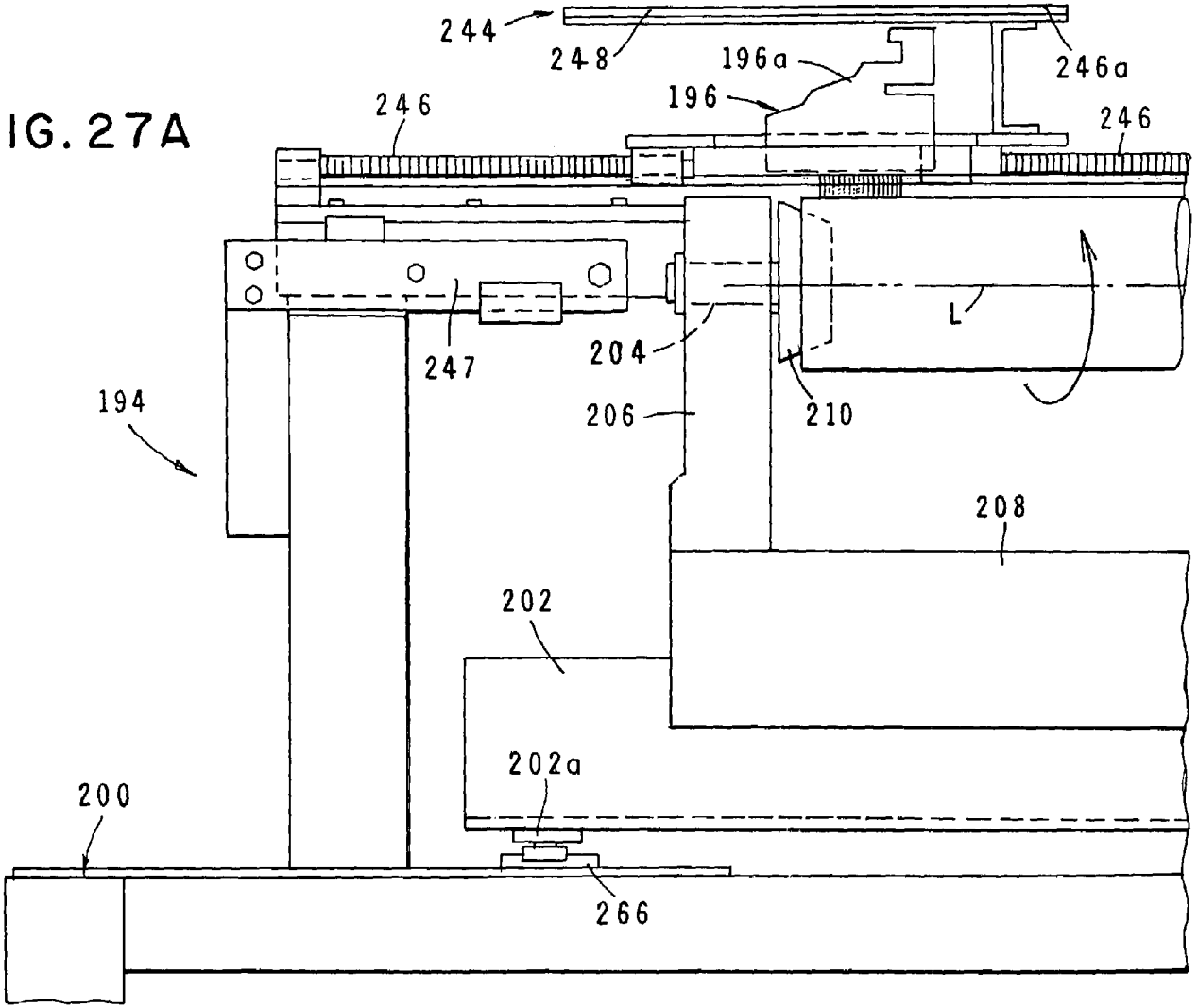
FIGS. 27A, 27B and 27C when considered together comprise an enlarged side-elevational view of the apparatus shown in FIGS. 26A and 26B.
Figure 27B:
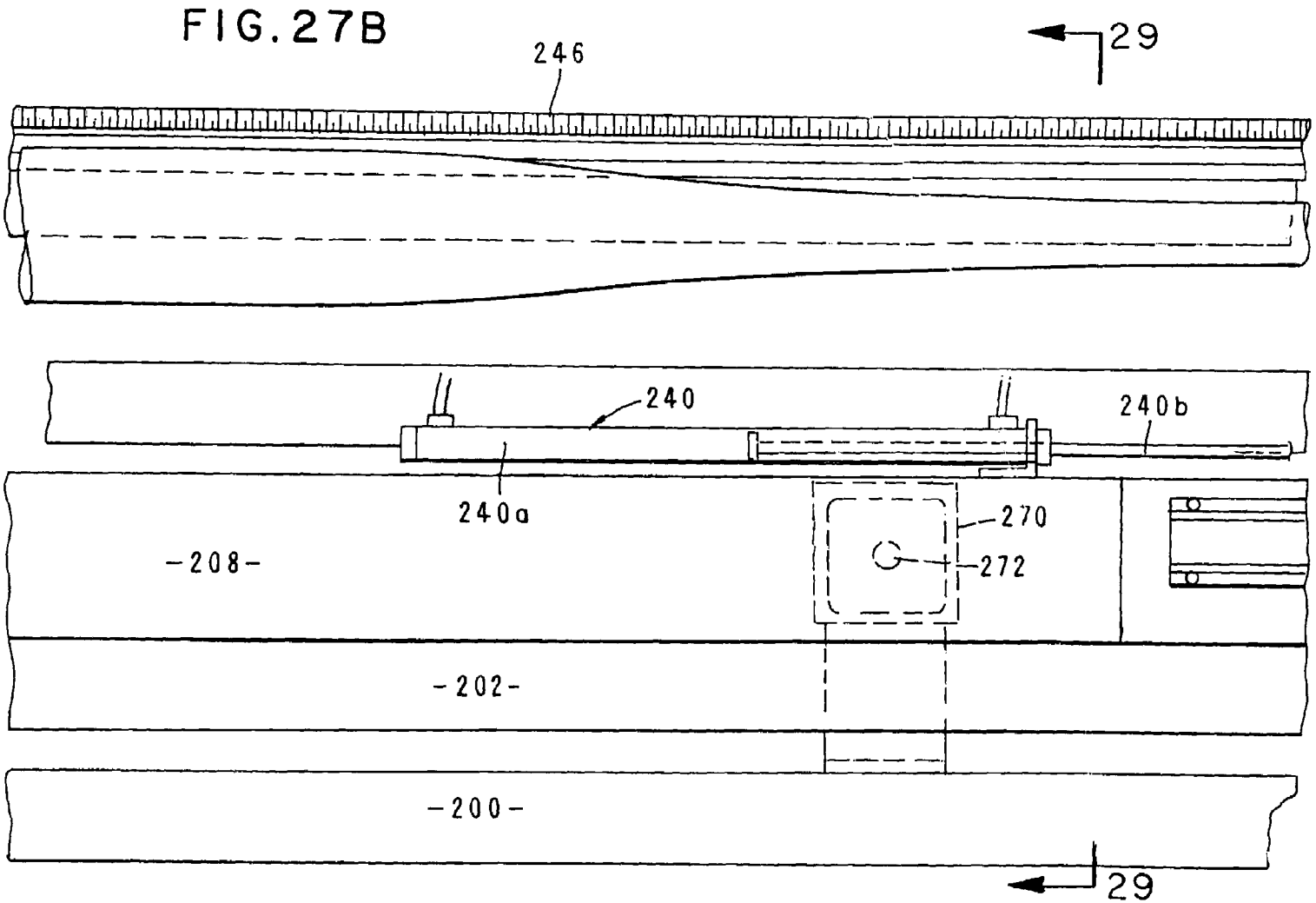

As best seen in FIGS. 26A and 26B, article-holding fixture 202 here comprises spaced-apart first and second gripping means for releasably gripping the opposite ends of the baseball bat that is to be imprinted (FIGS. 26A and 26B). As best seen in FIG. 27A, the first gripping means here comprises an axle 204 that is rotatably mounted within a first support block 206 carried by a fixture base 208 and a tapered, bat barrel-engaging gripping member 210 that is interconnected with axle 204.

Figure 27C:
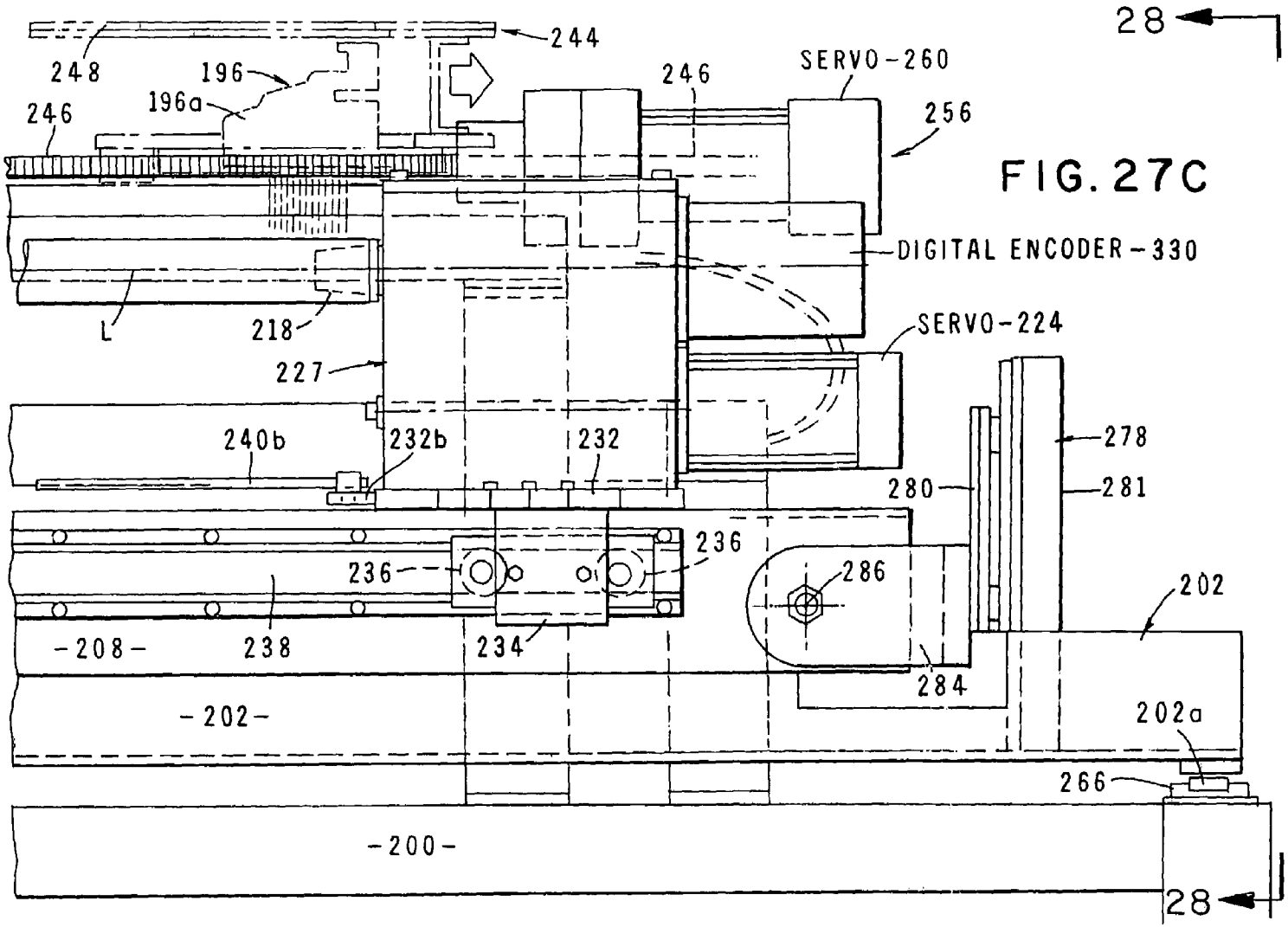
Figure 30A:
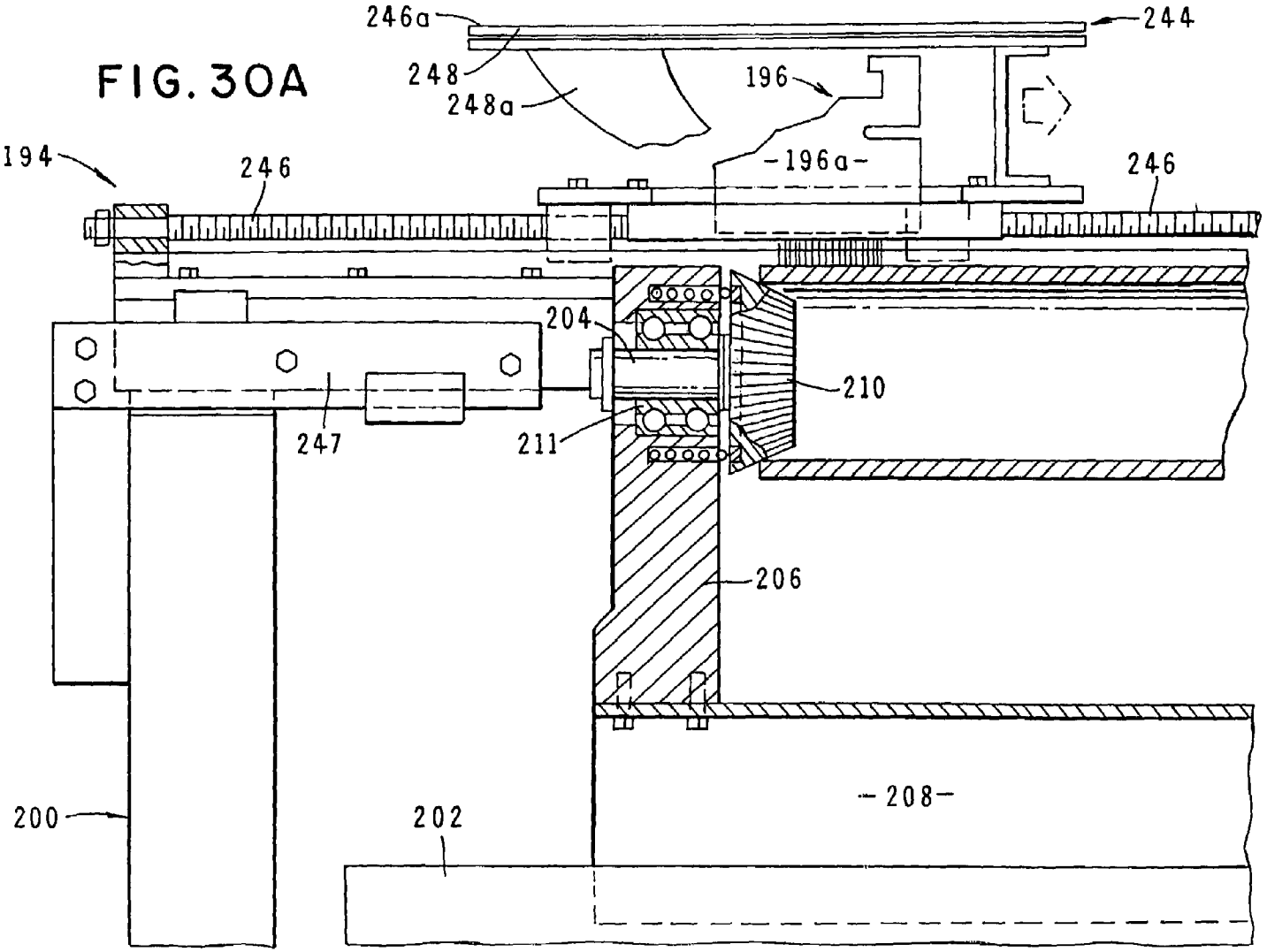
FIGS. 30A and 30B comprise a cross-sectional view taken along lines 30-30 of FIG. 29.
Figure 30B:
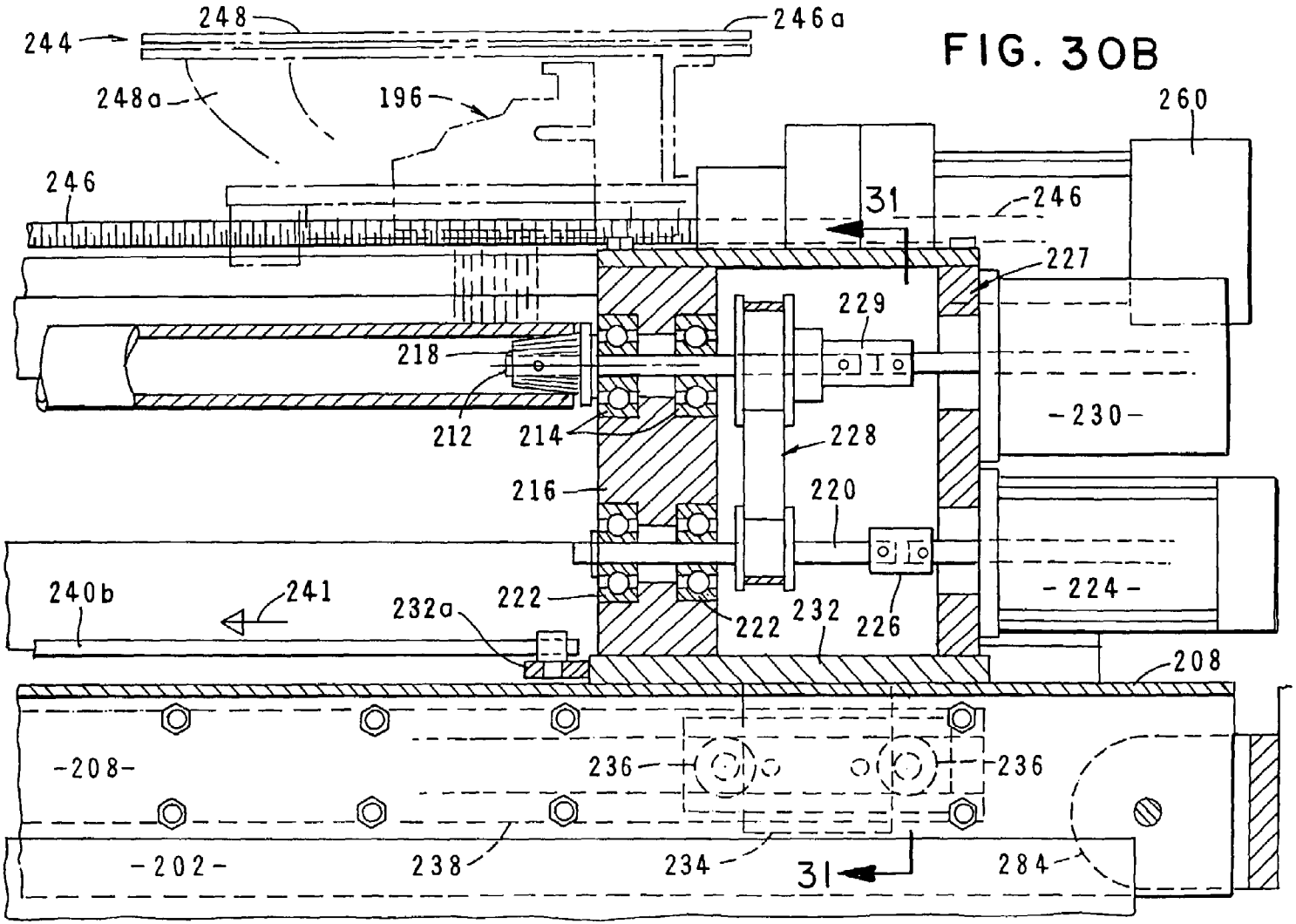
Figure 31:
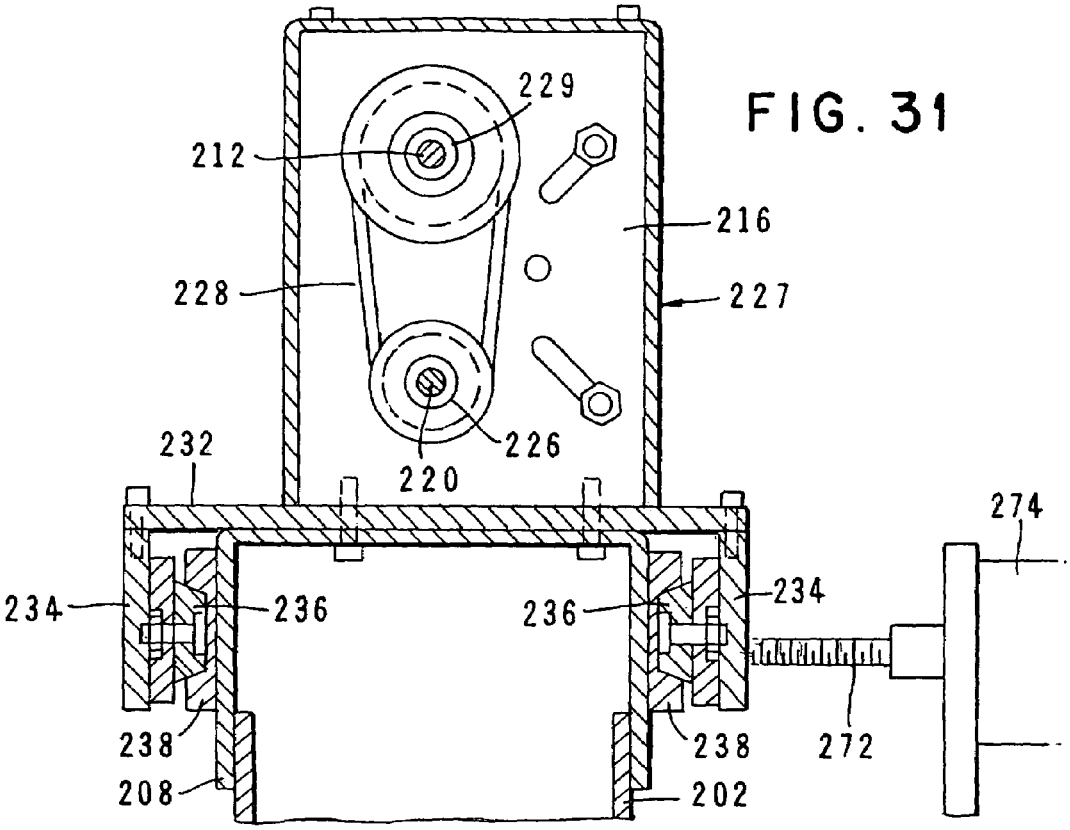
FIG. 31 is a cross-sectional view taken along lines 31-31 of FIG. 30B.
Figure 34:
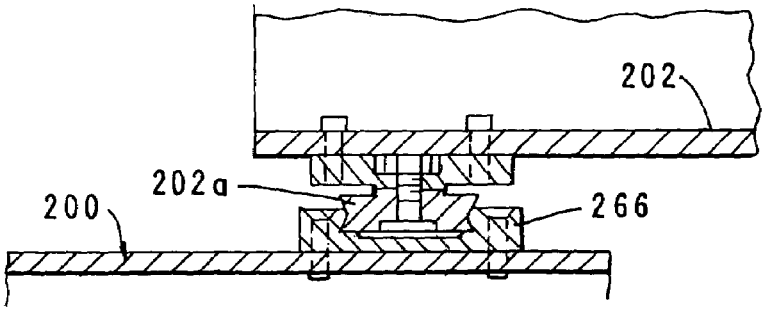
FIG. 34 is a cross-sectional view taken along lines 34-34 of FIG. 33.

As shown in FIGS. 27C and 30B, the second gripping means here comprises a driven shaft 212 that is rotatably mounted within a pair of bearing assemblies 214 carried by a second support block 216 that is also mounted on fixture base 208. A tapered, bat handle-engaging gripping member 218 is interconnected with driven shaft 212 in the manner shown in FIG. 30B.

Also comprising a part of the article-positioning means of this latest form of the invention is a specially designed article-rotating means, which is connected to second supporting block 216 for controllably rotating bat handle-engaging gripping member 218. As best seen by referring to FIG. 30B, this novel article-rotating means here comprises a drive shaft 220 that is rotatably mounted within a pair of bearing assemblies 222 carried by a second support block 216. Drive shaft 220 is controllably rotated by drive shaft motor means for rotating the drive shaft. This drive shaft motor means here comprises a commercially available servo 224, which is connected to drive shaft 220 by a coupler 226. Interconnection means, shown here as a conventional belt drive assembly 228 (FIG. 30B), is provided for interconnecting the drive shaft 220 with driven shaft 212.

Also interconnected with driven shaft 212 by means of a connector 229 is a digital encoder 230 of conventional construction which functions to correctly orient the baseball bat at the commencement of each printing cycle in accordance with instructions received from the computer means.

In order to controllably move the bat handle-engaging gripping member 218 toward and away from gripping member 210 so that the bat to be imprinted can be inserted between the bat gripping members 210 and 218 novel gripping member positioning means are provided. As best seen by referring to FIGS. 27C and 30B, this novel gripping member positioning means here comprises a support base 232 which carries second support 216 as well as servo 224 and digital encoder 230. Support base 232 is connected to a downwardly depending connector member 234, which, in turn, is connected to a roller assembly 236. Roller assembly 236 is adapted to roll along a linear guide, or roller track 238 that is carried by fixture base 208. A conventional pneumatic unit 240, which is mounted on fixture base 208, comprises a cylinder 240*a* and a retractable connector rod 240*b*, which is connected to support base 232. As indicated by the arrow 241 in FIG. 30B, pneumatic unit 240 functions to move the roller assembly and the bat handle-engaging gripping member 218 toward and away from gripping member 210 so that the bat to be imprinted can be inserted between the bat gripping members 210 and 218.

With the construction described in the preceding paragraphs, when the roller assembly is moved into the second position shown in FIG. 30B and when the motor means is energized in accordance with instructions received from the computer means, driven shaft 212, along with gripping member 218 and the baseball bat that is supported between gripping members 210 and 218 will be controllably rotated.

In accomplishing the method of the invention, with the gripping member 218 of the article-positioning means in engagement with the handle end of the bat, the motor means will cause the bat to rotate about its longitudinal axis "L" (FIG. 27C) at uniform, predetermined rate. In this regard, and by way of non-limiting example, when the image to be printed comprises, a depiction of a human figure, the desired image is either scanned or originally computer generated using specialized software of a character well known to those skilled in the art. As discussed in connection with the earlier described embodiment of the invention, because of the tapered configuration of the bat, it is necessary to produce a distorted image that is of a character, which generally conforms to the planar projection of the surface to be imprinted, the image being substantially narrowed so as to conform to the tapering of the bat. When this distorted image is printed by the printing means in accordance with appropriate instructions given by the computer means, the image will be neatly wrapped around the curved barrel surface as well as the tapered and handle portions of the bat to produce a desired non-overlapping result. As previously discussed herein, image distortion of the character described can be easily accomplished by those skilled in the art using several types of readily commercially available morphing type software, to create a file that is readable by the control circuitry of the modified microprocessor-based printer being used.

Considering next the printing means of the invention, this novel means comprises transport means for carrying the print-heads 196 longitudinally of the bat to be printed. This transport means here includes a printer head carriage 244 to which the print-heads 196 are affixed and carriage moving means comprising a longitudinally-extending screw-drive 246 to which the printer head carriage is connected in the manner shown in FIG. 26B. Mounted on carriage 244 is the print-head controller of the invention, which is generally designated in FIG. 26B by the numeral 246*a*. This print-head controller includes a digital interface 248 for the circuit boards of the controller and further includes the cables 248*a* (FIG. 28) required for interconnecting the print-head controller with the computer means. Also carried by carriage 244 is an ink bag holding station 254 for holding a plurality of ink bags (not shown) that are adapted to gravity feed ink to the print-heads. As indicated in FIG. 26A, an ink supply system 252, which includes a plurality of ink pumps 254, is mounted on supporting frame 200. In a manner well understood by those skilled in the art, ink. supply system 252 supplies ink to the ink bags carried by the ink bag holding station 254, which, in turn, supply ink as required to the print-heads 196.

Forming an important aspect of the printing means of the present invention is a screw-drive system 256, which is operably interconnected with feed screw 246 and functions to controllably rotate the feed screw in a manner to cause carriage 244, along with the print-heads 196, to travel longitudinally relative to the bat being imprinted. In the present form of the invention, screw-drive system 256 includes a drive motor, or servo 260 of conventional construction, which is operably interconnected with feed screw 246 in a manner well understood by those skilled in the art.

As previously discussed, during the printing operation, the article to be printed is controllably rotated relative to the print-heads of the printing means by motor 224, with the longitudinal axis of the article being continuously maintained by the article-positioning means in a plane which is parallel to and spaced-apart from the plane within which the ink jet nozzles of the print-heads reside. During the printing process, computer 198 communicates to the printing means via the print-head controller 244 information containing the predetermined pattern to be printed, which has either been previously scanned or originally-generated using commercially available software. Pursuant to instructions from the computer means, a printed circuit board, which comprises a part of the print-head controller 244, functions to sequentially fire the nozzles of the print-heads in a manner to controllably spray microdots of ink in a predetermined pattern onto the surface of baseball bat. Upon contact with the surface, the ink solidifies and leaves a digitally generated or scanned image or graphic on the surface without the ink jet nozzles ever coming into physical contact with the surface.

As previously mentioned, if required, computer-stored images can be edited on the computer monitor screen 198*a* (FIG. 26B) to eliminate images, add images or erase spaces for insertion of images. Such images can be nomenclature; video camera generated photo-quality images (people, objects, animals, and the like). Changes can be accomplished expeditiously just prior to commencement of the printing operation.

Figure 28:
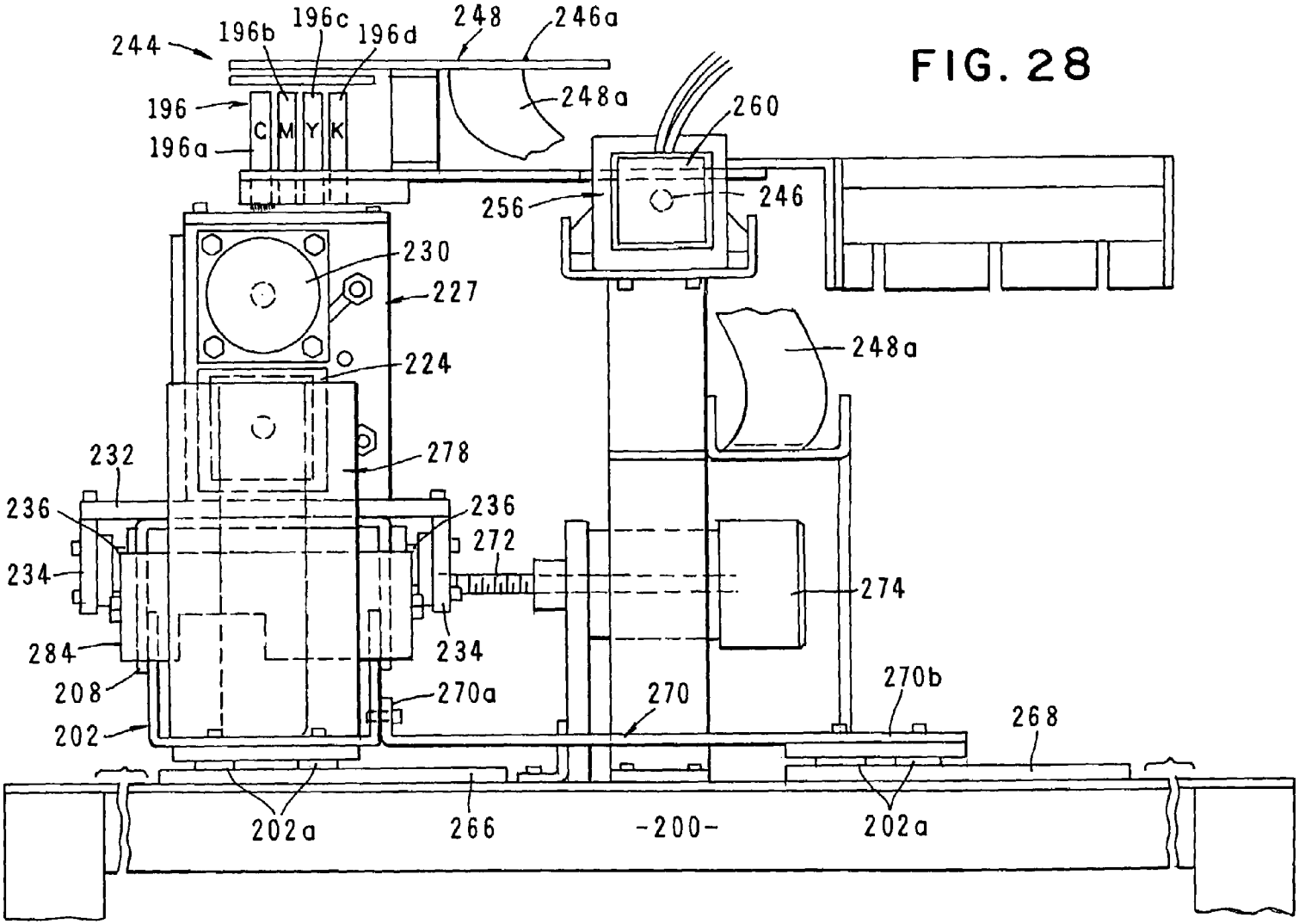
FIG. 28 is a view taken along lines 28-28 of FIG. 27C.
Figure 29:
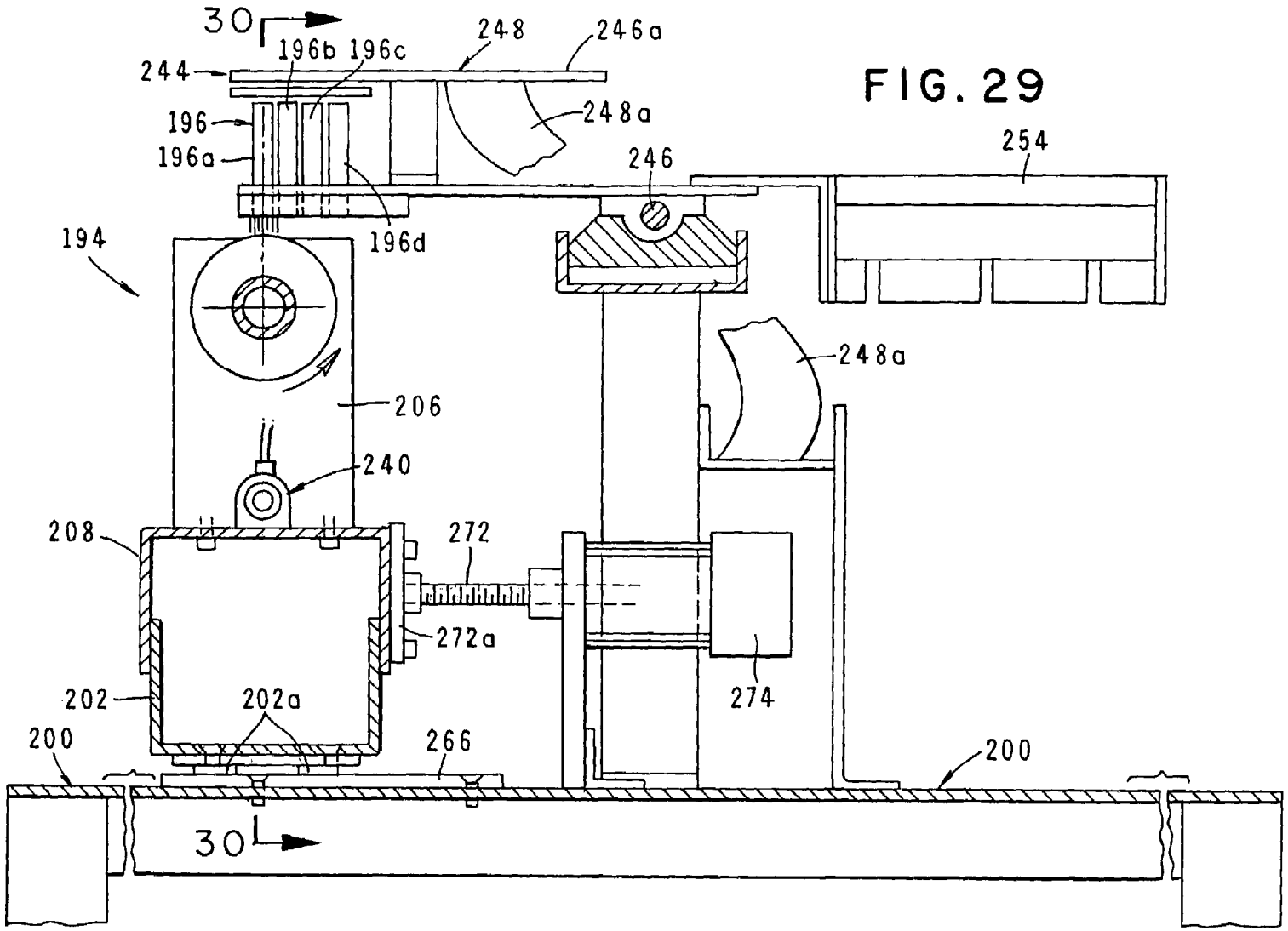
FIG. 29 is a cross-sectional view taken along lines 29-29 of FIG. 27B.

Provided proximate first support block 206 is a print-head cleaning means for cleaning the nozzles of the print-heads 196. This cleaning means here comprises a cleaning tray 247 which is adapted to contain suitable cleaning solvents for cleaning the nozzles of the print-heads as they are moved into the cleaning tray by rotation of screw 246. In this latest embodiment of the invention, four ink jet cartridges, or print-heads 196*a*, 196*b*. 196*c* and 196*d* are carried in a side-by-side relation by the printing carriage 244 (FIG. 28). Ink jet cartridge 196*a* contains cyan colored ink, ink jet cartridge 1966*b* contains magenta ink, ink jet cartridge 196*c* contains yellow ink, and ink jet cartridge 196*d* contains black ink. In order to selectively position a particular ink jet cartridge over the axial centerline of the baseball bat being printed, fixture advancing means are provided. These fixture advancing means here comprise a part of the article-positioning means of the invention and functions to selectively move the article-holding fixture 202 transversely of the support frame from a first position shown in FIG. 28 wherein ink jet cartridge 196*a* is aligned with the axial centerline of the baseball bat, to a second position wherein ink jet cartridge 196*b* is aligned with the axial centerline of the baseball bat, to a third position wherein ink jet cartridge 196*c* is aligned with the axial centerline of the baseball bat and to a fourth position wherein ink jet cartridge 196*d* is aligned with the axial centerline of the baseball bat.

With the construction described in the preceding paragraph, the apparatus of the invention is capable of first jetting the cyan (C) color onto the baseball bat in accordance with printing instructions from the computer means of the invention as the baseball bat is controllably rotated and as the carriage 244 is moved longitudinally of the baseball bat. Once this first pass is completed, the fixture advancing means of the invention is energized to transversely move carriage 244 to a position wherein the magenta (M) designated jet-head is positioned directly over the axial centerline of the baseball bat. In accordance with printing instructions from the computer means of the invention, the magenta colored ink is then jetted onto the baseball bat as the baseball bat is controllably rotated and as the carriage is moved longitudinally of the baseball bat. This done, the fixture advancing means moves the carriage 244 to a position where the print-head 196*c* is positioned directly over the axial centerline of the baseball bat so that the yellow color (Y) can be jetted on to the surface of the baseball bat as it is controllably rotated and as the carriage is moved longitudinally of the bat. Finally, the fixture advancing means moves the carriage 244 a position where the print-head 196*d* is positioned directly over the axial centerline of the baseball bat so that the black color (K) can be jetted on the surface of the bat as it is control rotated and as the carriage is moved longitudinally of the bat. This latest described method and apparatus of the invention enables imprinting indicia onto elongated, non-planar objects, such as baseball bats that only require one or two specific single colors. In this instance any specific color may be substituted for the traditional C or Y or M or K as best seen in FIGS. 26A, 26B and 28 the fixture advancing means here comprises first and second fixture advancing linear guides 266 and 268 that are mounted on support frame 200. Holding fixture 202 is slidably mounted on linear guide 266 for movement into the positions described in the preceding paragraph.

Figure 33:
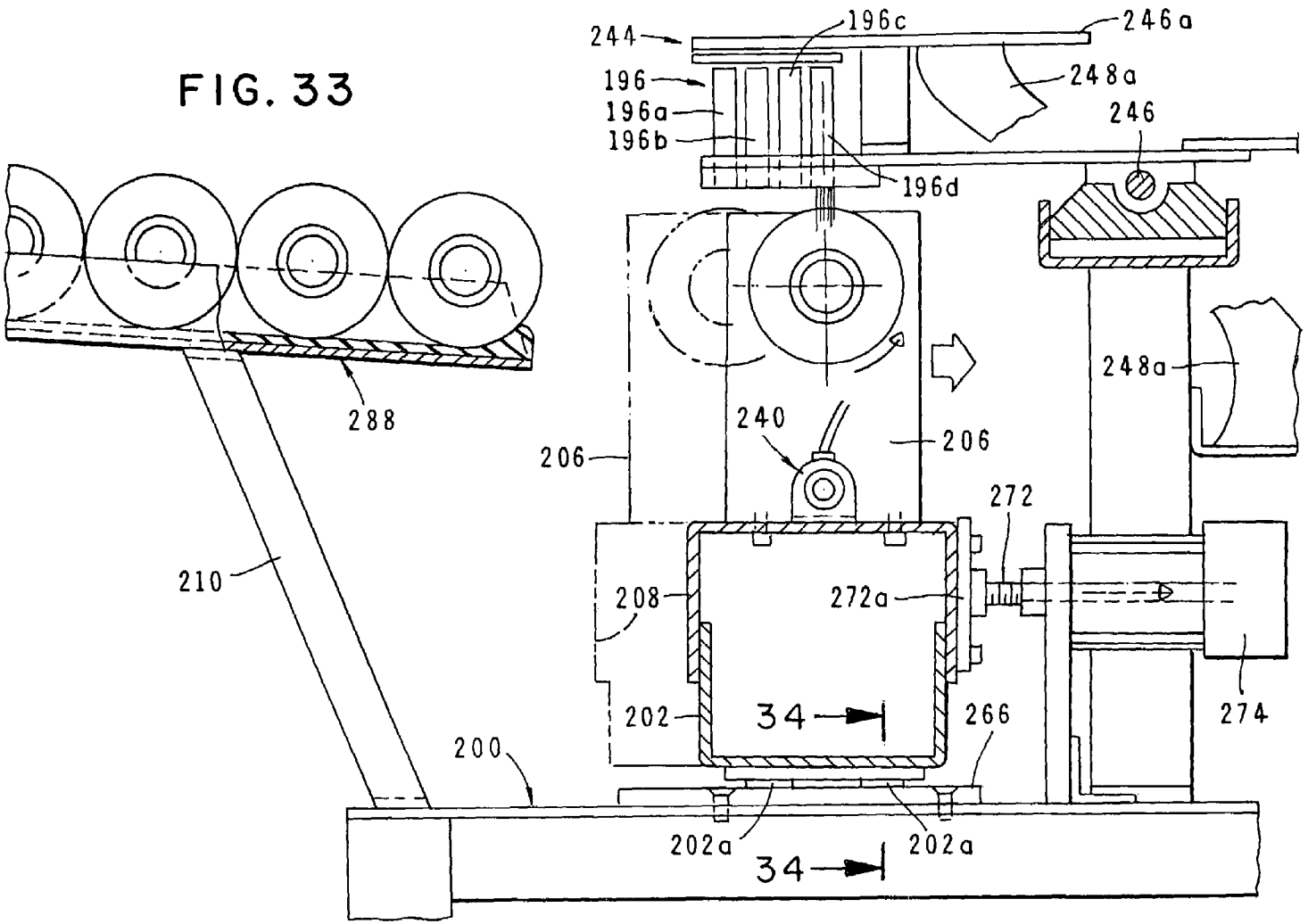
FIG. 33 is a cross-sectional view of a portion of the feed sub-system and the printing apparatus, further illustrating the operation of the feed sub-system.

A connector arm 270 is connected proximate its first end 270*a* with a holding fixture while the second end 270*b* of the connector arm is slidably mounted within fixture advancing linear guide 268. As best seen in FIG. 33 of the drawings, a rotatable screw 272 is interconnected at one end 272*a* to a holding fixture 202 and is interconnected at its opposite end to drive means for rotating shaft 272 which is here provided as a motor 274 that is carried by a support platform 200. Upon energizing motor 274, screw 272 is rotated in a manner to slidably move the holding fixture along with the baseball bat into the various positions described in the preceding paragraph.

Also forming a part of the positioning means of the present invention is vertical adjustment means for adjusting the vertical position of one end of the holding fixture and the baseball bat relative to the support frame 200 in order to adjust the level of the longitudinal axis of the baseball bat. In this latest form of the invention a vertical adjustment means comprises an adjustment assembly 278, which includes a vertical guide 280 and an adjustment plate 281 that is slidably connected to vertical guide 280. Adjustment plate 281 is pivotally connected to the holding fixture 202 by means of a connecting bar 284 so as to permit pivotal movement of one end of the holding fixture about a pivot axis 286 as the adjustment plate is slidably moved upwardly and downwardly along vertical guide 280 (FIG. 26B).

When the printing of the baseball bat is completed, pneumatic unit 240 is operated in a manner to move the roller assembly and the bat handle-engaging gripping member 218 away from gripping member 210 so that the bat that has been imprinted can be removed and, in a manner next to be described, an unprinted bat can be inserted between the bat gripping members 210 and 218.

Figure 32:
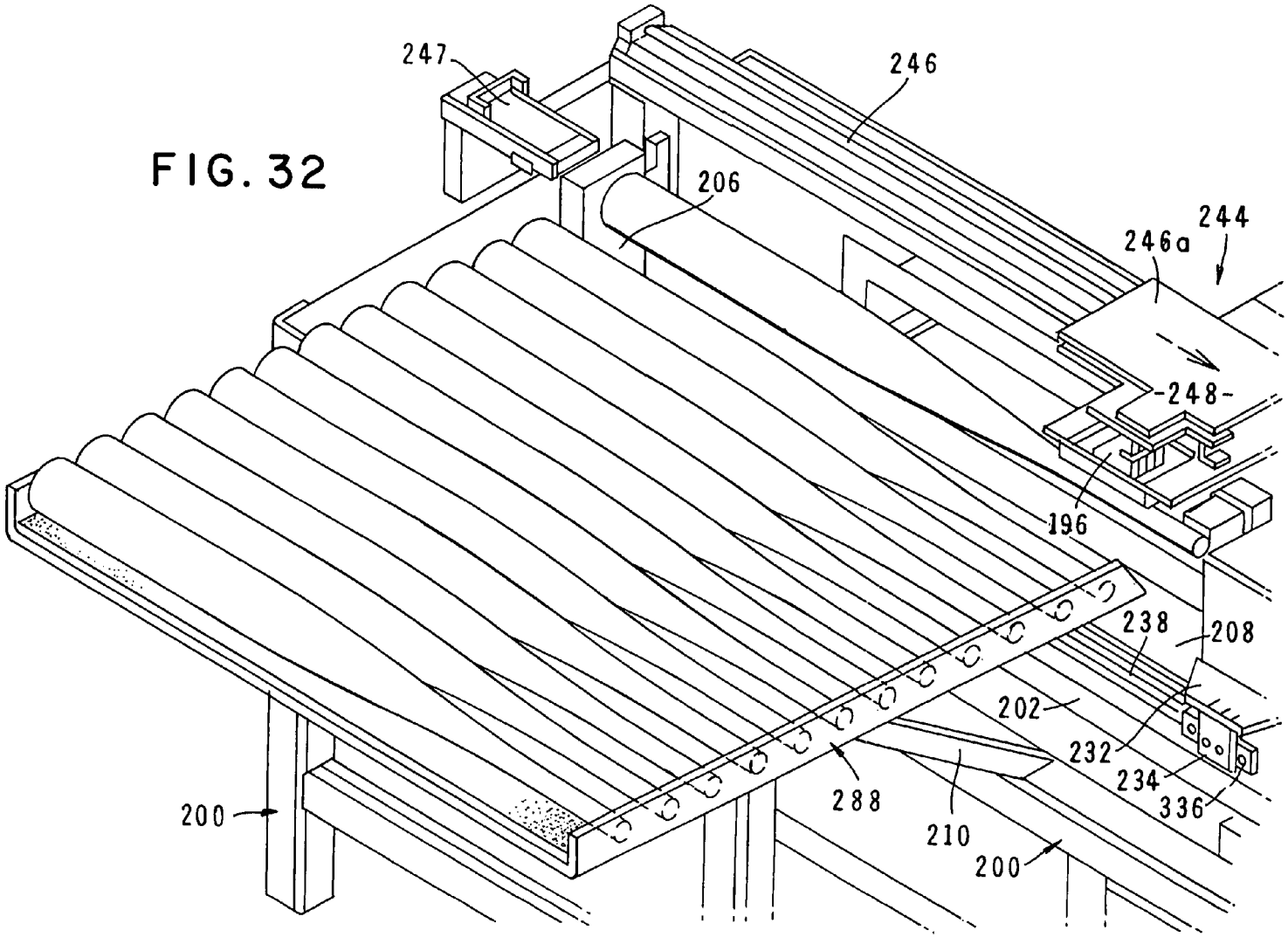
FIG. 32 is a generally perspective view of yet another form of the apparatus of the invention for imprinting a predetermined pattern on a surface of a three-dimensional article such as a baseball bat showing a bat-feed sub-system for sequentially feeding unprinted bats to the printing apparatus.

Turning next to FIGS. 32 and 33, one form of the bat loading means of the invention is there shown and can be seen to comprise a downwardly inclined holding rack 288 which is connected to support 200 by a pair of supporting braces 210. Holding rack 288 is adapted to rollably support a plurality of baseball bats which are to be imprinted by the printing means of the apparatus. As best seen by referring to FIG. 32, holding rack 288 is located intermediate the first and second gripping means of the invention so that when the bat handle gripping member 218 is moved away from gripping member 210 through operation of the pneumatic unit 240, and the printed bat is removed, an unprinted bat can easily be removed from the holding rack 288 and positioned between the gripping members 210 and 218.

Figure 35A:
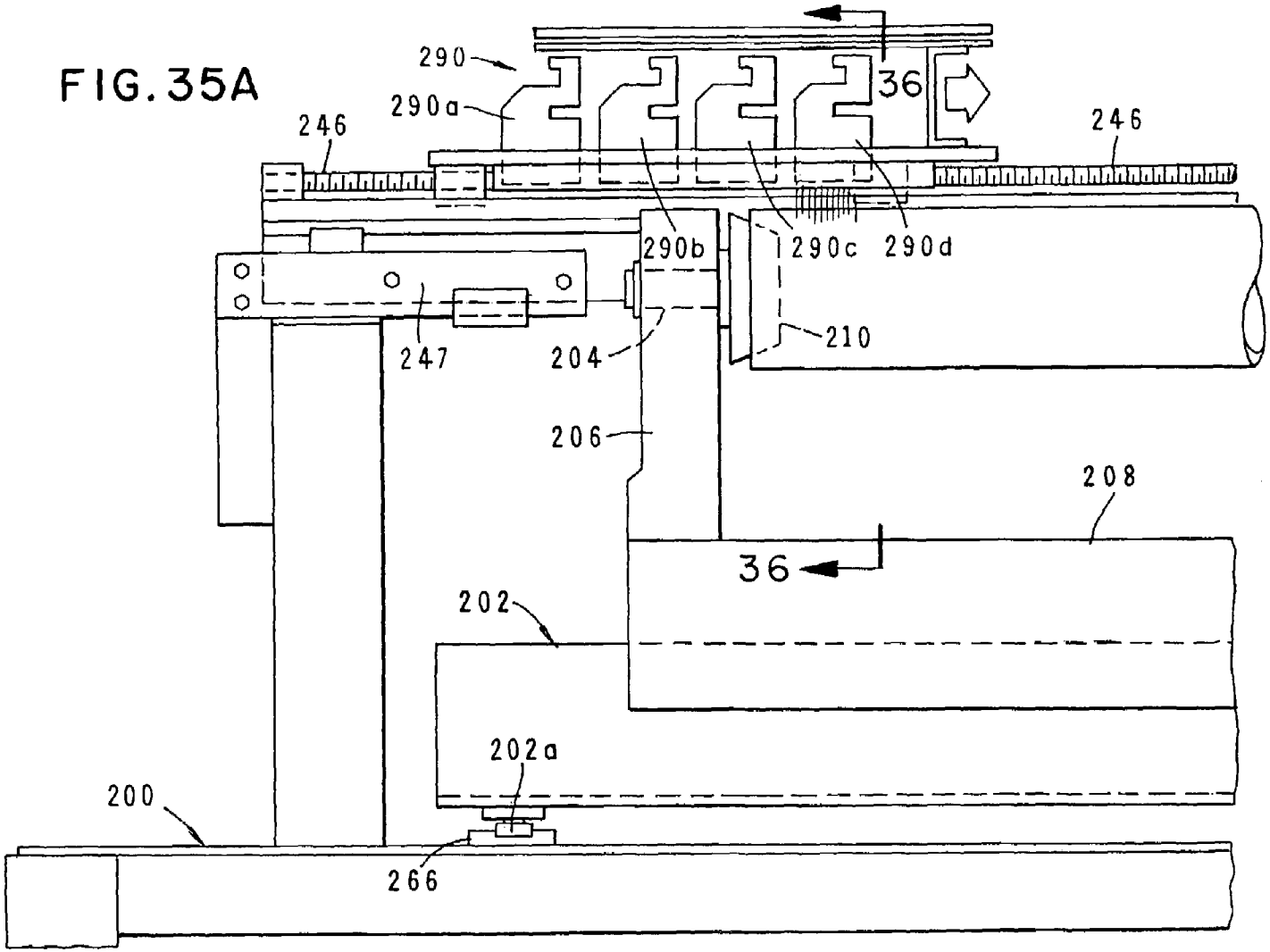
FIGS. 35A and 35B when considered together comprise an enlarged side-elevational view of still another form of the apparatus of the invention for imprinting a predetermined pattern on a surface of a three-dimensional article such as a baseball bat showing the printing heads in an inline configuration.
Figure 35B:
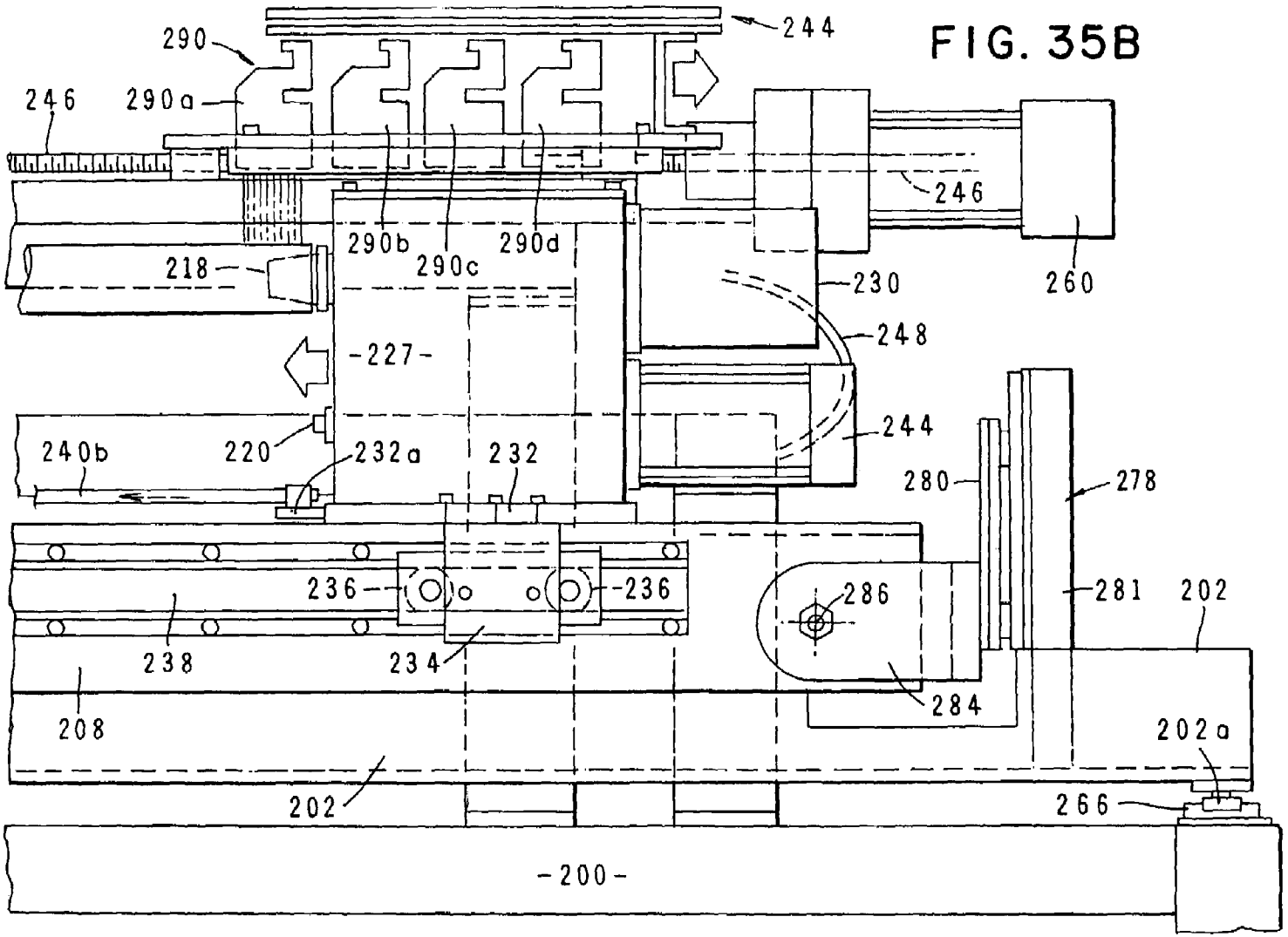
Figures 36, 37:
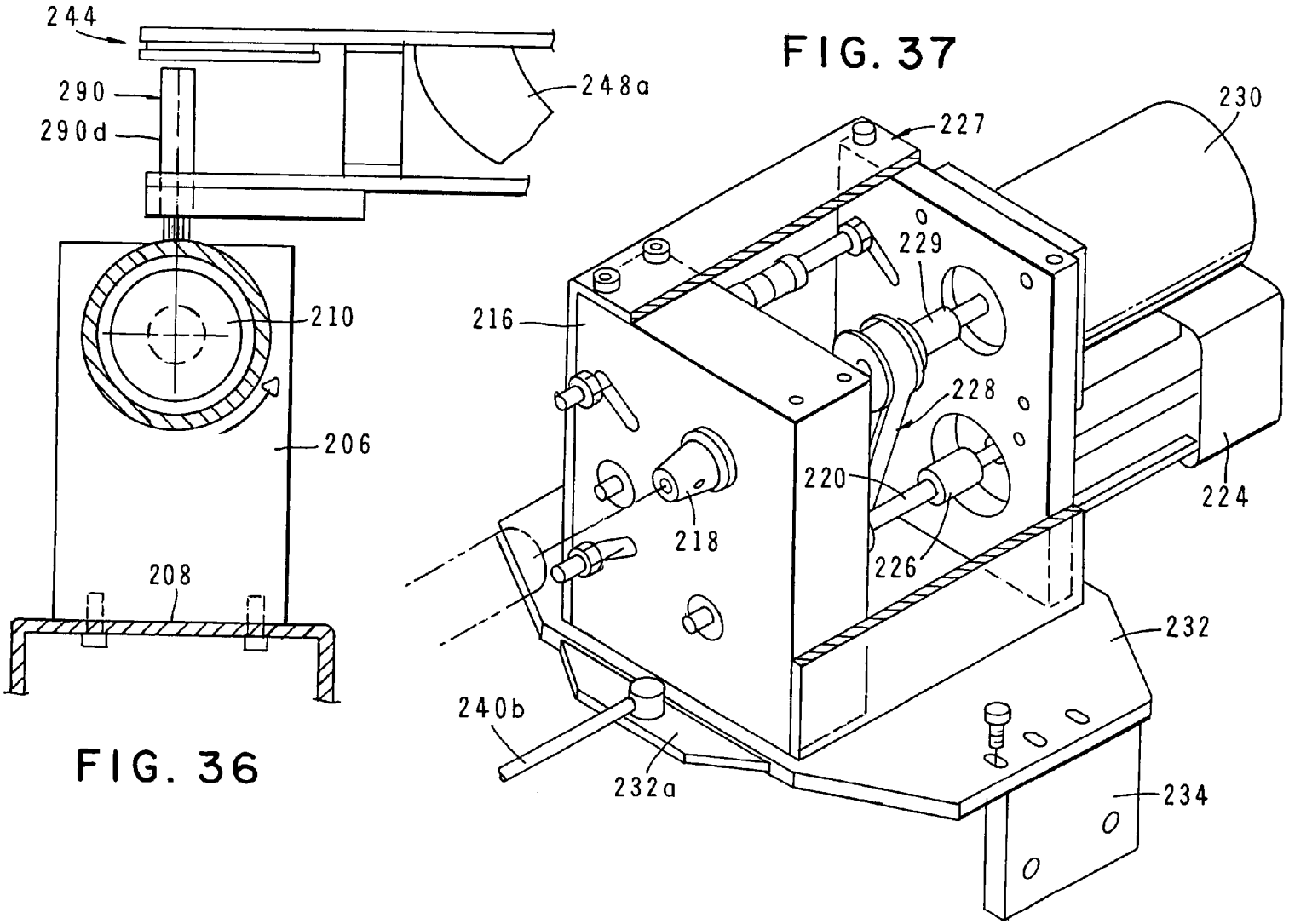
FIG. 36 is a cross-sectional view taken along lines 36-36 of FIG. 35A.
FIG. 37 is an enlarged, generally perspective view of the upper, right-hand portion of the apparatus shown in FIG. 35B showing certain of the details of construction of the drive means of the apparatus for rotating the bat to be printed.

Referring now to FIGS. 35A and 35B, an alternate form of the apparatus of the invention is there shown. This alternate form of the apparatus is similar in many respects to that illustrated in FIGS. 26 through 34 and like numerals are used in FIGS. 35A and 35B to identify like components. The primary difference between this latest embodiment of the invention and that earlier described resides in the fact that the four print-heads of the printing means of the apparatus which are generally designated by the numeral 290 are disposed in an in-line configuration rather than in a side-by-side relationship.

In the embodiment of the invention shown in FIGS. 35A and 35B, the apparatus is capable of jetting the traditional CMYK individually or the traditional C or Y or M or K colors all at once. In this configuration the system can be employed as a traditional process color output apparatus, or, alternatively, the CMYK colors can be substituted for high-speed spot color output. It is to be understood that this latter form of the apparatus of the invention can be used only with elongated, non-planar objects, because the non-planar object must be rotated or spun at a constant rate and is not stopped to advance to the next color being jetted. More particularly, in accordance with the method of this latest form of the invention, the article to be imprinted is rotated at roughly three to four revolutions a second, while the ink jet-heads are moved horizontally at a pre-calculated rate relative to the rotational speed of the article. The apparatus of this latest form of the invention will only print or jet media in one direction until the print cycle is complete. This is defined as "Uni-directional printing". The apparatus shown in FIGS. 35A and 35B has the capability of printing in this fashion in either a process or spot color mode. Further, the apparatus of this latest form of the invention enables spiral or high-speed rotary ink jet printing as a novel and new method of imprinting indicia on elongated non-planar articles.

As in the earlier described embodiments of the invention, a computer is used to communicate to the printing apparatus information containing the predetermined pattern to be printed, which has either been originally digitally created or been previously scanned using specialized software and color management tools of the character developed by Wasatch Computer Technology, Inc. and Onyx Graphics of Salt Lake City, Utah.

The primary difference between this latest embodiment of the invention and that earlier described resides in the fact that the four print-heads of the printing means of the apparatus which are generally designated by the 290 are disposed in an in-line configuration rather than in a side-by-side relationship.

In the embodiment of the invention shown in FIGS. 35A and 35B, the apparatus is capable of jetting the traditional CMYK individually or the traditional C or Y or M or K colors all at once. In this configuration the system can be employed as a traditional process color output apparatus, or, alternatively, the CMYK colors can be substituted for high-speed spot color output. It is to be understood that this latter form of the apparatus of the invention can be used only with elongated, non-planar objects, because the non-planar object must be rotated or spun at a constant rate and is not stopped to advance to the next color being jetted. More particularly, in accordance with the method of this latest form of the invention, the article to be imprinted is rotated at roughly three to four revolutions a second, while the ink jet-heads are moved horizontally at a pre-calculated rate relative to the rotational speed of the article. The apparatus of this latest form of the invention will only print or jet media in one direction until the print cycle is complete. This is defined as "Uni-directional printing". The apparatus shown in FIGS. 35A and 35B has the capability of printing in this fashion in either a process or spot color mode. Further, the apparatus of this latest form of the invention enables spiral or high-speed rotary ink jet printing as a novel and new method of imprinting indicia on elongated non-planar articles.

As in the earlier described embodiments of the invention, a computer is used to communicate to the printing apparatus information containing the predetermined pattern to be printed, which has either been originally digitally created or been previously scanned using specialized software and color management tools of the character developed by Wasatch Computer Technology, Inc. and Onyx Graphics of Salt Lake City, Utah.

Using the techniques described in the preceding paragraphs, high quality images can quickly and easily be imprinted on a variety of different types of materials and upon the non-planar surfaces of a number of types of irregularly configured three-dimensional articles including baseball bats.

Figure 38:
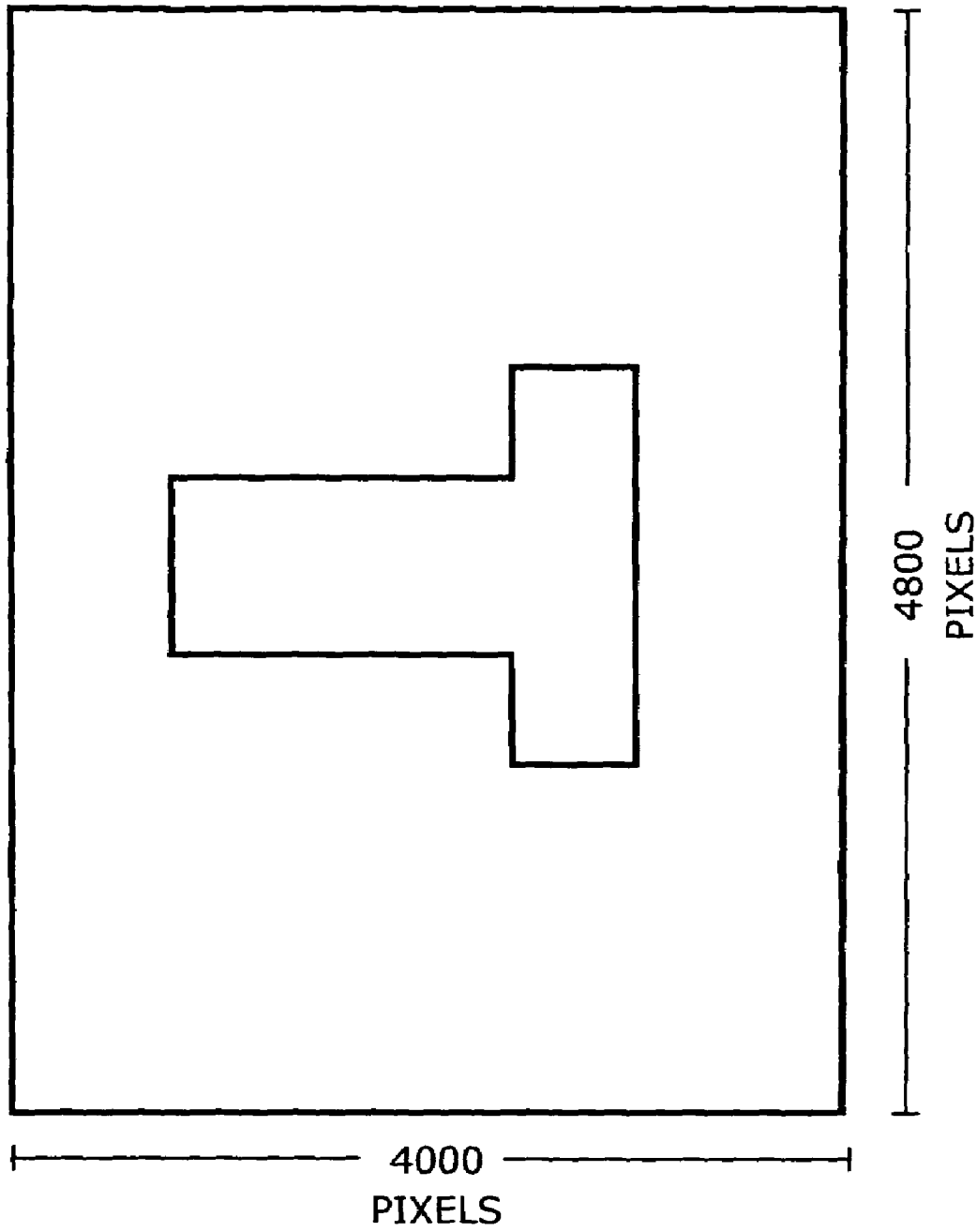
FIG. 38 is a generally diagrammatic view of the sample image that is to be imprinted on a baseball bat.
Figure 39:
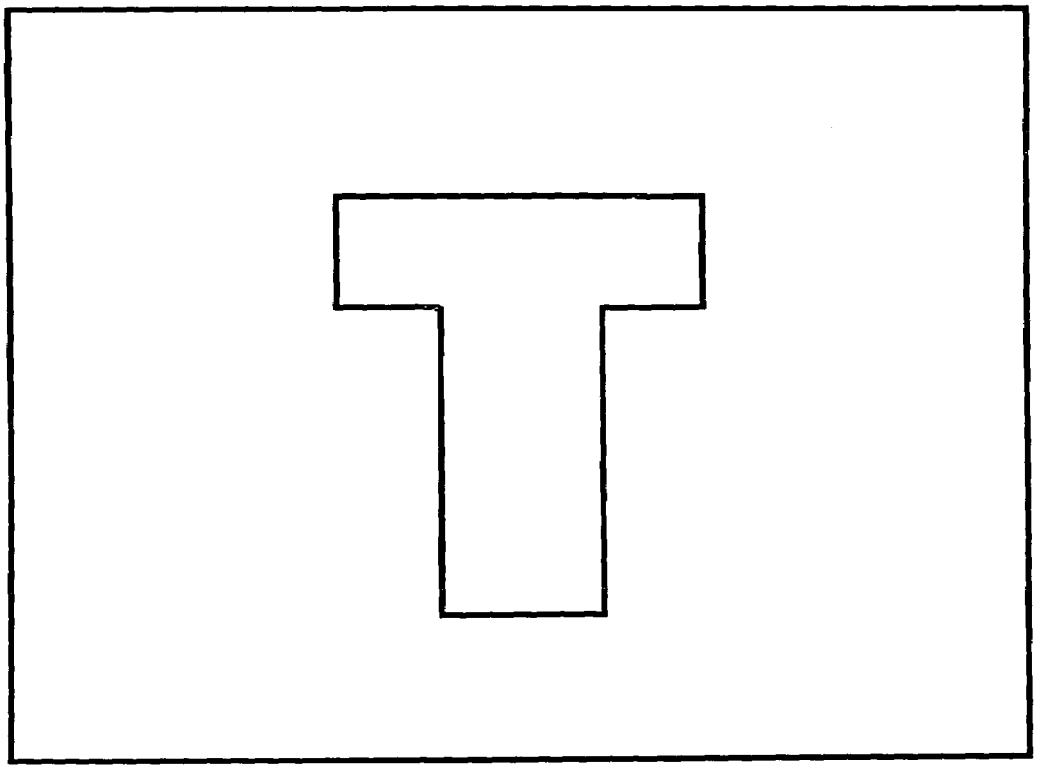
FIG. 39 is a generally diagrammatic view as it appears on screen in the raster input program.
Figure 40:
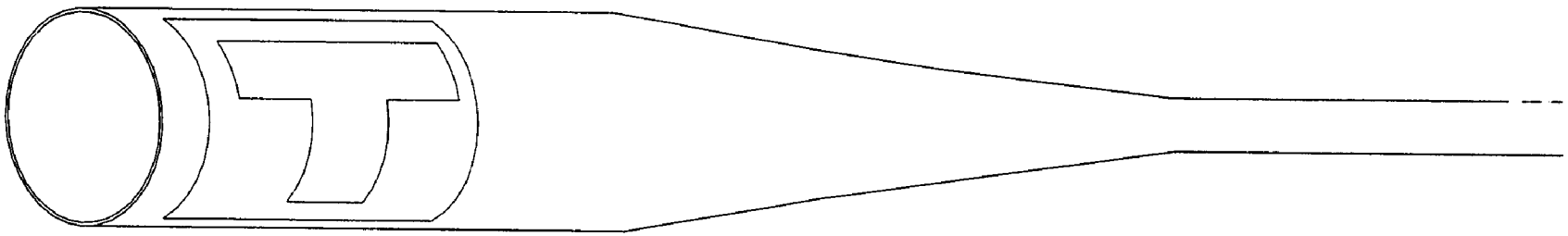
FIG. 40 is a generally perspective fragmentary view of a baseball bat showing the sample image imprinted thereon.

In the paragraphs which follow, the method and apparatus for spiral printing an image on a cylindrical object, such as a baseball bat, will be further discussed. Referring particularly to FIGS. 38 through 44, the method of imprinting an exemplary image on a baseball bat is there illustrated. More particularly, FIG. 38 illustrates an exemplary image in the form of the letter "T" as it appears on screen in the raster image program (RIP). This image is 400 dots per inch (DPI) so that the 12 inch by 10 inch image illustrated in FIG. 38 would be 4800 by 4000 pixels. FIG. 39 shows the flattened, unwrapped image as it will be delivered to the baseball bat printing apparatus (see FIG. 45). As illustrated in FIG. 40, the top of the image will eventually be printed at the barrel end of the bat with the image wrapped around the bat left to right.

Figure 41:
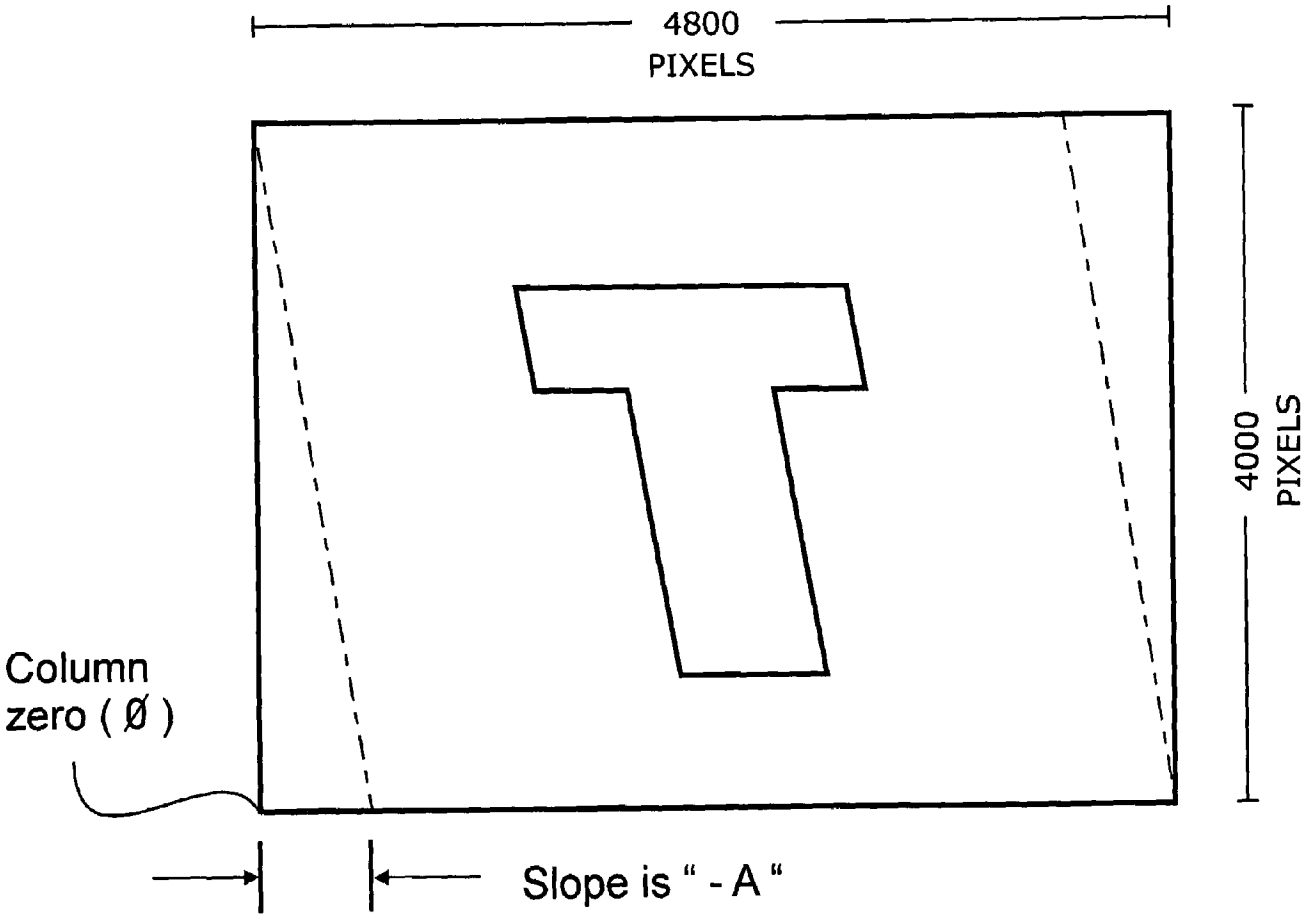
FIG. 41 is a generally diagrammatic view of the sample image as it appears in a slanted configuration to adjust for the natural slant inherent in the spiral printing method of the invention.

In the printer image pre-processing the image is reverse slanted in the manner shown in FIG. 41 to adjust for the natural slant inherent in spiral print method. As shown in FIG. 41 the image becomes wider by "A" columns where:

$$A = \frac{(N-1)}{P} \qquad 1$$

A is image lines advanced per bat rotation; N is the number of nozzles in a head and P is the number of passes.

For the s Spectra 128 and 2 Pass mode $$A = \frac{(128-1)}{2} = 63.5, \text{ or approximately } 63.$$

Therefore, the amount of slant top to bottom is 63 lines at the 400 DPI, that is 0.1575 inches when printed. As will be discussed in greater detail hereinafter, this pre-compensates for the natural slope that is introduced when the image is printed.

Figure 42:
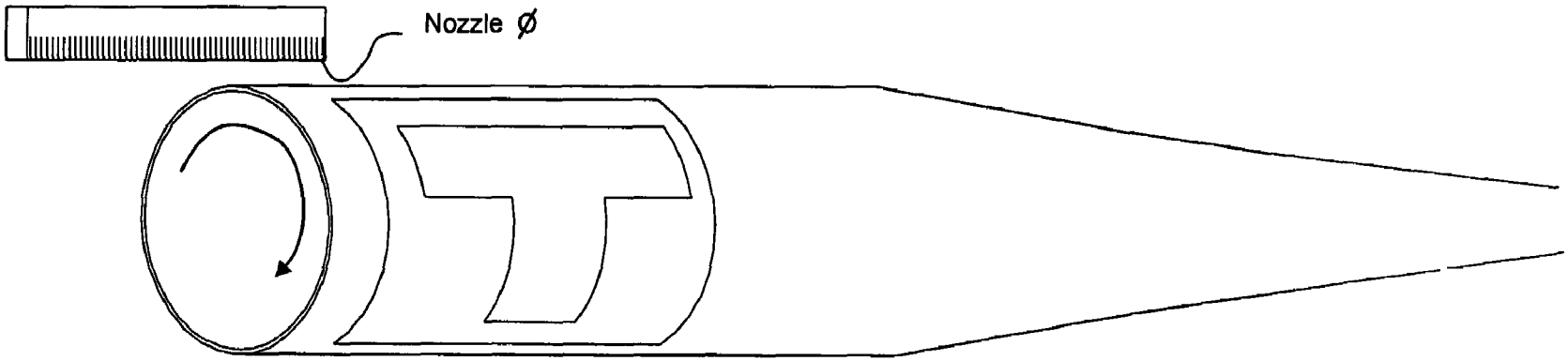
FIG. 42 is a generally diagrammatic, perspective view illustrating the relative motion between the print-heads of the printing apparatus of the invention and a baseball bat to be imprinted with the sample image during the spiral printing method.

As illustrated in FIG. 42 of the drawings, in the printer the motion is configured to advance the print-head 290 left to right by distance "A" for each rotation of the bat (see also FIGS. 35A and 35B). It is to be understood that in actual practice, the bat rotates once to accelerate to speed before the printing begins.

As indicated in the table which follows, during the printing step during revolution Ø of the bat, nozzle Ø prints the left edge (column Ø ) of the pre-compensated image depicted in FIG. 4. On revolution 1 of the bat, nozzle Ø prints column 63, which, due to nozzle pitch, maps nozzle 1 to column 55, maps nozzle 2 to column 47, maps nozzle 3 to column 39, maps nozzle 4 to column 31, maps nozzle 5 to column 23, maps nozzle 6 to column 15 and maps nozzle 7 to column 7. Similarly on revolution 2, of the bat, nozzle Ø prints column 126, which, due to nozzle pitch, maps nozzle 1 to column 118, maps nozzle 2 to column 110, maps nozzle 3 to column 102, maps nozzle 4 to column 94, maps nozzle 5 to column 86, maps nozzle 6 to column 78 and maps nozzle 7 to column 70 and so on as shown in the table.

| Matrix to Calculate Nozzle to Column Mapping On Each Revolution of the Bat | |
|---|---|
| Advance/Rev (A) | 63 (TJiisisA = (N − 1)/Passes) |
| Pitch of nozzles (P) | 8 (This is ImageDPI/PrintheadNozzlePitch) |

Array should be widened for nozzles 0-127 and as many revolutions as required to complete the image.

| Revolution Number | Nozzle | | | | | | |
|---|---|---|---|---|---|---|---|
| 0 | 0 | −8 | −16 | −24 | −32 | −40 | ^8 |
| 1 | 63 | 55 | 47 | 39 | 31 | 23 | 15 |
| 2 | 126 | 118 | 110 | 102 | 94 | 86 | 78 |
| 3 | 189 | 181 | 173 | 165 | 157 | 149 | 141 |
| 4 | 252 | 244 | 236 | 228 | 220 | 212 | 204 |
| 5 | 315 | 307 | 299 | 291 | 283 | 275 | 267 |
| 6 | 378 | 370 | 362 | 354 | 346 | 338 | 330 |
| 7 | 441 | 433 | 425 | 417 | 409 | 401 | 393 |
| 8 | 504 | 496 | 488 | 480 | 472 | 464 | 456 |
| g | 567 | 559 | 551 | 543 | 535 | 527 | 519 |
| 10 | 630 | 622 | 614 | 606 | 598 | 590 | 582 |
| 11 | 693 | 685 | 677 | 669 | 661 | 653 | 645 |
| 12 | 756 | 748 | 740 | 732 | 724 | 716 | 708 |
| 13 | 819 | 811 | 803 | 795 | 787 | 779 | 771 |
| 14 | 882 | 874 | 866 | 858 | 850 | 842 | 834 |
| 15 | 945 | 937 | 929 | 921 | 913 | 905 | 897 |
| 16 | 1008 | 1000 | 992 | 984 | 976 | 968 | 960 |
| 17 | 1071 | 1063 | 1055 | 1047 | 1039 | 1031 | 1023 |
| 18 | 1134 | 1126 | 1118 | 1110 | 1102 | 1094 | 1086 |
| 19 | 1197 | 1189 | 1181 | 1173 | 1165 | 1157 | 1149 |
| 20 | 1260 | 1252 | 1244 | 1236 | 1228 | 1220 | 1212 |
| 21 | 1323 | 1315 | 1307 | 1299 | 1291 | 1283 | 1275 |
| 22 | 1386 | 1378 | 1370 | 1362 | 1354 | 1346 | 1338 |
| 23 | 1449 | 1441 | 1433 | 1425 | 1417 | 1409 | 1401 |
| 24 | 1512 | 1504 | 1496 | 1488 | 1480 | 1472 | 1464 |
| 25 | 1575 | 1567 | 1559 | 1551 | 1543 | 1535 | 1527 |
| 26 | 1638 | 1630 | 1622 | 1614 | 1606 | 1598 | 1590 |
| 27 | 1701 | 1693 | 1685 | 1677 | 1669 | 1661 | 1653 |
| 28 | 1764 | 1756 | 1748 | 1740 | 1732 | 1724 | 1716 |
| 29 | 1827 | 1819 | 1811 | 1803 | 1795 | 1787 | 1779 |
| 30 | 1890 | 1882 | 1874 | 1866 | 1858 | 1850 | 1842 |
| 31 | 1953 | 1945 | 1937 | 1929 | 1921 | 1913 | 1905 |
| 32 | 2016 | 2008 | 2000 | 1992 | 1984 | 1976 | 1968 |
| 33 | 2079 | 2071 | 2063 | 2055 | 2047 | 2039 | 2031 |

Proprietary Information of J. Randel LaCaze S Paul Martinez
Note:
Nozzle-Revs with numbers less than 0 or greater than the last column of the image are located off the image during that revolution and will not be jetted.

| | .2L | | 124 | 125\| | 126\| | 127\| |
|---|---|---|---|---|---|---|
| −56 | −64 | −72 | −992 | −1000 | −1008 | −1016 |
| 7 | −1 | −9 | −929 | −937 | −945 | −953 |
| 70 | 62 | 54 | −866 | −874 | −882 | −890 |
| 133 | 125 | 117 | −803 | −811 | −819 | −827 |
| 196 | 188 | 180 | −740 | −748 | −756 | −764 |
| 259 | 251 | 243 | −677 | −685 | −693 | −701 |
| 322 | 314 | 306 | −614 | −622 | −630 | −638 |
| 385 | 377 | 369 | −551 | −559 | −567 | −575 |
| 448 | 440 | 432 | −488 | −496 | −504 | −512 |

-continued

| .2L | | | 124 | 125l | 126l | 127l |
|---|---|---|---|---|---|---|
| 511 | 503 | 495 | −425 | −433 | −441 | −149 |
| 574 | 566 | 558 | −362 | −370 | −378 | −386 |
| 637 | 629 | 621 | −299 | −307 | −315 | −323 |
| 700 | 692 | 684 | −236 | −244 | −252 | −260 |
| 763 | 755 | 747 | −173 | −181 | −189 | −197 |
| 826 | 818 | 810 | −110 | −118 | −126 | −134 |
| 889 | 881 | 873 | −47 | −55 | −63 | −71 |
| 952 | 944 | 936 | 16 | 8 | 0 | −8 |
| 1015 | 1007 | 999 | 79 | 71 | 63 | 55 |
| 1078 | 1070 | 1062 | 142 | 134 | 126 | 118 |
| 1141 | 1133 | 1125 | 205 | 197 | 189 | 181 |
| 1204 | 1196 | 1188 | 268 | 260 | 252 | 244 |
| 1267 | 1259 | 1251 | 331 | 323 | 315 | 307 |
| 1330 | 1322 | 1314 | 394 | 386 | 378 | 370 |
| 1393 | 1385 | 1377 | 457 | 449 | 441 | 433 |
| 1456 | 1448 | 1440 | 520 | 512 | 504 | 496 |
| 1519 | 1511 | 1503 | 583 | 575 | 567 | 559 |
| 1582 | 1574 | 1566 | 646 | 638 | 630 | 622 |
| 1645 | 1637 | 1629 | 709 | 701 | 693 | 685 |
| 1708 | 1700 | 1692 | 772 | 764 | 756 | 748 |
| 1771 | 1763 | 1755 | 835 | 827 | 819 | 811 |
| 1834 | 1826 | 1818 | 898 | 890 | 882 | 874 |
| 1897 | 1889 | 1881 | 961 | 953 | 945 | 937 |
| 1960 | 1952 | 1944 | 1024 | 1016 | 1008 | 1000 |
| 2023 | 2015 | 2007 | 1087 | 1079 | 1071 | 1063 |

To calculate Column:

$$\text{Column} = (Rev \times A) - (\text{Nozzle} \times \text{Interlace})$$

$$\text{Where Interlace} = \frac{\text{Imaged } PI}{\text{Head } DPI} = \frac{400}{50} = 8$$

Figure 43:
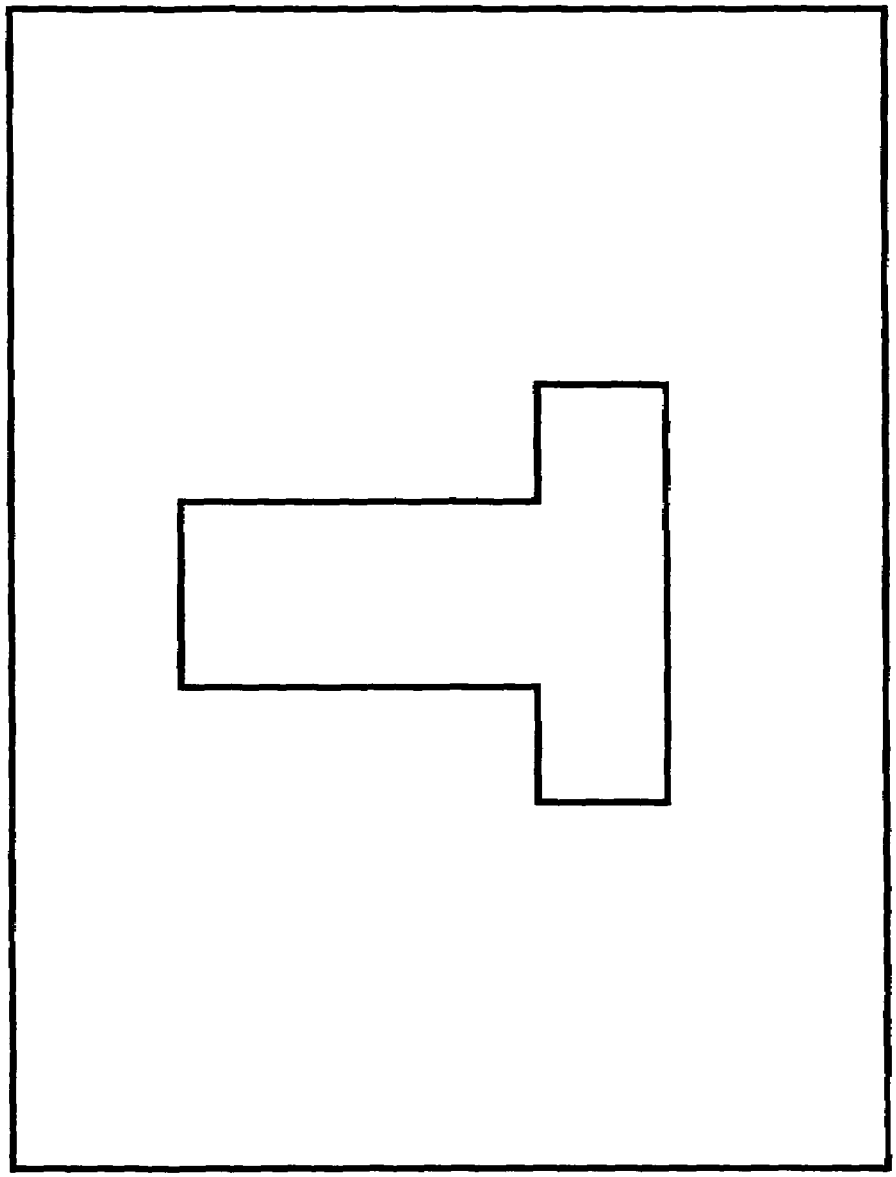
FIG. 43 is a generally diagrammatic view of the compensated sample image as it appears after printing in accordance with the spiral printing method of the apparatus.
Figure 44:
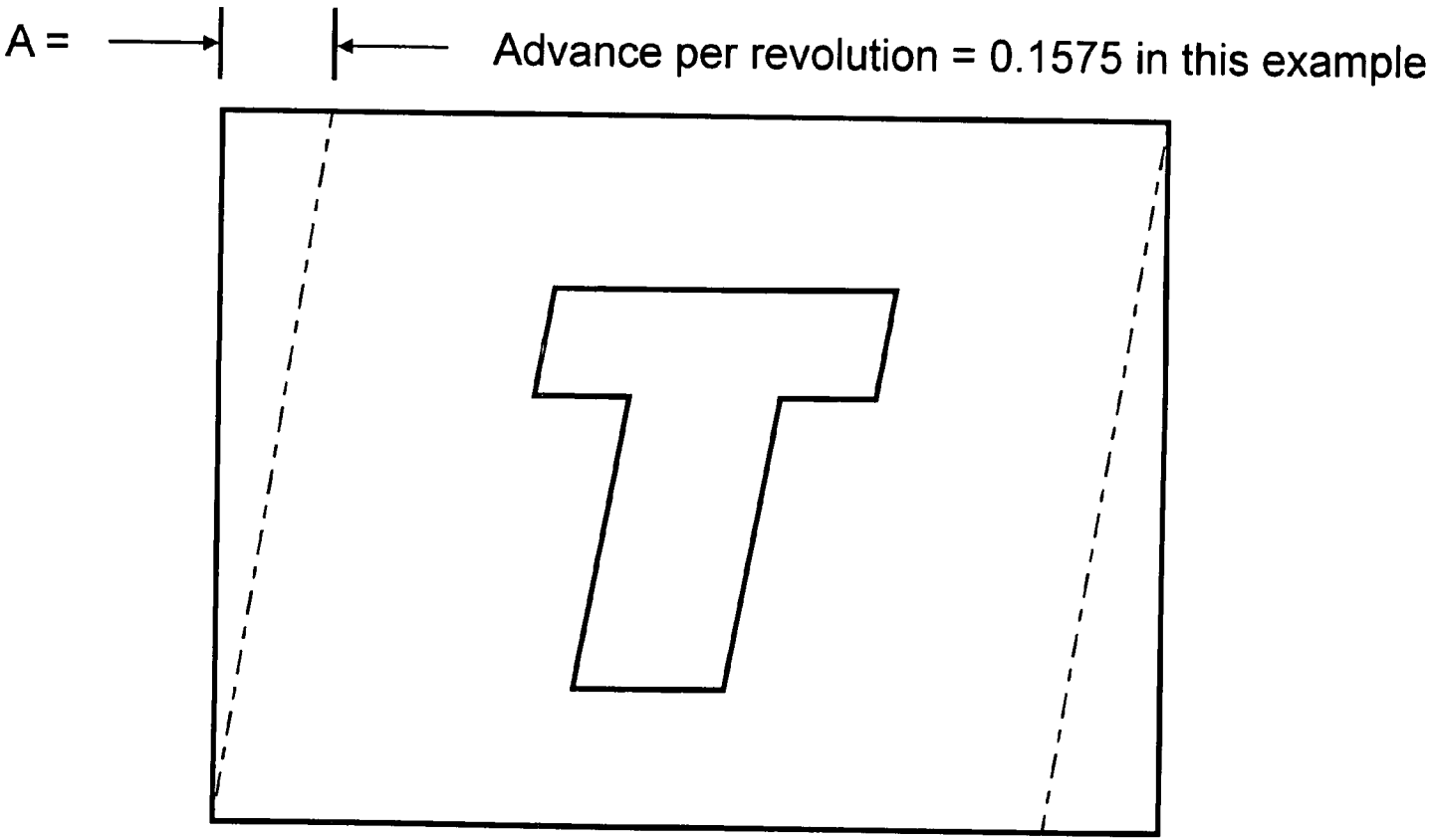
FIG. 44 is a generally diagrammatic view illustrating the appearance of the sample image if it had not been compensated for during the spiral printing method.
Figure 45:
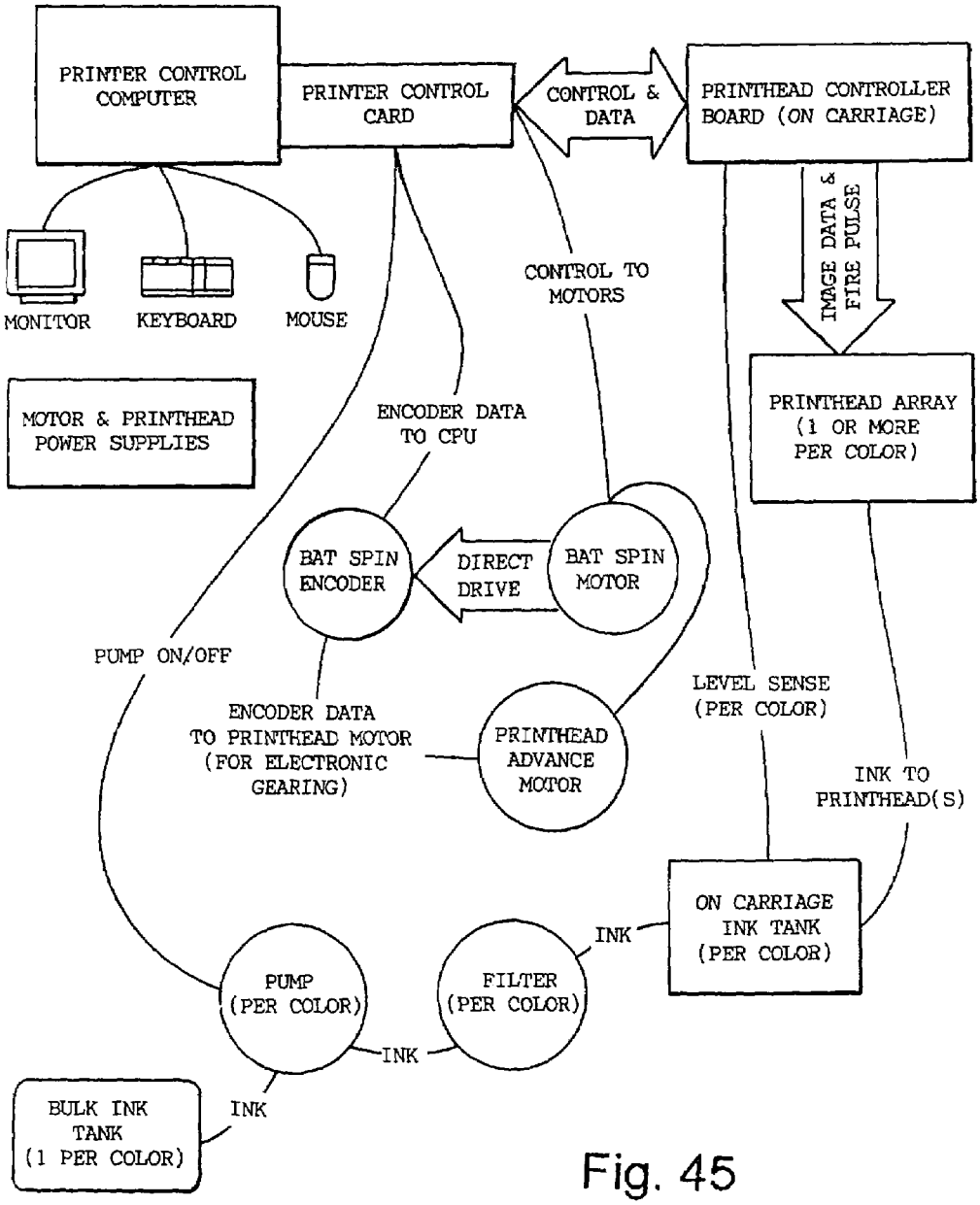
FIG. 45 is a generally diagrammatic view illustrating the interaction among the various components that make up the apparatus of one form of the apparatus of the invention.

During the bat printing operation, bat revolutions and head advance continue until the last nozzle is no longer over the image. FIG. 43 shows pre-compensated image after printing. FIG. 44 shows the image printed without pre-compensation to further illustrate the natural slant of the spiral printing method.

Is be observed that in the two pass mode example nozzles 126 and 127 are re-printing the same as nozzles Ø and 1 and must be disabled. In the one pass mode this happens with nozzle 127 overlapping nozzle Ø and, therefore, only nozzle 127 must be disabled.

It is also to be observed that the speed of bat rotation is a function of head firing frequency and the number of pixels printed around the bat circumference. The pixel count around the circumference of the bat should be a multiple of the bat rotation encoder. 4000 pixels is here chosen since the encoder provides 20,000 counts per revolution. For a bat diameter of 2.75 inches the circumference is 8.64 inches. This means that 4000 dots are delivered in 8.64 inches resulting in 463 DPI in that direction. On a smaller diameter bat the DPI is even larger.

$$\text{Bat surface speed} = \frac{\text{Head fire frequency}}{4000}.$$

For example $$\frac{16{,}000}{4000} = 40 \text{ inches/sec.}$$

Assuming a 2.75 inch diameter bat:

$$\frac{40}{\text{sec.}} \times \frac{\text{Rev.}}{8.64} = \frac{40\,\text{Rev.}}{8.64\,\text{sec.}} = 4.63 \text{ Rev./sec.}$$

Referring next to FIGS. 46A through 46D, There is shown a generally graphical representation of the physical relationship between pixel positions on a cylindrical object and the nozzles of the print-head which deliver the ink drop in a one pass printing mode.

In the horizontal headings of FIGS. 46A through 46D (identified as Image Pixel Rotation in degrees), it can be seen that during printing the rotational advance is delivered in increments of 0.625 degrees. As shown in the vertical column, pixels are delivered in increments of 22.5, (that is starting in FIG. 46A with 22.5 and ending with 337.5) with a nozzle pitch of 4 image lines.

As indicated by the various patterns and numbers shown in FIGS. 46A through 46D, each pixel is delivered by an 8 nozzle print-head in a one pass mode to achieve a 48×16 pixel image. More particularly, it is to be noted that in image having a size of 48×16 pixels can be quickly and conveniently imprinted onto a cylindrical object of the character shown in FIG. 42 by the novel spiral printing method of the invention.

Considering next FIGS. 47A through 47D, these Figures are similar to FIGS. 46A through 46D, but show a generally graphical representation of the physical relationship between pixel positions on a cylindrical object and the nozzles of the print-head which deliver the ink drop in a two pass printing mode.

Turning to FIG. 48, this Figure comprise a tabular representation showing pixel positions on the bat relative to the total 127 printer head nozzles of one form of the printing assembly that are delivering the ink drops during the spiral printing operation.

A study of FIGS. 46 through 48 clearly shows the novel ability of the apparatus of the invention is to seamlessly print a selected image in a rotary, spiral, uni-directional "inline", non-indexing manner wherein printing speed and print quality are achieved by synchronizing the rotational speed of the object being printed with the movement and firing sequence of the individual print-head nozzles.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

I claim:

1. A printing apparatus for printing indicia on a plurality of three-dimensional articles each having a first end, a second end, a longitudinal axis and a curved surface upon which the indicia is to be imprinted, the apparatus comprising:

(a) a supporting frame;

(b) printing means connected to said supporting frame for printing indicia on the three-dimensional articles, said printing means including a carriage carried by and movable longitudinally of said supporting frame, carriage moving means for moving said carriage longitudinally of said supporting frame and a plurality of print heads disposed in a side-by-side relationship and connected to said carriage; and (c) positioning means connected to said supporting frame for positioning a selected one of the plurality of three-dimensional articles relative to said printing means in a manner such that the longitudinal axis of the selected one of the plurality of three-dimensional articles is maintained within a plane that is spaced-apart from said carriage of said printing means, said positioning means comprising computer means operably associated with said printing means for providing printing instructions thereto and an article-holding assembly, including a holding fixture carried by said supporting frame.

2. The printing apparatus as defined in claim 1 further including fixture advancing means for selectively moving said holding fixture transversely of said supporting frame.

3. The printing apparatus as defined in claim 2 further including vertical adjustment means carried by said supporting frame for adjusting the vertical position of said holding fixture.

4. The printing apparatus as defined in claim 3 in which said printing means comprises an ink supply system carried by said supporting frame and cooperatively associated with said print-heads for supplying ink to said print-heads.

* * * * *